US007978162B2

(12) United States Patent
Maruoka et al.

(10) Patent No.: US 7,978,162 B2
(45) Date of Patent: Jul. 12, 2011

(54) LIQUID CRYSTAL DISPLAY

(75) Inventors: Yoshio Maruoka, Mobara (JP); Toshiki Misonou, Ichihara (JP); Toshio Maeda, Chiba (JP); Akihiro Watanabe, Mobara (JP); Hideki Nakagawa, Chiba (JP)

(73) Assignees: Hitachi, Ltd., Tokyo (JP); Hitachi Displays, Ltd., Chiba (JP)

( * ) Notice: Subject to any disclaimer, the term of this patent is extended or adjusted under 35 U.S.C. 154(b) by 705 days.

(21) Appl. No.: 11/263,032

(22) Filed: Nov. 1, 2005

(65) Prior Publication Data

US 2006/0050045 A1 Mar. 9, 2006

Related U.S. Application Data

(63) Continuation of application No. 10/141,942, filed on May 10, 2002, now Pat. No. 6,980,189.

(30) Foreign Application Priority Data

Jun. 8, 2001 (JP) ..... 2001-173410

(51) Int. Cl.
*G09G 3/36* (2006.01)

(52) U.S. Cl. ..... 345/87; 345/94; 345/96; 345/98; 345/100; 345/102

(58) Field of Classification Search ..... 345/87, 345/204, 208, 547, 74.1, 539, 669, 8, 3.2, 345/24, 75.2, 94–102, 589, 640, 660, 672; 349/37, 61, 155; 348/671, 690, 694, 607, 348/739, 441

See application file for complete search history.

(56) References Cited

U.S. PATENT DOCUMENTS

| | | | | | |
|---|---|---|---|---|---|
| 4,567,768 | A | * | 2/1986 | Satoh et al. | 73/606 |
| 4,584,673 | A | * | 4/1986 | Kuijk | 365/219 |
| 5,414,443 | A | | 5/1995 | Kanatani et al. | |
| 5,499,128 | A | * | 3/1996 | Hasegawa et al. | 349/155 |
| 5,508,813 | A | * | 4/1996 | Sakaegi et al. | 386/300 |
| 5,515,190 | A | * | 5/1996 | Ogawa et al. | 349/124 |
| 5,579,026 | A | * | 11/1996 | Tabata | 345/8 |
| 5,638,088 | A | * | 6/1997 | Mano et al. | 345/95 |
| 5,649,217 | A | * | 7/1997 | Yamanaka et al. | 710/52 |
| 5,691,778 | A | * | 11/1997 | Song | 725/59 |
| 5,781,165 | A | * | 7/1998 | Tabata | 345/8 |
| 5,841,475 | A | * | 11/1998 | Kurihara et al. | 375/240.15 |
| 5,844,536 | A | * | 12/1998 | Okada et al. | 345/94 |
| 5,844,538 | A | * | 12/1998 | Shiraki et al. | 345/98 |
| 5,860,721 | A | * | 1/1999 | Bowron et al. | 353/101 |
| 5,940,142 | A | * | 8/1999 | Wakitani et al. | 348/671 |

(Continued)

FOREIGN PATENT DOCUMENTS

JP 05-216430 2/1992

(Continued)

*Primary Examiner* — Prabodh M Dharia
(74) *Attorney, Agent, or Firm* — Stites & Harbison PLLC; Juan Carlos A. Marquez, Esq.

(57) ABSTRACT

In a liquid crystal display device which inputs analogue video signals after phase development, the deterioration of display quality due to the irregularities of circuit can be reduced. To correct the irregularities due to a plurality of analogue circuits, the liquid crystal display device includes look up tables for a plurality of analogue circuits in the inside of a digital signal processing circuit. The liquid crystal display device performs the correction of irregularities of the analogue circuits based on data set in the look up tables.

8 Claims, 46 Drawing Sheets

FIG. 27B

U.S. PATENT DOCUMENTS

| | | | | |
|---|---|---|---|---|
| 5,977,943 | A * | 11/1999 | Mano et al. | 345/98 |
| 6,100,906 | A * | 8/2000 | Asaro et al. | 345/539 |
| 6,122,705 | A * | 9/2000 | Kimura | 711/104 |
| 6,188,382 | B1 * | 2/2001 | Okamura et al. | 345/669 |
| 6,222,603 | B1 * | 4/2001 | Sakai et al. | 349/153 |
| 6,304,602 | B1 * | 10/2001 | Yokoyama | 375/240.08 |
| 6,310,651 | B1 * | 10/2001 | Mizutome | 348/459 |
| 6,323,713 | B1 * | 11/2001 | Yuzue | 327/291 |
| 6,388,648 | B1 | 5/2002 | Clifton et al. | |
| 6,411,267 | B1 * | 6/2002 | Narui | 345/10 |
| 6,483,555 | B1 * | 11/2002 | Thielemans et al. | 348/745 |
| 6,510,179 | B1 * | 1/2003 | Kasezawa et al. | 375/240.28 |
| 6,559,823 | B1 * | 5/2003 | Mano et al. | 345/100 |
| 6,638,781 | B1 * | 10/2003 | Hirakata et al. | 438/30 |
| 6,683,595 | B2 * | 1/2004 | Ikeda | 345/95 |
| 6,741,229 | B1 * | 5/2004 | Yanagi et al. | 345/98 |
| 6,816,131 | B2 * | 11/2004 | Narui et al. | 345/3.2 |
| 7,079,165 | B2 * | 7/2006 | Matsuda et al. | 345/698 |
| 7,161,573 | B1 * | 1/2007 | Takatori et al. | 345/96 |
| 7,228,150 | B1 * | 6/2007 | Kim | 455/556.1 |
| 2001/0026348 | A1 * | 10/2001 | Murata et al. | 349/187 |
| 2002/0008685 | A1 * | 1/2002 | Ban et al. | 345/92 |
| 2002/0158882 | A1 | 10/2002 | Liaw et al. | |
| 2003/0218587 | A1 * | 11/2003 | Ikeda | 345/87 |

FOREIGN PATENT DOCUMENTS

| | | |
|---|---|---|
| JP | 05-265405 | 3/1992 |
| JP | 2001-142426 | 11/1999 |

* cited by examiner

FIG. 14

| Address | Correction data | | | | | | | | | |
|---|---|---|---|---|---|---|---|---|---|---|
| 0 | $D_9$ | $D_8$ | $D_7$ | $D_6$ | $D_5$ | $D_4$ | $D_3$ | $D_2$ | $D_1$ | $D_0$ |
| 1 | $D_9$ | $D_8$ | $D_7$ | $D_6$ | $D_5$ | $D_4$ | $D_3$ | $D_2$ | $D_1$ | $D_0$ |
| 2 | $D_9$ | $D_8$ | $D_7$ | $D_6$ | $D_5$ | $D_4$ | $D_3$ | $D_2$ | $D_1$ | $D_0$ |
| 3 | $D_9$ | $D_8$ | $D_7$ | $D_6$ | $D_5$ | $D_4$ | $D_3$ | $D_2$ | $D_1$ | $D_0$ |
| 4 | $D_9$ | $D_8$ | $D_7$ | $D_6$ | $D_5$ | $D_4$ | $D_3$ | $D_2$ | $D_1$ | $D_0$ |
| 5 | $D_9$ | $D_8$ | $D_7$ | $D_6$ | $D_5$ | $D_4$ | $D_3$ | $D_2$ | $D_1$ | $D_0$ |
| | | | | | | | | | | |
| 251 | $D_9$ | $D_8$ | $D_7$ | $D_6$ | $D_5$ | $D_4$ | $D_3$ | $D_2$ | $D_1$ | $D_0$ |
| 252 | $D_9$ | $D_8$ | $D_7$ | $D_6$ | $D_5$ | $D_4$ | $D_3$ | $D_2$ | $D_1$ | $D_0$ |
| 253 | $D_9$ | $D_8$ | $D_7$ | $D_6$ | $D_5$ | $D_4$ | $D_3$ | $D_2$ | $D_1$ | $D_0$ |
| 254 | $D_9$ | $D_8$ | $D_7$ | $D_6$ | $D_5$ | $D_4$ | $D_3$ | $D_2$ | $D_1$ | $D_0$ |
| 255 | $D_9$ | $D_8$ | $D_7$ | $D_6$ | $D_5$ | $D_4$ | $D_3$ | $D_2$ | $D_1$ | $D_0$ |

MSB LSB

LIQUID CRYSTAL DISPLAY

CROSS REFERENCE TO RELATED APPLICATIONS

This application is a Continuation application of U.S. application Ser. No. 10/141,942 filed on May 10, 2002 now U.S. Pat. No. 6,980,189. Priority is claimed based on U.S. application Ser. No. 10/141,942 filed on May 10, 2002, which claims priority to Japanese Patent Application No. 2001-173410 filed on Jun. 8, 2001, all of which is incorporated by reference.

BACKGROUND OF THE INVENTION

1. Technical Field of the Invention

The present invention relates to a display device for a projector, and more particularly to a technique which is effectively applicable to image processing of inputted image data in a liquid crystal display device in which amplified analogue video signals are inputted after being subjected to the phase development.

2. Description of the Related Art

Recently, a liquid crystal display device has been popularly used as a display terminal of any equipment ranging from a miniaturized display device to a so-called OA equipment. The liquid crystal display device is basically constituted of a so-called liquid crystal panel (a liquid crystal display element or a liquid crystal cell) which inserts a layer (a liquid crystal layer) formed of liquid crystal composition between a pair of insulation substrates at least one of which is made of a transparent glass plate, a plastic substrate or the like.

The liquid crystal panel is roughly classified into a liquid crystal panel adopting a method (a simple matrix method) in which the pixel formation is performed by changing the orientation direction of liquid crystal molecules constituting the liquid crystal composition of desired pixel portions by selectively applying voltages to various types of electrodes for forming pixels formed on the insulation substrate, and a liquid crystal panel adopting a method (an active matrix method) which performs the pixel formation by changing the orientation direction of liquid crystal molecules of pixels which are arranged between pixel electrodes connected to active elements and reference electrodes which face the pixel electrodes in an opposed manner by forming the above-mentioned various types of electrodes and active elements for selecting pixels and selecting the active elements.

An active-matrix type liquid crystal display device which includes active elements (thin film transistors, for example) provided to respective pixels and performs the switching driving of these active elements has been popularly used as a display device of a notebook type personal computer or the like. In general, the active matrix type liquid crystal display device has been adopting a so-called vertical electric field method in which an electric field for changing the orientation direction of a liquid crystal layer is applied between electrodes formed on one substrate and electrodes formed on another substrate. Further, a liquid crystal display device which adopting a so-called lateral electric field IPS (In-Plane-Switching) method which sets the direction of an electric field applied to a liquid crystal layer to a direction substantially parallel to surfaces of substrates has been commercialized.

On the other hand, as a display device which uses the liquid crystal display device, a liquid crystal projector has been commercialized. In the liquid crystal projector, an illumination light emitted from a light source is emitted to a liquid crystal panel and an image on the liquid crystal panel is projected onto a screen. The liquid crystal panel used in the liquid crystal projector is classified into a reflection type projector and a transmission type projector. With respect to the reflection type projector, the approximately whole area of the pixels can be used as an effective reflection surface and hence, the reflection type projector is advantageous compared with a transmission type projector in view of the miniaturization, the acquisition of high definition and high brightness of the liquid crystal panel. Further, among the active matrix type liquid crystal display devices, there has been known a so-called liquid crystal display device incorporating driving circuits which also forms driving circuits for driving pixel electrodes on a substrate on which pixel electrodes are formed.

Further, with respect to the liquid crystal display device incorporating driving circuits, there has been known a reflection type liquid crystal display device (Liquid Crystal on Silicon, hereinafter also referred to as LCOS) which does not mount pixel electrodes and driving circuits on an insulation substrate but mounts them on a semiconductor substrate.

Further, as a driving method of the liquid crystal display device incorporating driving circuits, there has been known a driving method which inputs video signals to a liquid crystal display device from the outside in a form of analogue signals and outputs the video signals to a liquid crystal panel by sampling the video signals using driving circuits.

SUMMARY OF INVENTION

In the driving method which samples the video signals, to allow the driving circuits to ensure time for fetching the video signals, a method which divides video signals into a plurality of phases (phase development) is used. That is, the video signals which are transmitted through one signal line are transmitted in a divided manner. By outputting the video signals in a form that the video signals are transmitted along a plurality of divided signal lines, the video signals can be fetched by a plurality of circuits simultaneously so that period or interval necessary for fetching the video signals can be prolonged. However, although it is possible to ensure a sufficient period for fetching the video signals due to the phase development, it has been found that there arises a problem due to the irregularities of circuits. That is, for outputting the video signals to a plurality of signal lines, output circuits are provided to respective signal lines. When there exist irregularities with respect to the characteristics of these output circuits, irregularities are also generated with respect to display images thus giving rise to a problem that the display quality is deteriorated.

According to a liquid crystal display device of the present invention, to correct irregularities derived from a plurality of analogue circuits, correction means for a plurality of analogue circuits is arranged in the inside of a digital signal processing circuit so that the irregularities of the analogue circuits can be corrected using the correction means.

The liquid crystal display device includes data for correcting the irregularities which are generated with respect to a plurality of analogue circuits respectively as a look up table and the irregularities which are generated by the analogue circuits can be corrected by correcting digital signals using the look up table.

BRIEF DESCRIPTION OF THE DRAWINGS

FIG. 14 is a data constitutional view showing a look up table of the liquid crystal display device according to the embodiment of the present invention.

DESCRIPTION OF THE PREFERRED EMBODIMENTS

Preferred embodiments of the present invention are explained hereinafter in conjunction with attached drawings. Here, in all drawings which serve to explain the embodiments of the present invention, parts which have identical functions are given same symbols and their repeated explanation is omitted.

Figure 1:
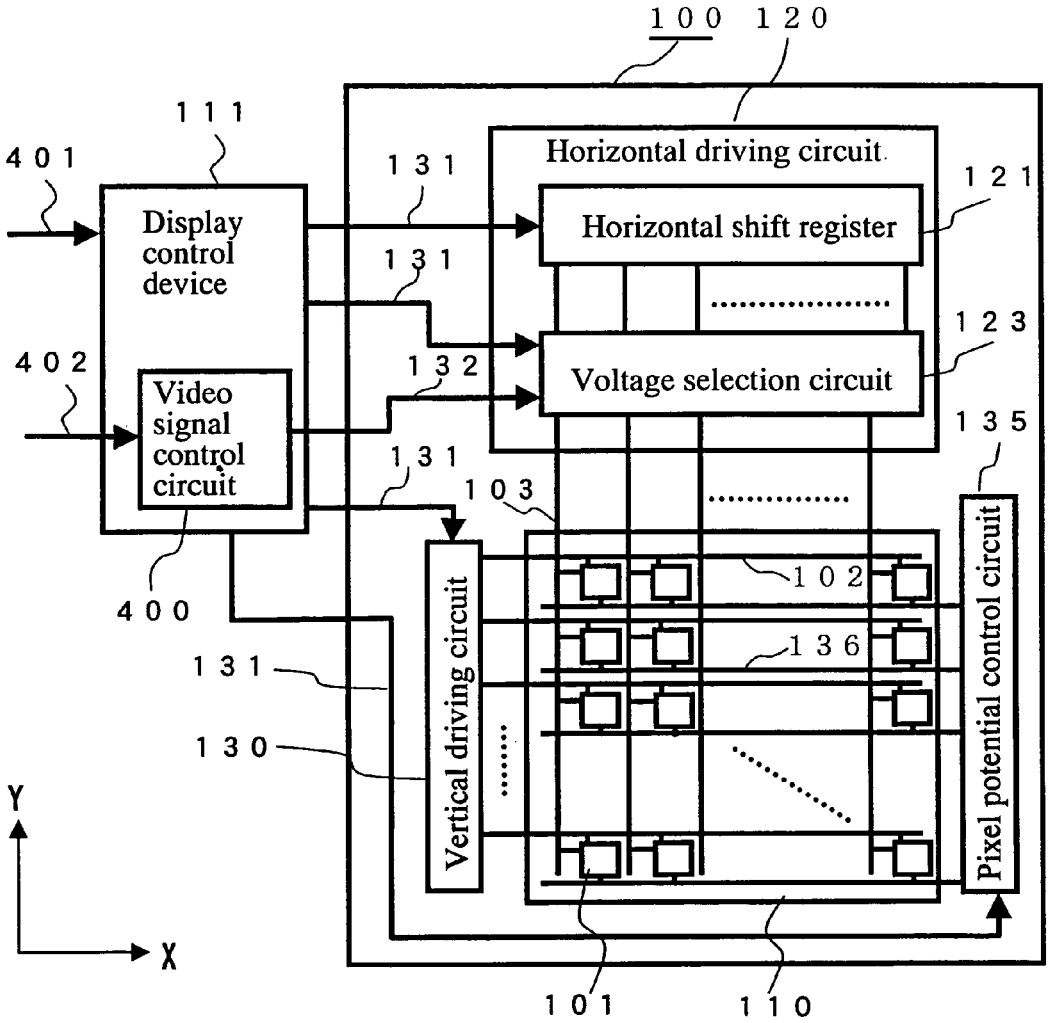
FIG. 1 is a block diagram showing a schematic constitution of a liquid crystal display device according to an embodiment of the present invention.

FIG. 1 is a block diagram showing a schematic constitution of a liquid crystal display device according to an embodiment of the present invention.

The liquid crystal display device of this embodiment is constituted of a liquid crystal panel (liquid crystal display element) 100 and a display control device 111. The liquid crystal panel 100 includes a display part 110 in which pixel portions 101 are arranged in a matrix array, a horizontal driving circuit (a video signal line driving circuit) 120, a vertical driving circuit (a scanning signal line driving circuit) 130 and a pixel potential control circuit 135. Further, the display part 110, the horizontal driving circuit 120, the vertical driving circuit 130 and the pixel potential control circuit 135 are formed on the same substrate. In the pixel portions 101, a liquid crystal layer is formed in such a manner that the liquid crystal layer is inserted between both electrodes consisting of pixel electrodes and counter electrodes (not shown in the drawing). The display is performed by making use of a phenomenon that when a voltage is applied between the pixel electrode and the counter electrode, the orientation direction of liquid crystal molecules or the like is changed and the property of the liquid crystal layer with respect to light is changed correspondingly. Here, although the present invention is effectively applicable to the liquid crystal display device using the pixel potential control circuit 135, the present invention is not limited to the liquid crystal display device having the pixel potential control circuit 135.

An external control signal line 401 is connected to the display control device 111 from an external device (for example, a personal computer or the like). The display control device 111 generates signals which control the horizontal driving circuit 120, the vertical driving circuit 130 and the pixel potential control circuit 135 using control signals such as a clock signal, a display timing signal, a horizontal synchronous signal, a vertical synchronous signal and the like which are transmitted to the display control device 111 from the outside through the external control signal line 401.

Further, the display control device 111 includes a video signal control circuit 400. A display signal line 402 is connected to the video signal control circuit 400 so that display signals are inputted to the video signal control circuit 400 from the external device. The display signals are transmitted in a fixed order such that images displayed on the liquid crystal panel 100 are constituted. For example, starting from the pixel positioned at the left upper portion of the liquid crystal panel 100, pixel data for one line is sequentially transmitted and then the pixel data for respective lines from above to below are sequentially transmitted from the external device. The video signal control circuit 400 generates video signals based on the display signals and supplies video signals to the horizontal driving circuits 120 at the timing which matches displaying of images by the liquid crystal panel 100.

Numeral 131 indicates control signal lines which are extended from the display control device 111 and numeral 132 indicates a video signal transmission line which is also extended from the display control device 111. Here, although the video signal transmission line 132 is depicted by a single line in FIG. 1, the video signal transmission line 132 is subjected to the phase development in a plurality of phases so that a plurality of video signal transmission lines 132 are provided. The phase development is explained later.

The video signal transmission lines 132 are outputted from the display control device 111 and are connected to the horizontal driving circuit 120 provided to the periphery of the display part 110. A plurality of video signal lines (also referred to as drain signal lines or vertical signal lines) 103 are extended from the horizontal driving circuit 120 in the vertical direction (Y direction in the drawing). Further, a plurality of video signal lines 103 are arranged in parallel in the horizontal direction (X direction). Video signals are transmitted to the pixel portions 101 through the video signal lines 103.

Further, the vertical driving circuit 130 is also provided to the periphery of the display part 110. A plurality of scanning signal lines (also referred to as gate signal lines or horizontal signal lines) 102 are extended in the horizontal direction (X direction) from the vertical driving circuit 130. Further, a plurality of scanning signal lines 102 are arranged in parallel in the vertical direction (Y direction). Scanning signals which turn on or off switching elements formed in the pixel portion 101 are transmitted through the scanning signal lines 102.

Further, the pixel potential control circuit 135 is provided to the periphery of the display part 110. A plurality of pixel potential control lines 136 are extended from the pixel potential control circuit 135 in the horizontal direction (X direction). Further, a plurality of pixel potential control lines 136 are arranged in parallel in the vertical direction (Y direction). Signals which control the potential of pixel electrodes are transmitted through the pixel potential control lines 136.

The horizontal driving circuit 120 is constituted of a horizontal shift register 121 and a video signal selection circuit 123. The control signal lines 131 and the video signal transmission lines 132 extended from the display control device 111 are connected to the horizontal shift register 121 and the video signal selection circuit 123 respectively so as to enable the transmission of the control signals and the video signals to the horizontal shift register 121 and the video signal selection circuit 123. Here, although power source voltage lines for respective circuits are omitted from the drawing, it is assumed that necessary voltages are supplied to respective circuits.

When the first display timing signal is inputted to the display control device 111 following inputting of the vertical synchronous signal from the outside, the display control device 111 outputs a start pulse to the vertical driving circuit 130 through the control signal line 131. Subsequently, the display control device 111 outputs a shift clock to the vertical driving circuit 130 for every 1 horizontal scanning time (hereinafter referred to as 1h) in response to the horizontal synchronous signal so as to sequentially select the scanning signal lines 102. The vertical driving circuit 130 selects the scanning signal lines 102 in accordance with the shift clock and outputs the scanning signals to the scanning signal lines 102. That is, the vertical driving circuit 130 outputs signals for selecting the scanning signal lines 102 during 1 horizontal scanning time 1h sequentially from above in FIG. 1.

Further, when the display timing signal is inputted to the display control device 111, the display control device 111 determines this inputting as the starting of display and outputs the video signals to the horizontal driving circuit 120. Although the video signals are sequentially outputted from the display control device 111, the horizontal shift register 121 outputs the timing signals in accordance with the shift clocks transmitted from the display control device 111. The timing signals indicate timings that the video signal selection circuit 123 fetches the video signals to be outputted to respective video signal lines 102 therein.

That is, the video signal selection circuit 123 includes a circuit (a sample hold circuit) which fetches and holds the video signals therein for respective video signal lines 103, wherein the sample hold circuit fetches the video signal when the timing signal is inputted to the sample hold circuit. At the timing that the timing signal is inputted to the specific sample hold circuit, the display control device 111 outputs the video signal which is to be fetched by the corresponding sample hold circuit. The video signals are analogue signals and the video signal selection circuit 123 fetches a fixed voltage from the analogue signal as the video signal (gray scale voltage) in accordance with the timing signal and outputs the fetched video signal to the video signal line 103. The video signal outputted to the video signal line 103 is written in the pixel electrode of the pixel portion 101 in accordance with the timing at which the scanning signals is outputted from the vertical driving circuit 130.

The pixel potential control circuit 135 controls the voltage of the video signal written in the pixel electrode based on the control signal transmitted from the display control device 111. The gray scale voltage written in the pixel electrodes transmitted from the video signal lines 103 has a certain potential difference with respect to the reference voltage of the counter electrode. The pixel potential control circuit 135 supplies the control signal to the pixel portion 101 so as to change the potential difference between the pixel electrode and the counter electrode. Here, the pixel potential control circuit 135 will be described in detail later.

Figure 2:
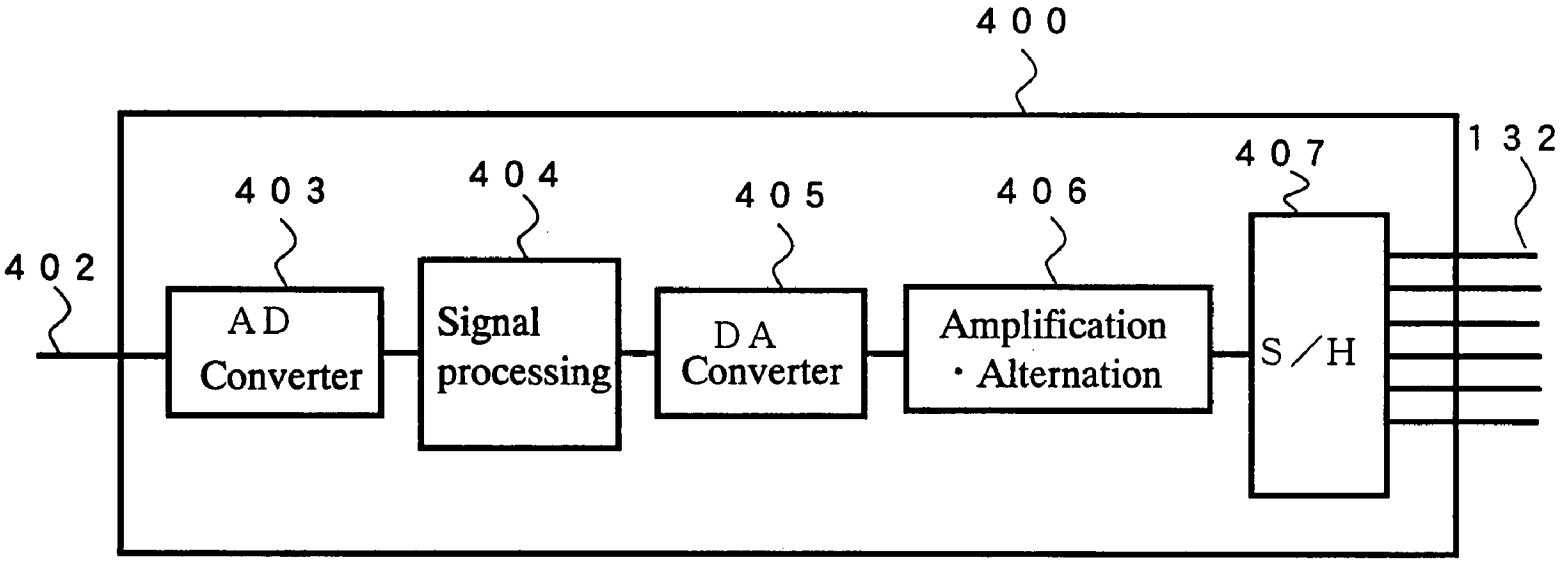
FIG. 2 is a block diagram showing a video signal control circuit of the liquid crystal display device according to the embodiment of the present invention.
Figure 3A:
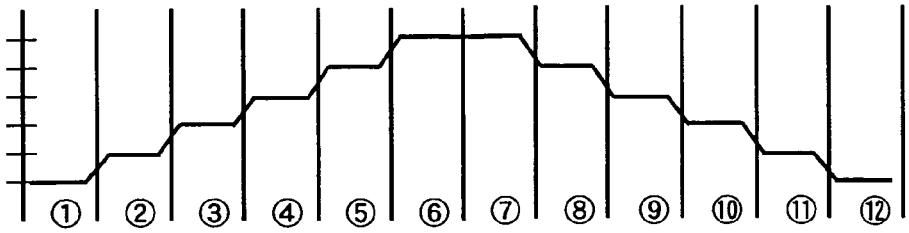
FIG. 3 is a timing chart for explaining the phase development.
Figure 3B:
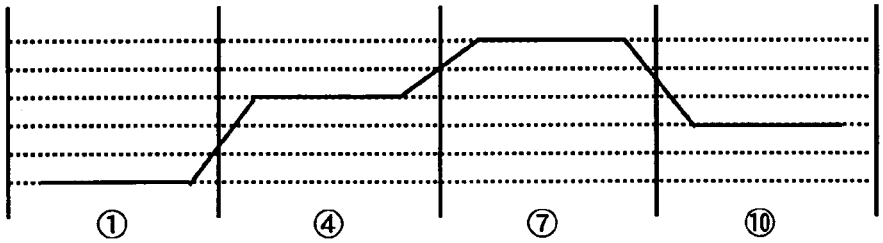
Figure 3C:
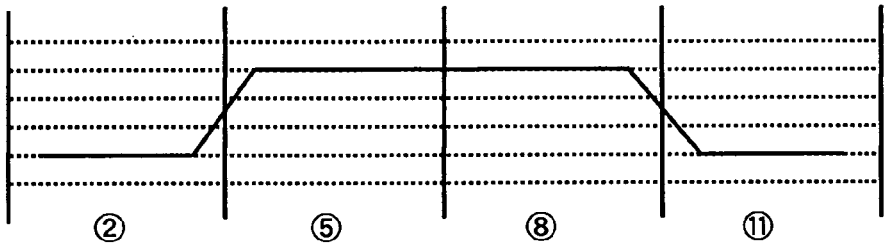
Figure 3D:
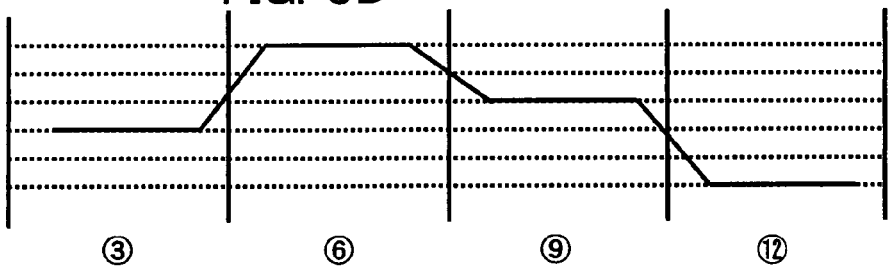

Subsequently, the video signal control circuit 400 is explained in conjunction with FIG. 2. FIG. 2 is a schematic block diagram showing the circuit constitution of the video signal control circuit 400 of the liquid crystal display device according to one embodiment of the present invention. As mentioned previously, the display signals are inputted to the video signal control circuit 400 from the outside through the display signal line 402. Numeral 403 indicates an AD converter. When the display signals are analogue signals, the AD converter 403 converts the display signals into digital signals. Numeral 404 indicates a signal processing circuit and performs the signal processing such as the γ correction, the conversion of resolution and the like. Here, when the display signals are digital signals, the display signals are inputted to the signal processing circuit 404 directly or through various types of interface circuits.

Further, in the signal processing circuit 404, the multiplication of frame frequency is performed. The signals necessary for display are transmitted to the video signal control circuit 400 from the outside for every one screen. The period in which the signals necessary for display for one screen is set as one frame period and the inverse number of the frame period is set as frame frequency. Particularly, the frame period of a case in which the signals are transmitted to the liquid crystal display device from the outside is referred to as external frame period and the frame period of a case in which the liquid crystal control device 111 transmits the signals to the liquid crystal panel 100 is referred to as a liquid crystal driving frame period. In the signal processing circuit 404, the liquid crystal driving frame frequency is increased several times compared to the external frame frequency. The multiplication of the frame frequency is performed for preventing the occurrence of flickers. The multiplication of the frame frequency will be explained later.

Numeral 405 is a DA converter. The DA converter 405 converts the digital signals which are subjected to the signal processing in the signal processing circuit 404 into analogue signals. Numeral 406 indicates an amplification and alternation circuit. The amplification and alternation circuit 406 amplifies and alternates the analogue signals outputted from the DA converter 405.

In general, with respect to the liquid crystal display device, the alternation driving which periodically inverts the polarity of voltage applied to the liquid crystal layer is performed. The alternation driving is performed for preventing the deterioration of the liquid crystal which is brought about by applying the direct current voltage to the liquid crystal. Although the pixel portion 101 includes the pixel electrode and the counter electrode as mentioned previously, in one method for performing the alternation driving, a fixed voltage is applied to the counter electrode and the gray scale voltage of positive polarity or negative polarity with respect to the counter electrode is applied to the pixel electrode. Here, in this specification, the voltage of positive polarity or negative polarity means the voltage of the pixel electrode using the potential of the counter electrode as the reference voltage. In the reflection type liquid crystal display device LCOS, this alternation driving is performed at the frame period (frame inversion). The reason that the reflection type liquid crystal display device LCOS does not adopt the line inversion and the dot inversion is that a black matrix is not used in the reflection type liquid crystal display device LCOS and hence, it is impossible to conceal the leaking of light caused by the undesired lateral electric field generated by the line inversion or the dot inversion. However, when the frame inversion is performed, flickers occur on the display surface at the frame period (surface flicker). As mentioned previously, by making the frame period shorter than response time of human eyes, the surface flickers are reduced.

Numeral 407 indicates a sample hold circuit. In the sample hold circuit 407, the video signals outputted from the amplification and alternation circuit 406 are fetched every fixed period and are outputted to the video signal transmission lines 132. As mentioned previously, the video signal transmission lines 132 are formed in a plural number and the sample hold circuit 407 sequentially outputs the fetched voltages to the video signal transmission lines 132. Accordingly, the video signals are subjected to the phase development in a plurality of phases and are outputted to the video signal transmission lines 132.

The phase development is explained in conjunction with FIG. 3. Here, to ease the explanation, a case in which the number of the video signal transmission lines 132 is three, that is, a case in which the phase development is performed in three phases is shown. FIG. 3(*a*) shows the video signals inputted to the sample hold circuit 407. The sample hold circuit 407 fetches the video signals at the periods indicated by circled numbers. FIG. 3(*b*) shows the video signals outputted to the first video signal transmission line 132. The video signals which are fetched every two periods, that is, at the period (1), (4), (7) and so on are outputted to the first video signal transmission line 132 from the sample hold circuit 407. Further, by transmitting the video signals in a form that the video signals are divided into three video signal transmission lines 132, it is possible to prolong the period in which the video signal is outputted three times. FIG. 3(*c*) shows the video signal outputted to the second video signal transmission line 132 and FIG. 3(*d*) shows the video signal outputted to the third video signal transmission line 132.

By performing the phase development with respect to the video signals, in the video signal selection circuit 123 provided to the liquid crystal panel 100, it is possible to prolong the period in which the video signal is fetched. However, as the sample hold circuit 407, a high-performance circuit which is capable of performing the sample holding with high speed signals is used. Further, by performing the sample-holding at another stage, it is possible to align the phases of the video signals after the phase development. By aligning the phases of the video signals, it is possible to perform the sampling of the video signals by the video signal selection circuit 123 in the inside of the liquid crystal panel 100 using the same sampling clock.

Figure 4A:
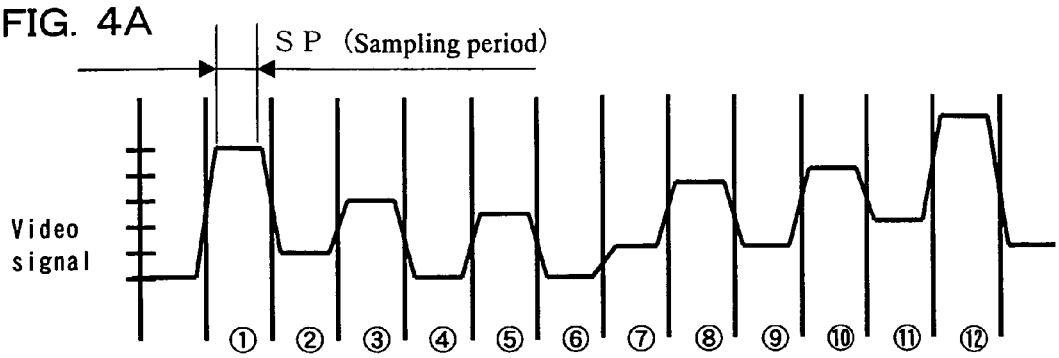
FIG. 4 is a timing chart for explaining a sample hold circuit.
Figure 4B:
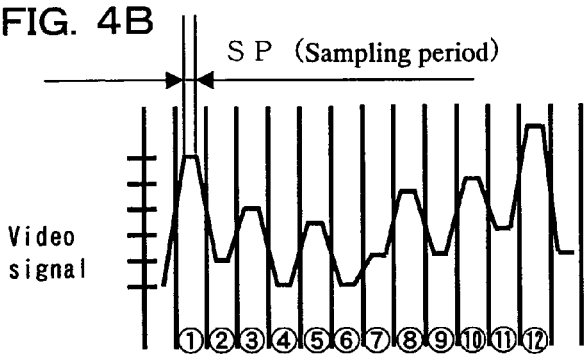

Subsequently, problems that the sample hold circuit 407 shown in FIG. 2 has are explained in conjunction with FIG. 4. In the circuit system shown in FIG. 2, when the signals shown in FIG. 4(*a*) are at a low speed, the sampling period SP is sufficiently long. Accordingly, there is enough margin for sampling the correct signal levels in the sample hold circuit 407 and hence, the irregularities of signals sampled by the sample hold circuit 407 is small. However, along with the increase of the resolution, or when the signals become high-speed signals due to the multiplication of the frame frequency, the waveform of the video signals becomes close to a triangular waveform as shown in FIG. 4(*b*). Accordingly, the period in which the correct signal level is sampled becomes short due to the phase displacement of the sampling clocks, noises and the like so that the erroneous sampling is easily generated and the irregularities of level due to the displacement of sampling timing are increased. This implies that the display gray scales are erroneously displayed thus degrading the display quality.

Figure 5:
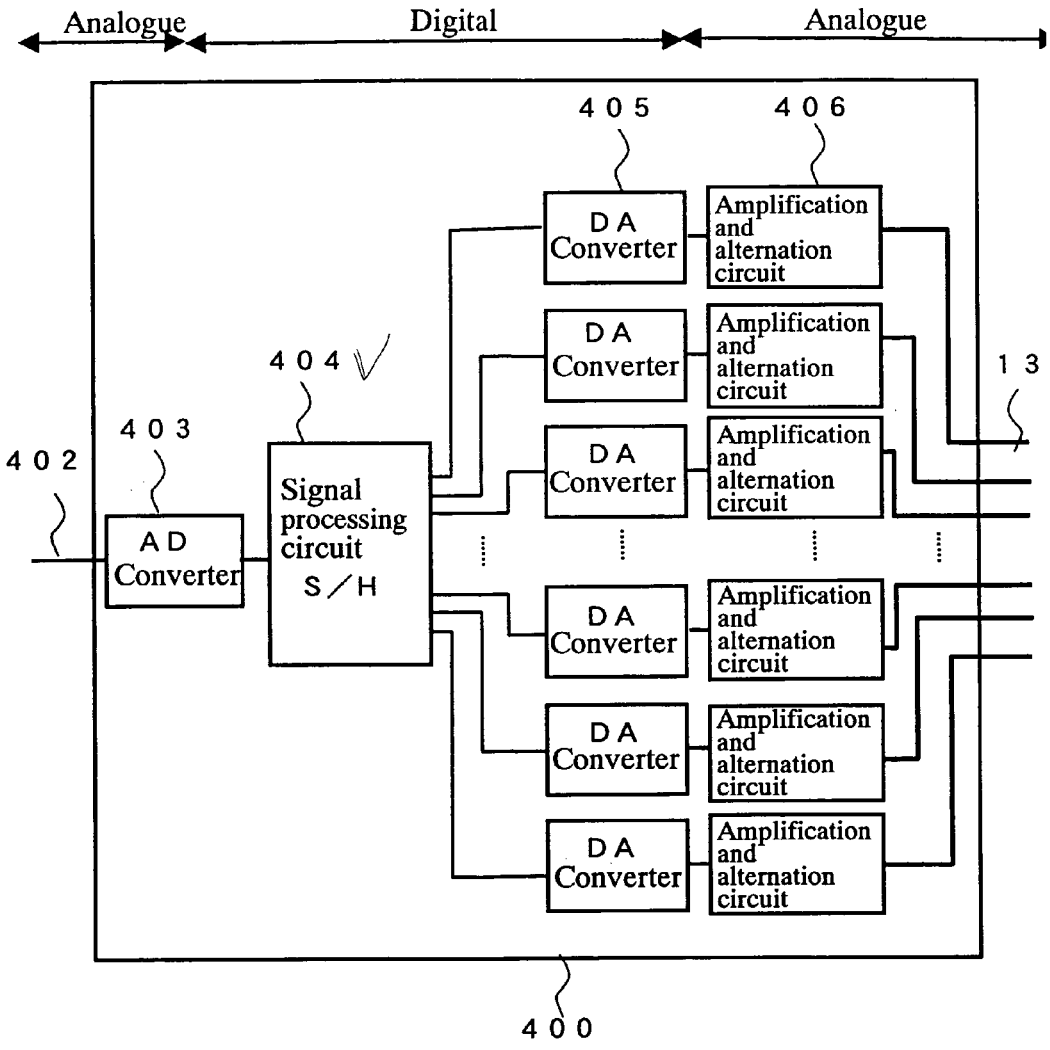
FIG. 5 is a block diagram showing a video signal control circuit of the liquid crystal display device according to the embodiment of the present invention.

In view of the above-mentioned problems, as a method to cope with the erroneous sampling which may be generated under the high resolution and the high frame frequency, a circuit having the constitution shown in FIG. 5 is developed. Compared to the constitution shown in FIG. 2, this circuit performs the sample holding processing using digital signals. Video signals from the outside are converted into digital signals by an AD converter 403. These digitized signals are subjected to the signal processing such as they correction, the conversion of resolution and the frame rate conversion in a signal processing circuit 404 and, thereafter, are subjected to the sample holding and the phase development while maintaining the state of the digital signals. Since the signals are subjected to the phase development while maintaining the state of the digital signals, the irregularities of sample holding are remarkably reduced and hence, the irregularities of sample holding at the time of performing the phase development of analogue signals are not generated. Here, the signals of respective developed phases are converted into analogue signals by a DA converter 405 which constitutes a latter stage and, thereafter, are subjected to the amplification and alternation.

Figure 6:
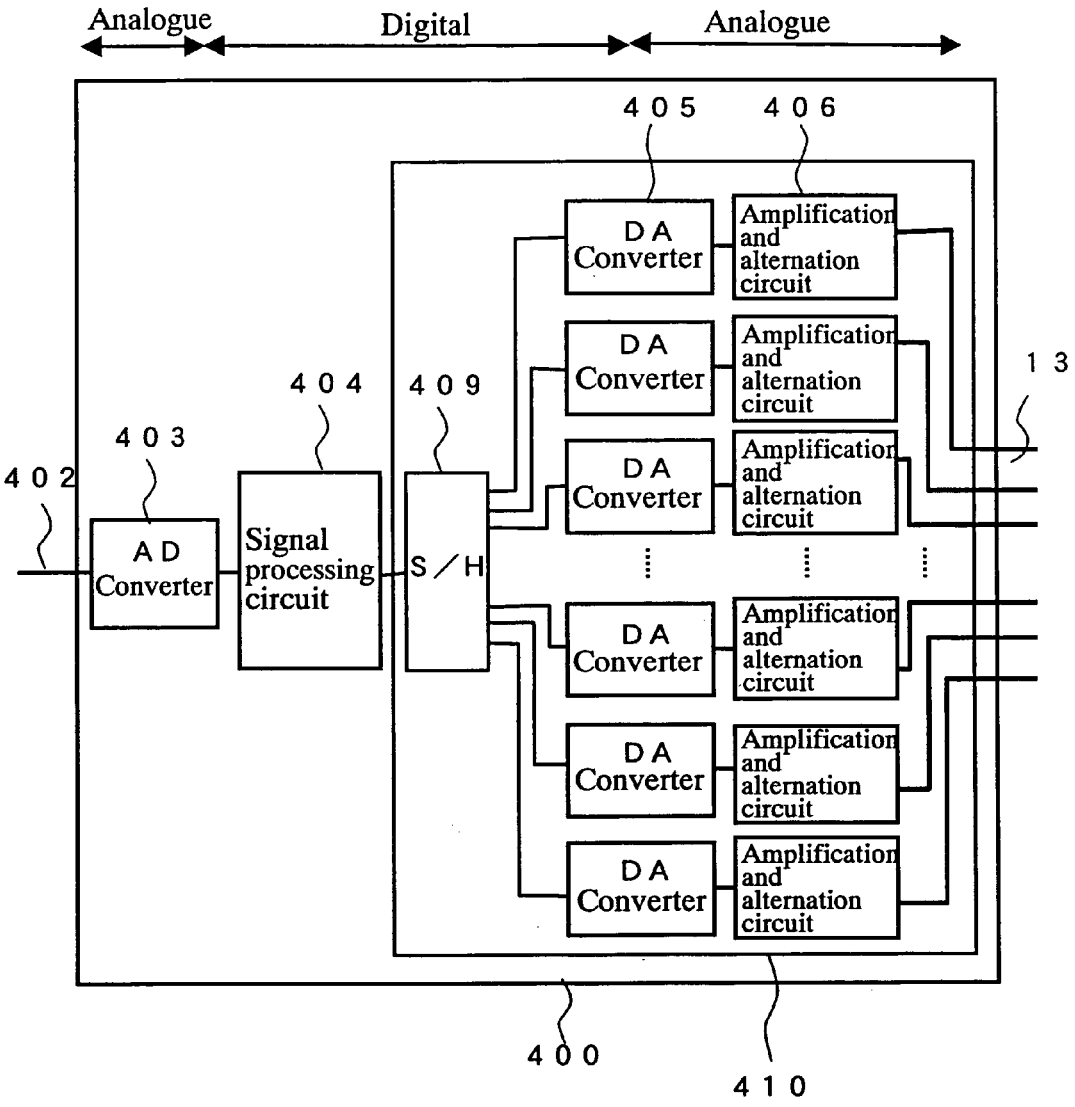
FIG. 6 is a block diagram showing a video signal control circuit of the liquid crystal display device according to the embodiment of the present invention.

FIG. 6 shows the constitution in which the processing of the latter stage of the circuit shown in FIG. 5 is performed using IC components. Numeral 410 indicates an analogue driver formed into an IC. Here, digital signals which are subjected to the signal processing such as they correction, the conversion of resolution and the frame rate conversion by the signal processing circuit 404 are inputted to the inside of the analogue driver 410. In the inside of the analogue driver 410, the digital signals inputted to a sample hold circuit 409 are subjected to the phase development while maintaining the digital state and, thereafter, the digital signals of respective phases are subjected to the DA conversion by the DA converter 405, and thereafter, are amplified and are alternated by the amplification and alternation circuit 406. Due to such a constitution, the latter-stage can be formed of one chip so that the circuit can be simplified.

As mentioned previously, in the constitution shown in FIG. 5 and FIG. 6, the sample holding is performed using the digital signals and hence, the irregularities of sample holding are not generated. Accordingly, the constitution is particularly advantageous when high-speed signals are used as the signals. In a method which performs the sample holding of the digital signals and performs the phase development, the video signals are digital signals of either "1" or "0". Accordingly, even when the voltage outputted onto the signal lines becomes fluctuated and irregular, since the voltages are fetched as either the value "1" or the value "0" as signals, the irregularities which give rise to problems with respect to the analogue signals are not generated.

Here, also with respect to a method for dividing and transmitting the video signals to a plurality of signal lines, since the video signals are digital signals, it is easy to hold the data compared to analogue signals. The video signals of the period which follows the resolution of displayed images are inputted from an external device (for example, a personal computer) in the order of pixels constituting the screen and the digital signals which are outputted from the AD converter 403 also follow the period and the order of the video signals inputted from the external device. Accordingly, by sequentially outputting the fetched digital signals to a plurality of signal lines, it is possible to perform the phase development with the digital signals. However, inventors have found a problem that the irregularities are generated among respective phases due to the characteristics of circuits which come after the phase development. Subsequently, the irregularities generated by the circuits which come after the phase development are explained.

Figure 7A:
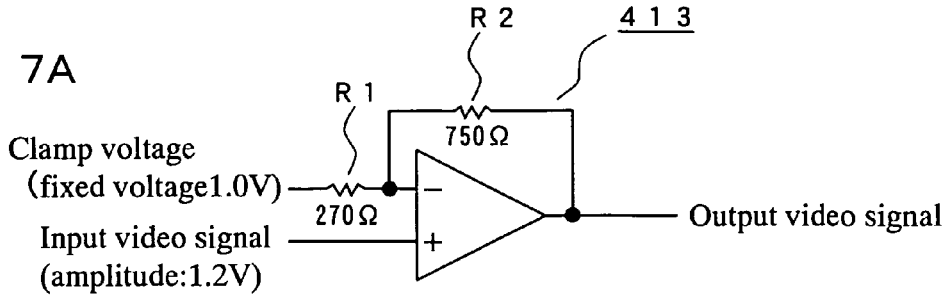
FIG. 7 is a schematic circuit diagram for explaining irregularities of an amplifier circuit.
Figure 7B:
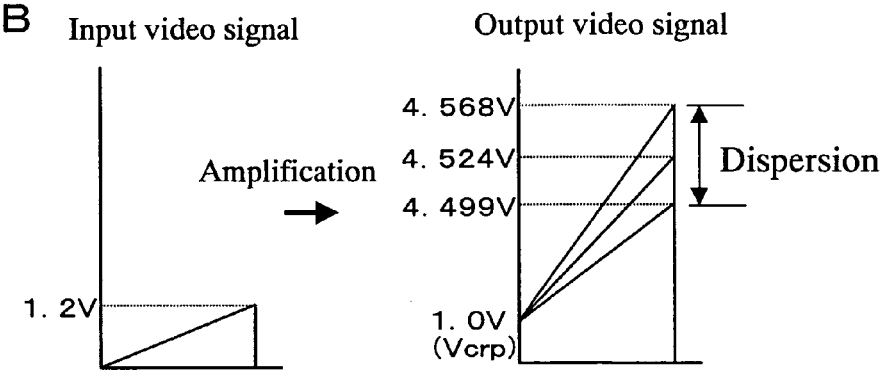

Components or parts which constitute the circuit originally have irregularities with respect to their characteristics. FIG. 7 shows an example in which the amplifier circuit is constituted of an operational amplifier 413. Here, using an example shown in FIG. 7(*a*), the irregularities of signals derived from the irregularities of characteristics of parts are estimated. In a circuit shown in FIG. 7(*a*), assuming the resistance value of a resistor R1 as 270Ω, the resistance value of a resistor R2 as 750Ω, and the irregularities of resistance of these resistors as ±0.5%, the gain irregularities of an operational amplifier 413 as ±0.025%, and the amplitude of the video signals as 1.2 V, the amplification factor of the operational amplifier 413 is determined based on a rate of R2/R1. Accordingly, the amplitudes of output voltages when the amplification factor becomes maximum and minimum respectively due to the irregularities of characteristics can be calculated as follows.

When the amplification factor becomes maximum, the amplitude of the output voltage is calculated such that 1.2 V×((750×1.005)+(270×0.995)+1)×1.00025=4.568 V, while when the amplification factor becomes minimum, the amplitude of the output voltage is calculated such that 1.2 V×((750×0.995)+(270×1.005)+1)×0.99975=4.499 V.

Accordingly, the difference of the amplitude of the output voltage between the case in which the amplitude factor is maximum and the case in which the amplitude factor is minimum is expressed as 4.568 V−4.499 V=0.069 V and hence, the irregularities of 69 mV at the maximum are generated. The irregularities of this amplification factor are expressed as a waveform shown in FIG. 7(*b*). Here, a fixed voltage is applied as a clamp voltage Vcrp and the clamp voltage Vcrp is set to 1.0 V in FIG. 7(*b*).

Figure 8:
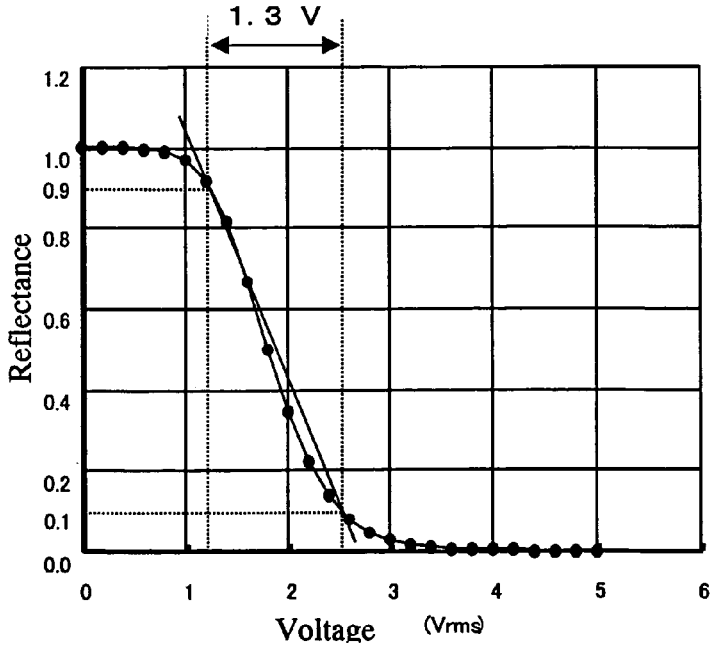
FIG. 8 is a characteristic graph showing the relationship between applied voltage and the reflectance of the liquid crystal display device according to the embodiment of the present invention.

Further, FIG. 8 shows the applied voltage-reflectance characteristics of a reflection type liquid crystal display device (LCOS). Since the applied voltage becomes 1.1 V at the 90% of the relative reflectance and 2.4 V at the 10% of the relative reflectance, 256 gray scales are displayed with the voltage difference of 1.3 V so that the inclination of FIG. 8 becomes 1.3 V+256 gray scales=5.1 mV/gray scale. Therefore, the voltage per 1 gray scale becomes approximately 5 mV. Accordingly, when the irregularities of 69 mV are present, the gray scales become 69 mV+5 mV/gray scale=13.8 gray scales. In this case, the irregularities of 69 mV generates the brightness difference of approximately 14 gray scales.

The irregularities of this amplifier circuit lead to the irregularities between the video signal transmission lines 132. The irregularities between the video signal transmission lines 132 are expressed as the brightness difference of periodical longitudinal lines with respect to the display images on the liquid crystal panel so that it gives rise to a problem that the display quality is remarkably deteriorated.

Figure 9:
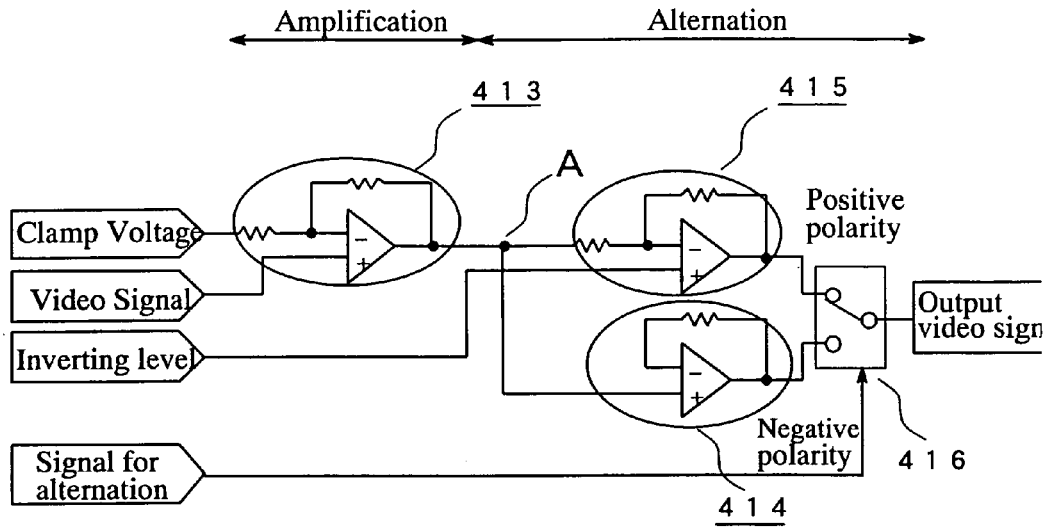
FIG. 9 is a schematic circuit diagram for explaining irregularities of an alternation circuit.

As shown in FIG. 9, the amplification and alternation includes operational amplifiers in the amplifier circuit but also in the alternation circuit and hence, the irregularities of inversion in the alternation circuit is also to be considered. Further, the irregularities of characteristics and the like of the transistors in the inside of the liquid crystal panel 100 also constitute factors which cause longitudinal lines.

Figure 10A:
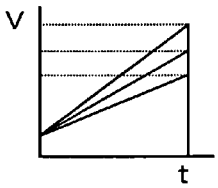
FIG. 10 is a waveform chart for explaining the irregularities of the alternation circuit.
Figure 10B:
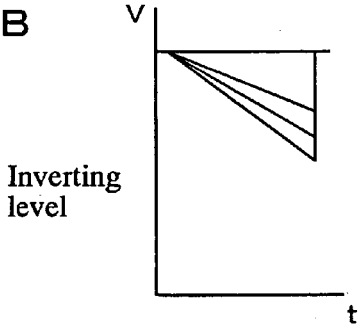
Figure 10C:
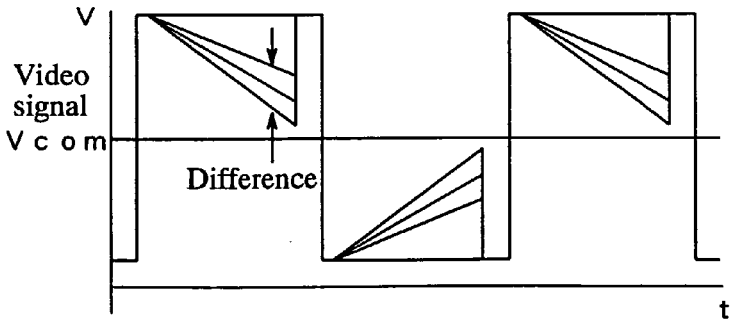

FIG. 10 shows the irregularities of the circuit shown in FIG. 9. FIG. 10(*a*) shows a signal waveform which is outputted to a node A in FIG. 9 when an input waveform shown in FIG. 7(*b*) is inputted to the operational amplifier 413. FIG. 10(*b*) shows an output of an operational amplifier 415 for positive polarity. The operational amplifier 415 for positive polarity is an inversion amplifying circuit with an amplification factor 1 and an output thereof is a value which is obtained by subtracting the input voltage from the inversion level voltage given as a fixed voltage as shown in FIG. 10(*b*). The operational amplifier 414 for negative polarity is a buffer amplifier with an amplification factor of 1 and outputs an input waveform as it is.

FIG. 10(*c*) shows a state in which the output of the operational amplifier 414 for negative polarity and the output of the operational amplifier 415 for positive polarity are outputted alternately using an analogue switch 416. Video signals shown in FIG. 10(*c*) are those which are used when the liquid crystal display adopts a normally white mode. Accordingly, with less potential difference with respect to the reference electrode Vcom of the counter electrode, the higher brightness (white display) can be obtained. As shown in FIG. 10(*c*), the irregularities among respective circuits lead to the irregularities among the video signal transmission lines 132. For example, assuming the number of the video signal transmission lines 132 as n, when the voltage levels of the video signal transmission lines 132 become irregular such that the voltage level of the first video signal transmission line 132 becomes minimum and the voltage level of the nth video signal transmission line 132 becomes maximum, the longitudinal lines appear on the display image on the liquid crystal panel every n pieces so that the display quality is remarkably deteriorated.

Although it is possible to correct the irregularities by adjusting respective analogue circuits, since the number of parts to be adjusted is so large that the mass productivity is remarkably damaged. Accordingly, the irregularities of the analogue circuit are reduced by correcting them using digital signals prior to inputting these digital signals into respective analogue circuit.

Figure 11:
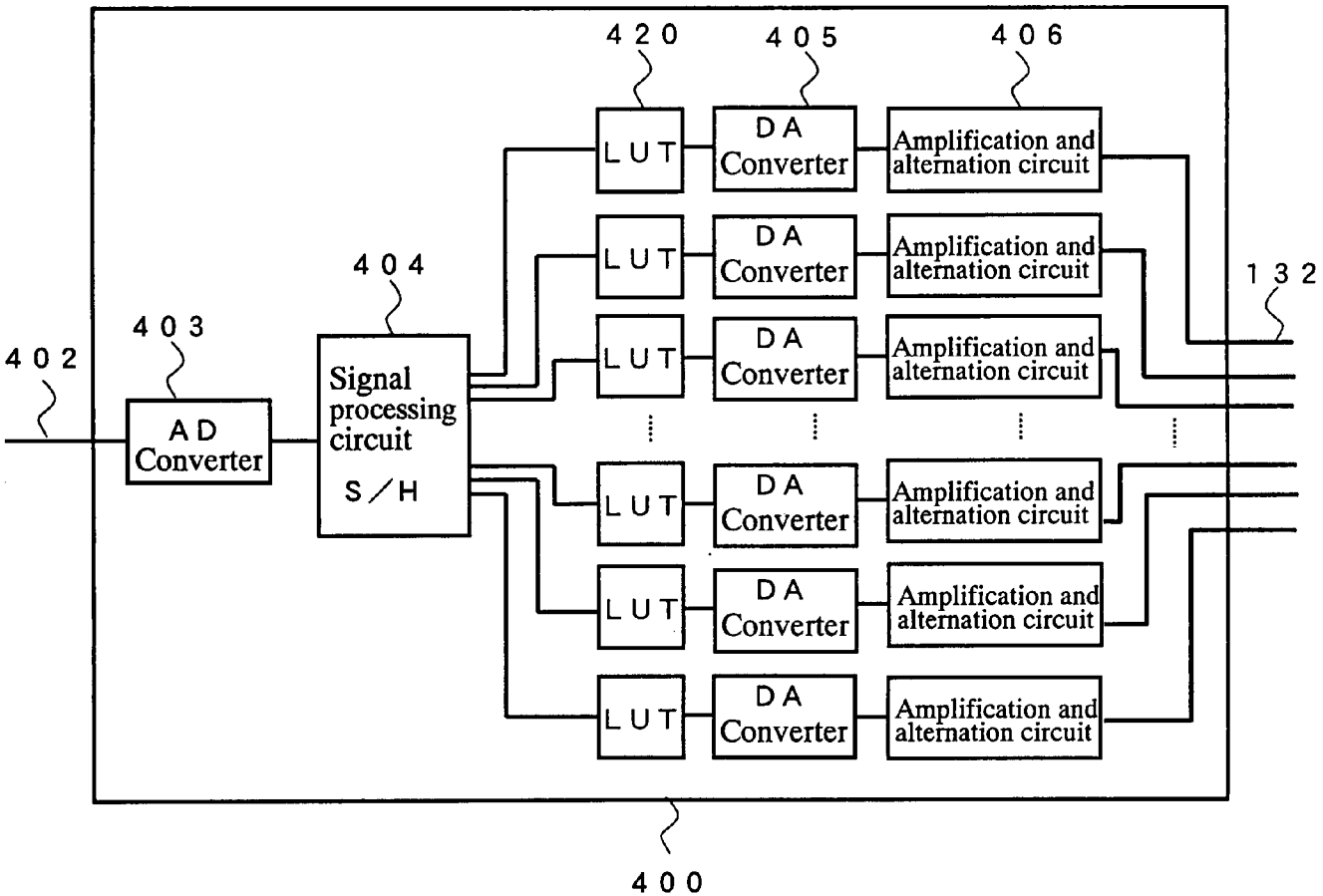
FIG. 11 is a block diagram showing the video signal control circuit of the liquid crystal display device according to the embodiment of the present invention.

FIG. 11 shows the circuit constitution which corrects the irregularities of circuits using look up tables.

Respective signal lines which are subjected to the phase development after performing sample-holding the digital signals have the look up tables (hereinafter also referred to as LUTs) 420 and perform correction independently with respect to respective phases. Since the irregularities differ on respective phases, optimal data are preliminarily required by the look up tables 420. Further, correction data is stored in a separate memory or the like and the data which corrects the irregularities is transferred to the look up tables 420 when necessary.

In FIG. 11, in the signal processing circuit 404, the signal processings such as they correction, the conversion of resolution, the frame rate conversion and the like are performed and digital signals which are subjected to the phase development are inputted to the look up tables 420. With respect to the look up tables 420, the digital data corresponding to the inputted digital signals are outputted to the DA converter 405. The DA converter 405 converts the digital data into analogue signals and outputs the analogue signals to the amplification and alternation circuit 406.

Data which correct the irregularities for every phase is stored in the look up tables 420. Setting of the correction data stored in the look up tables 420 is performed while observing and evaluating the display screen. First of all, data which is not corrected (standard data) is stored in the look up tables 420 and the display is performed and the irregularities for respective phases are observed. Thereafter, with respect to the phase whose brightness is lowered, a coefficient which increases the brightness is multiplied to the standard data so as to produce the correction data, while with respect to the phase whose brightness is increased, a coefficient which decreases the brightness is selected. When the brightness for respective phases is made uniform, the coefficients of this instant case are recorded in the video signal control circuit 400 as optimal coefficients.

Figure 12:
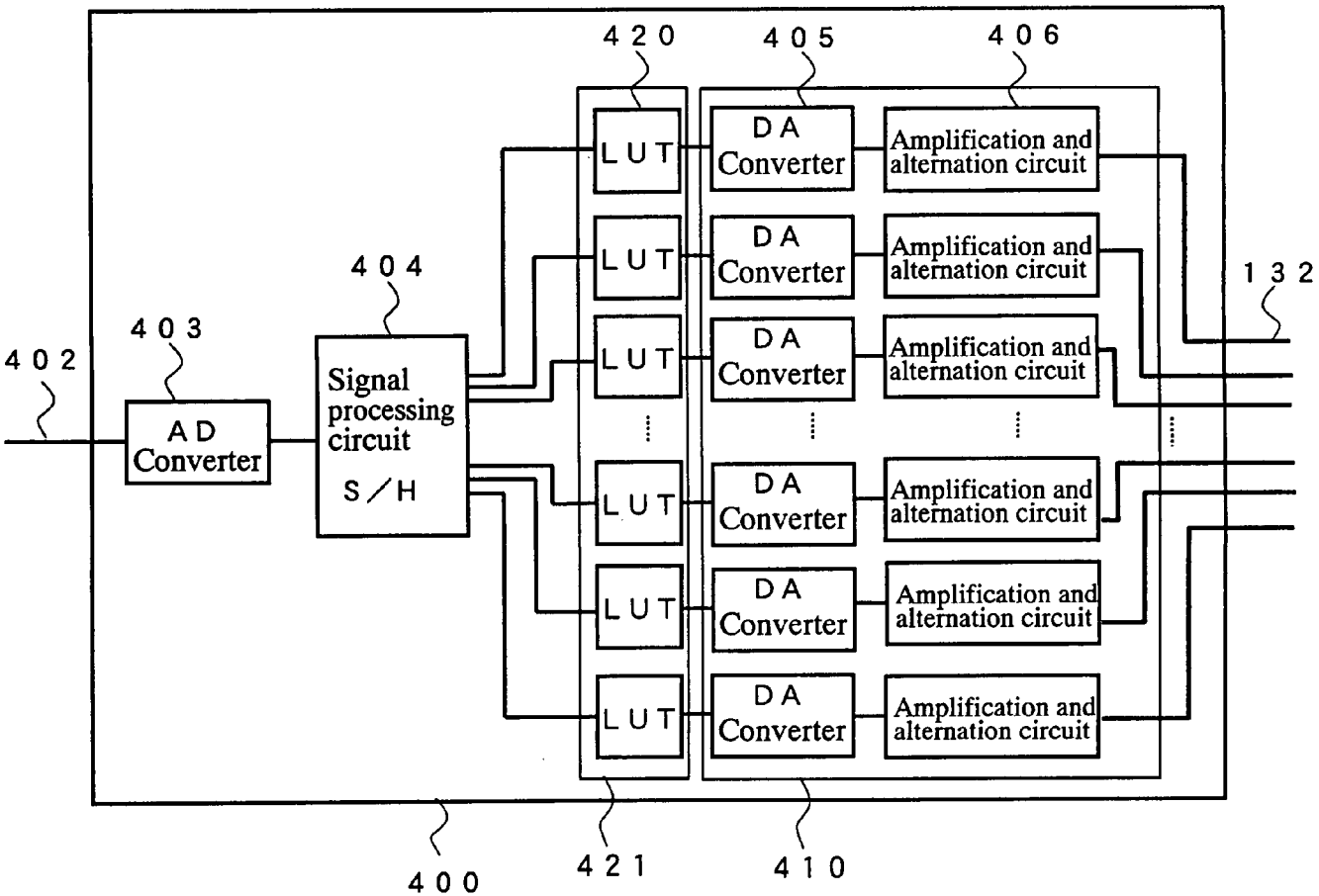
FIG. 12 is a block diagram showing the video signal control circuit of the liquid crystal display device according to the embodiment of the present invention.

FIG. 12 shows the constitution in which the look up tables 420 of the circuit shown in FIG. 11 are formed as one package and the latter-stage processing is performed by an IC. In the drawing, numeral 410 indicates analogue drivers which are formed of the IC and numeral 421 indicates a look up table 420 consisting of the look up tables 420 formed into one package using a gate array or the like. Digital signals which are subjected to the signal processing such as the γ correction, the conversion of resolution, the frame rate conversion, the phase development and the like in the signal processing circuit 404 are inputted into the look up tables 421 of respective phases. The data is corrected in the look up table 421 and the corrected data is outputted to the analogue driver 410. In the analogue driver 410, the DA conversion, the amplification and the alternation are performed. Due to such a constitution, each stage can be formed in one package and the circuit can be simplified.

Here, it is possible to separate the signal processing circuit and the sample hold circuit and to form the sample hold circuit and the look up tables into one package. Further, the inside of one package may be constituted of one chip gate array or a plurality of divided chips.

Figure 13:
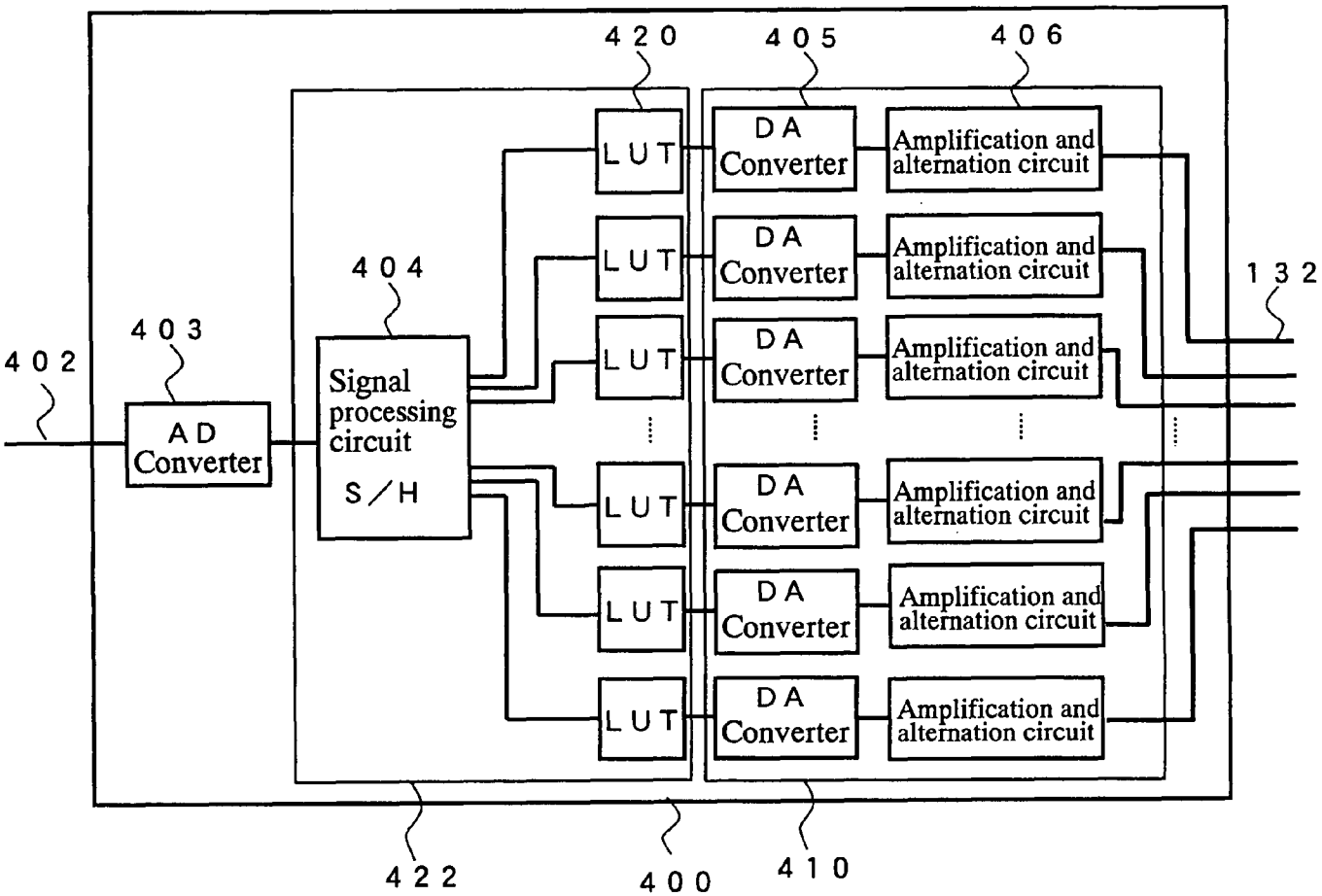
FIG. 13 is a block diagram showing the video signal control circuit of the liquid crystal display device according to the embodiment of the present invention.

FIG. 13 shows an embodiment in which a signal processing circuit 404 and look up tables 420 are formed in one package. Numeral 422 indicates a flat package and includes the signal processing circuit 404 and the look up tables 420 in the inside thereof. The signal processing circuit 404 and the look up tables 420 may be formed by 1 chip gate array or a plurality of chips.

FIG. 14 shows an embodiment of the data constitution of the look up table 420 which corrects 256 gray scale data per one color. The input data of 8 bits and the correction data of 10 bits are used. The correction data uses the number of bits for the number of gray scales which sufficiently enables the gray scale expression. The look up table 420 is constituted of a random access memory (RAM) and addresses the inputted 256 gray scale video signals and outputs the data of 10 bits stored in addresses as the correction data.

Here, as the constitution which outputs the correction data, any constitution which has a function of outputting the correction data in response to the input data can be used. For example, a signal processing circuit which calculates correction coefficients in response to the input data and outputs the correction data can be used. Further, although a table which includes addresses and can store data in respective addresses may be used as the look up table, the look up table may be constituted of memories such as a RAM or a ROM. Further, the look up table may be also constituted of a logic circuit.

Figure 15:
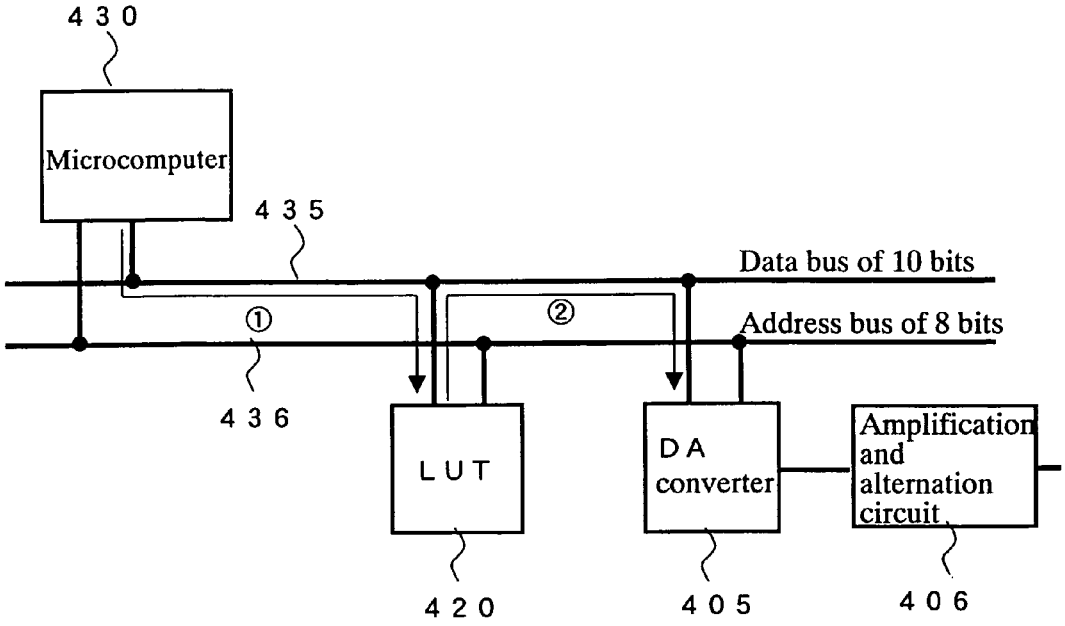
FIG. 15 is a schematic circuit diagram showing a path through which data is transferred to the look up table of the liquid crystal display device according to the embodiment of the present invention.

An example of a method for setting the correction data in the look up table 420 shown in FIG. 14 is shown in FIG. 15. With respect to the constitution of signal lines in the inside of the video signal control circuit 400, a data bus 435 of 10 bits and an address bus 436 of 8 bits are formed. Further, a microcomputer 430 is provided for data processing. Here, the microcomputer 430 may adopt a circuit which is capable of performing the data processing when necessary. At the time of setting the correction data, the correction data of 10 bits× 256 is transmitted from the microcomputer 430 and is set in the RAM for the look up table 420 (path (1)).

Figure 16:
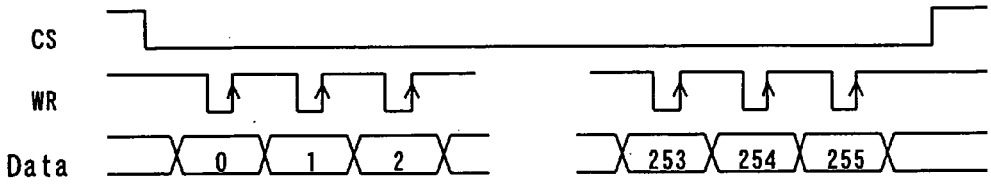
FIG. 16 is a timing chart showing a method for transferring the data to the look up table of the liquid crystal display device according to the embodiment of the present invention.

An example of setting timing of 256 data in parallel communication is shown in FIG. 16. The microcomputer 430 sets a chip select signal CS of the chip which constitutes the RAM to a low level and thereafter sequentially outputs values ranging from 0 to 255 to the address bus 436. Further, simultaneously with outputting of the addresses, the correction data for respective addresses is outputted to the data bus 435 at a rate of 10 bits. Further, in the state that the correction data is outputted to the data bus 435, a read/write signal WR is outputted. The RAM latches data at the rise of the read/write signal WR and stores the data. The addresses are incremented at the rise of the read/write signal WR and the data is set sequentially from the address 0 to the address 255.

To read out the correction data from the look up table 420, the digital signals which are subjected to the phase development are set in the address bus 436 and the RAM outputs the correction data of addresses instructed by the address bus 436 to the data bus 435 (path (2) in FIG. 15). A DA converter 405 converts the digital data inputted from the data bus 435 into analogue signals and outputs the analogue signals to the amplification and alternation circuit.

Figure 17A:
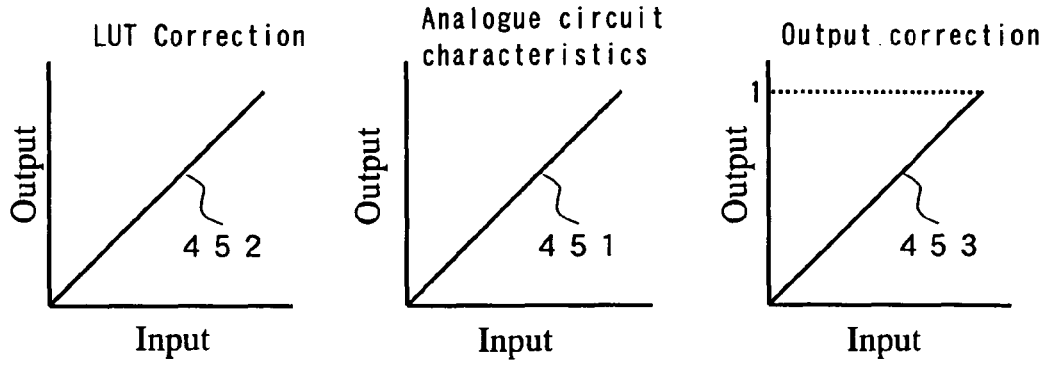
FIG. 17 are input-output contrast graphs showing the correction method in accordance with the look up table of the liquid crystal display device according to the embodiment of the present invention.
Figure 17B:
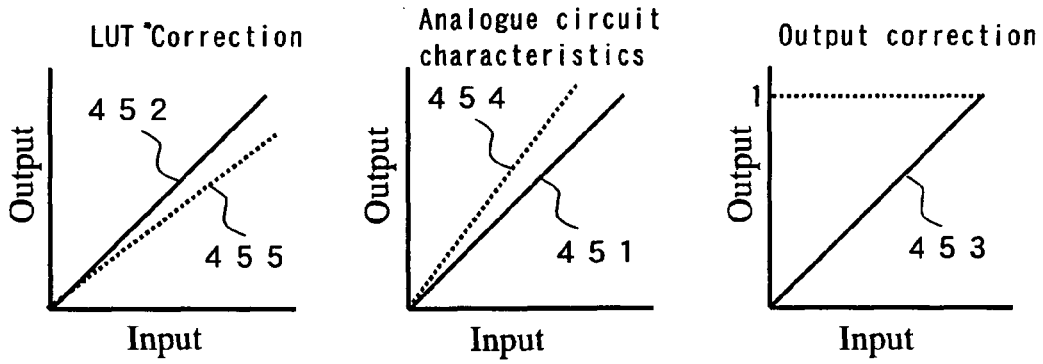
Figure 17C:
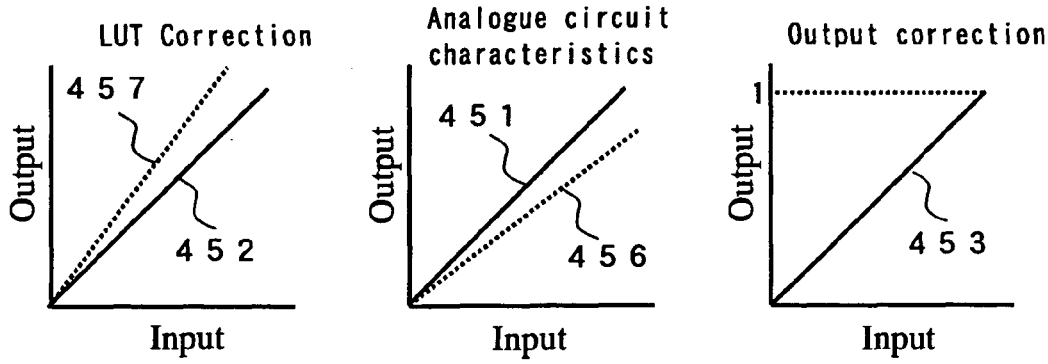

The correction of data using the look up table 420 is shown in FIG. 17. The irregularities of characteristics generated in the analogue circuit are corrected in the inverse direction using the look up table 420 so as to minimize the irregularities of the corrected output. FIG. 17(*a*) shows a case of ideal analogue circuit characteristics, in which a normal output is obtained with respect to an input. Numeral 451 shows the characteristics of the normal output with respect to the input. Since the characteristics which is indicated by a line 451 is normal, values which are not corrected are selected as values of the look up table 420. Numeral 452 indicates the characteristics of the input and the output of the look up table 420 when the correction is not made.

Subsequently, FIG. 17(*b*) shows a case in which the analogue circuit characteristics output a high value with respect to a normal value. Numeral 454 is a line which indicates the characteristics which exhibit the high output value with respect to the input. Since the characteristics of the input and the output indicated by the line 454 exhibit the high output value and hence, the correction data which lowers the output is selected in the look up table 420. The characteristics of the look up table 420, as indicated by a line 455, adopt values which lower the output with respect to the line 452 of the case in which the correction is not made.

As a method for correcting the irregularities in the case shown in FIG. 17(*b*), images on a liquid crystal panel are observed and a coefficient which makes the characteristics of the look up table set to the phase of high brightness take the line 455 of FIG. 17(*b*) is inputted into the microcomputer 430 shown in FIG. 15 from the outside. The microcomputer 430 prepares correction data based on the inputted coefficient and the reference data and also prepares the data of the look up table. The corrected images are outputted to the liquid crystal panel. When the further correction is necessary, the similar operation is repeated to perform the adjustment such that the brightness irregularities are not observed on the screen. Further, an interface part to which the coefficients are inputted from the outside is provided and is connected to the microcomputer 430.

Once the coefficients are set in the above-mentioned manner, these coefficients are recorded in the video signal control circuit 400. The correction data is prepared based on the standard data and the coefficients using the microcomputer 430 at the rising operation of the liquid crystal display device and is stored in the look up table 420.

Subsequently, FIG. 17(*c*) shows a case in which the analogue circuit characteristics output a low value with respect to a normal value. Numeral 456 is a line which indicates the characteristics which exhibit the low output value with respect to the input. Since the characteristics of the input and output indicated by the line 456 exhibit the low output value, the correction data which elevates the output is selected in the look up table 420. The characteristics of the look up table 420, as indicated by a line 457, adopt values which elevates the output with respect to the line 452.

Here, as the correction method, it is possible to adopt a method in which images of the liquid crystal panel are inputted by an image pick-up device, phases having the brightness irregularities are detected based on the inputted image data, coefficients are automatically calculated, and the correction data is prepared in the look up table 420 based on the calculated coefficients.

As shown in FIG. 17, the irregularities of the analogue circuit are constituted of the irregularities of the amplification factor, the irregularities of the output with respect to the input are changed lineally and hence, the data which corrects the irregularities also takes values which change lineally with respect to the input. Accordingly, it is possible to obtain the correction data by multiplying the standard data by the coefficients.

Figure 18:
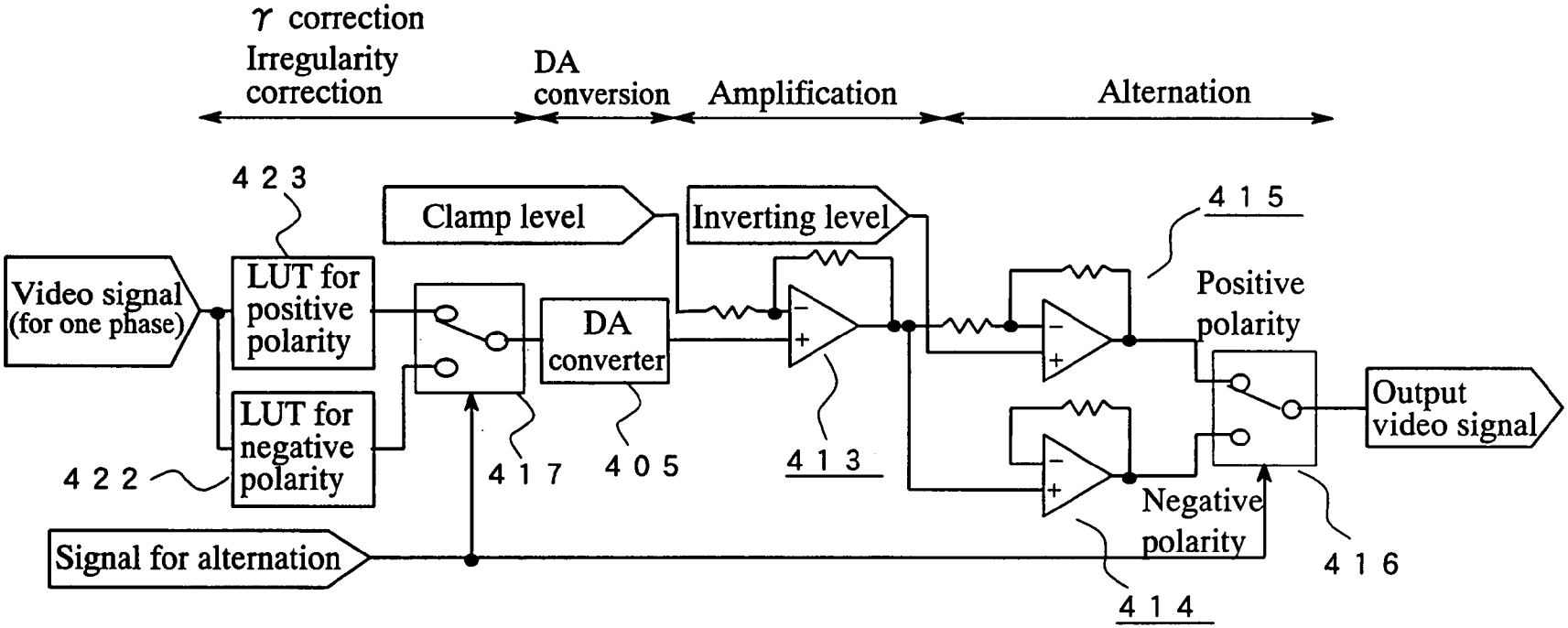
FIG. 18 is a schematic circuit diagram for correcting alternation irregularities derived using the look up table of the liquid crystal display device according to the embodiment of the present invention.

FIG. 18 shows the constitution which corrects the irregularities generated in the alternation circuit. The look up table has two tables, that is, a table 423 for positive polarity and a table 422 for negative polarity per one phase and these tables are selected by an analogue switch 417 in synchronism with the alternation signal. When the video signal is outputted from the operational amplifier 414 for negative polarity, the irregularities are corrected using the look up table 422 for negative polarity, while when the video signal is outputted from the operational amplifier 415 for positive polarity, the irregularities are corrected using the look up table 423 for positive polarity. By setting the correction data in respective look up tables for positive polarity and negative polarity, the irregularities between the positive polarity and the negative polarity can be corrected.

Figure 19A:
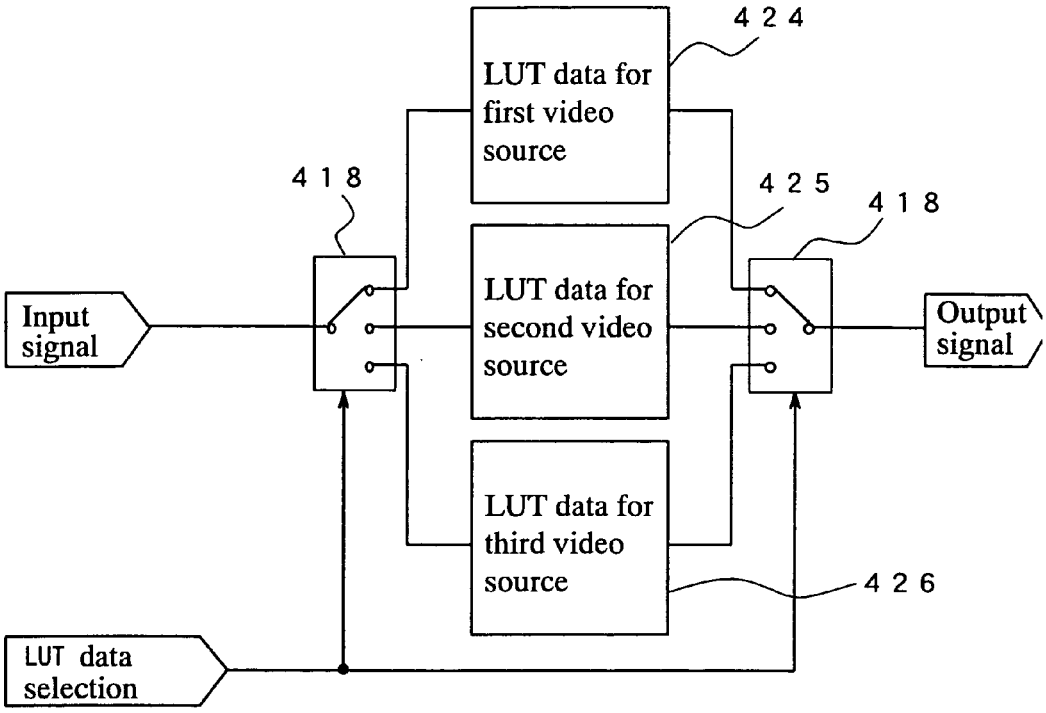
FIG. 19 is a schematic block diagram for correcting the difference between video sources using the look up table of the liquid crystal display device according to the embodiment of the present invention.
Figure 19B:
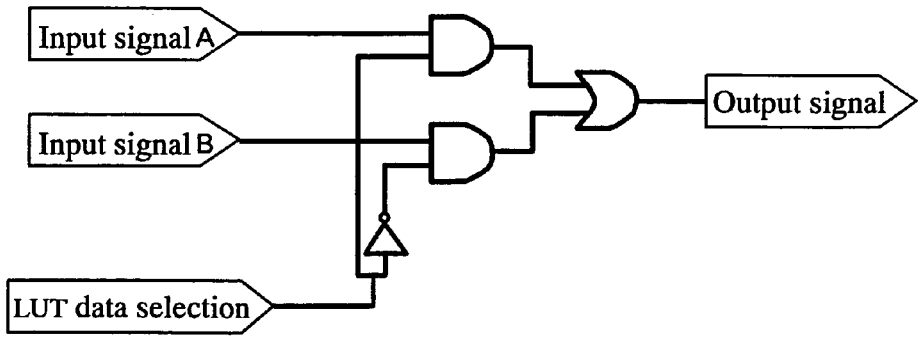

FIG. 19 shows a method which selects one look up table from a plurality of look up tables using video sources. Usually, as a source of signals, graphic images such as a window of a personal computer, movies, natural pictures and the like can be considered. The look up tables of the γ correction data and the like which are suitable for a plurality of these video sources are preliminarily prepared and are used by changing over a switch in response to the video source. FIG. 19 shows a case in which the look up tables are prepared for three types of video sources. Here, it is possible to provide a plurality of look up tables corresponding to the number of video sources. Numeral 424 indicates the look up table for the first video source, numeral 425 indicates the look up table for the second video source, and numeral 426 indicates the look up table for the third video source. The selection of the look up table is performed by a switch 418.

Any switch which can change over the transmission path of digital signals can be used as the switch 418. FIG. 19(*b*) shows a case in which the switch 418 is constituted of a logic circuit.

Figure 20A:
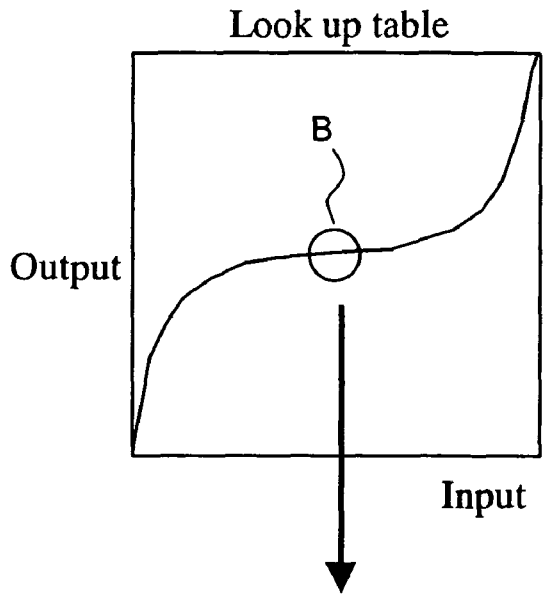
FIG. 20 is a view for explaining a method for increasing gray scales in a pseudo manner using the look up table of the liquid crystal display device according to the embodiment of the present invention.
Figure 20B:
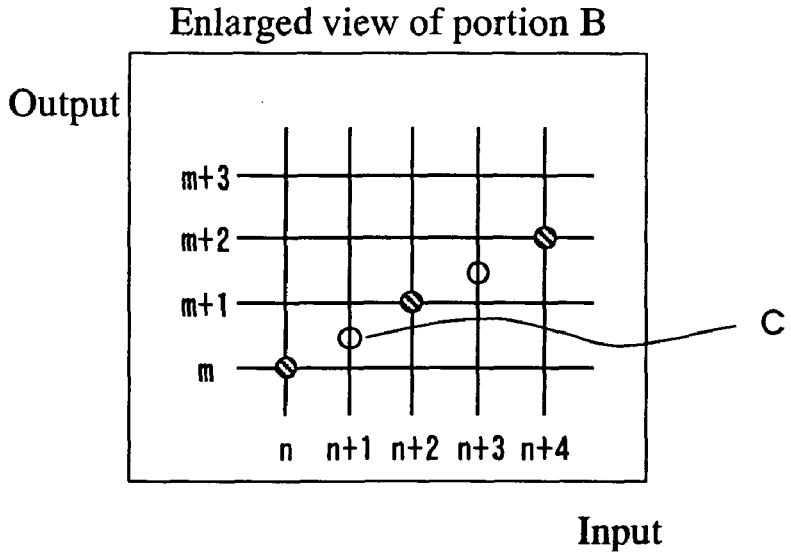
Figure 21A:
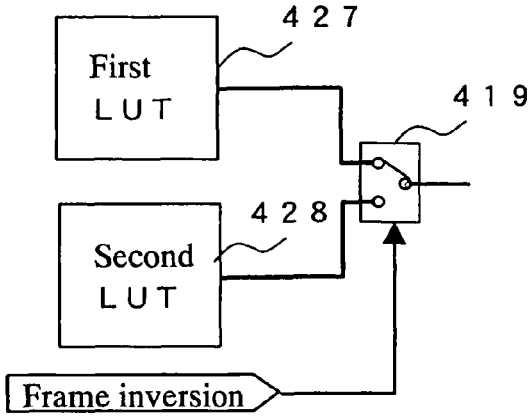
FIG. 21 is a view for explaining a method for increasing gray scales in a pseudo manner using the look up table of the liquid crystal display device according to the embodiment of the present invention.
Figure 21B:
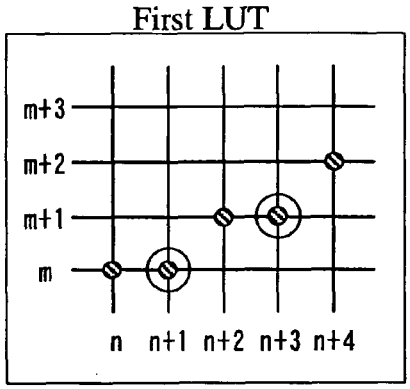
Figure 21C:
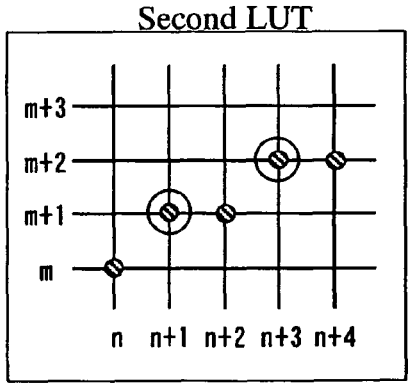
Figure 21D:
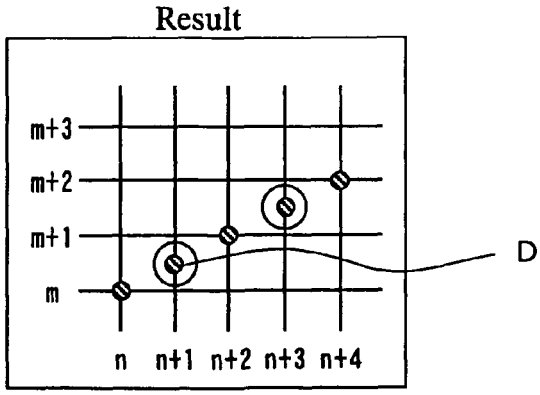

A method which elevates the gray scale in a pseudo manner using a plurality of look up tables is explained in conjunction with FIG. 20 and FIG. 21. When the look up tables for the γ correction or the like is used, as shown in FIG. 20(*a*), the change of an output with respect to an input is small so that the outputted gray scale is reduced whereby the image quality is deteriorated. FIG. 20(*b*) is an enlarged view of a portion B in FIG. 20(*a*) where the change of output is small. In an example shown in FIG. 20(*b*), as indicated by a symbol C, even when it is desired to output the gray scale between m and m+1 with respect to an input n+1, the gray scale can be expressed only either by m or m+1 in view of the number of bits. Accordingly, the intermediate gray scale is outputted by changing over two look up tables every frame.

In FIG. 21(*a*), numeral 427 indicates a first lookup table, numeral 428 indicates a second look up table and numeral 419 indicates an analogue change over switch. As shown in FIG. 21(*b*), when the first look up table 427 receives n+1 as an input, the first look up table 427 outputs m. As shown in FIG. 21(*c*), when the second look up table 428 receives n+1 as an input, the look up table 428 outputs m+1. The outputs of the first look up table 427 and the second look up table 428 are outputted using the analogue switch 419 such that these outputs are alternately changed over every frame period. Due to such an operation, as shown in FIG. 21(*d*), it is possible to visually display the intermediate gray scale (D in the drawing) between m and m+1 in a pseudo manner.

Figure 22A:
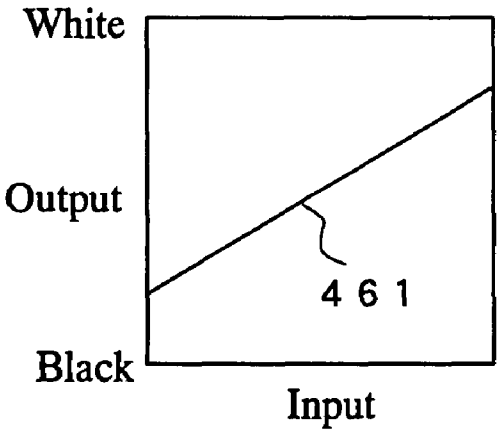
FIG. 22 is a view for explaining a method for adjusting contrast using the look up table of the liquid crystal display device according to the embodiment of the present invention.
Figure 22B:
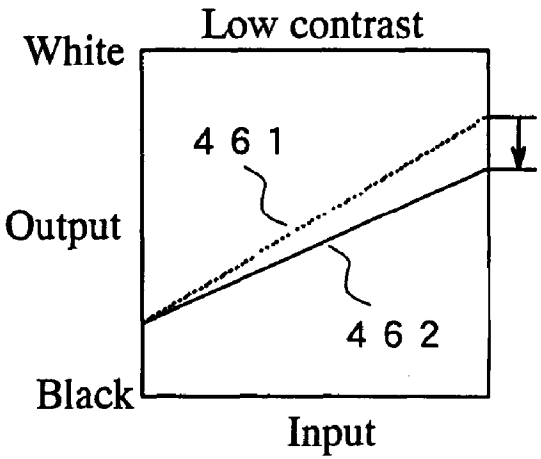
Figure 22C:
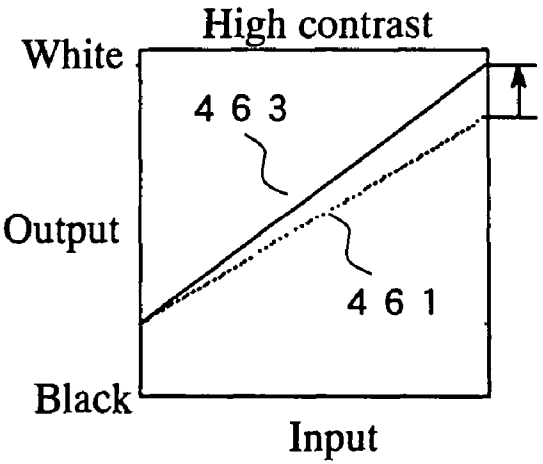
Figure 23A:
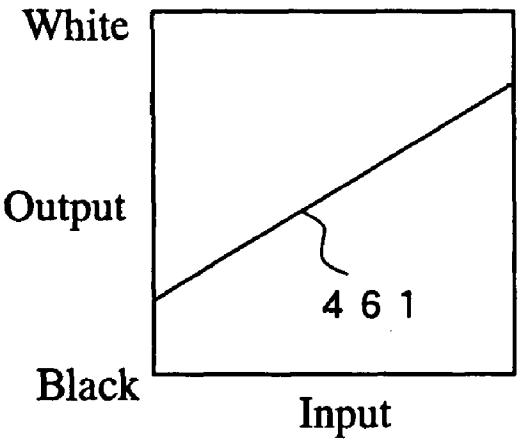
FIG. 23 is a view for explaining a method for adjusting brightness using the look up table of the liquid crystal display device according to the embodiment of the present invention.
Figure 23B:
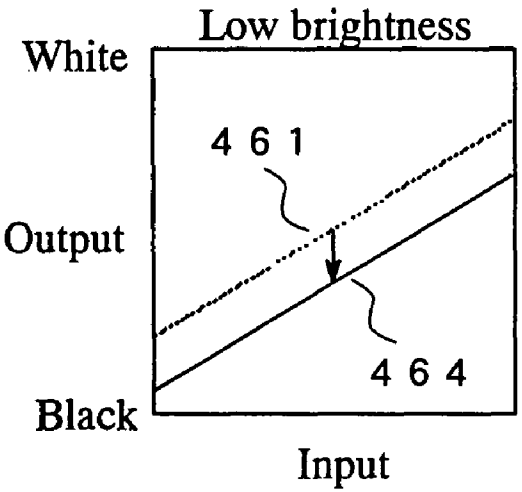
Figure 23C:
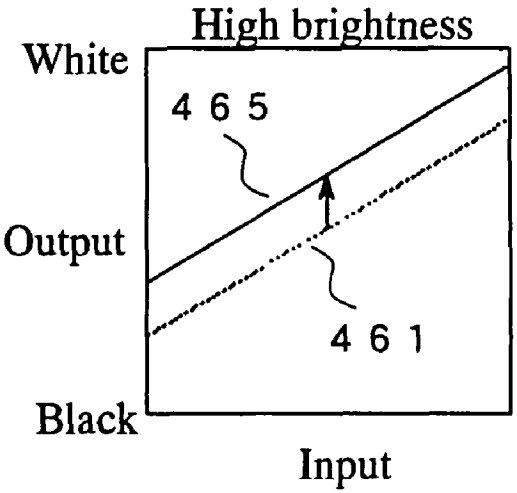

Subsequently, methods for adjusting the contrast and the brightness using the look up tables are explained in conjunction with FIG. 22 and FIG. 23. In FIG. 22 and FIG. 23, to ease the explanation, a case in which the liquid crystal display device is in a normally black mode is explained. That is, when a voltage is increased, the brightness (white display) is increased. FIG. 22 is a view which explains the method for adjusting the contrast. To lower the contrast of data depicted by a line 461 which indicates the characteristics of an output with respect to an input in FIG. 22(*a*), as shown in FIG. 22(*b*), the inclination of a line 462 which indicates the characteristics is decreased. To elevate the contrast, as shown in FIG. 22(*c*), the inclination of a line 463 which indicates the characteristics is increased.

FIG. 23 is a view which explains the method for adjusting the brightness. To lower the brightness of data depicted by a line 461 which indicates the characteristics of an output with respect to an input shown in FIG. 23(*a*), as shown in FIG. 23(*b*), a line 464 which indicates the characteristics is moved in parallel in the black direction. On the other hand, to elevate the brightness of data, as shown in FIG. 23(*c*), a line 465 which indicates the characteristics is moved in parallel in the white direction.

Figure 24:
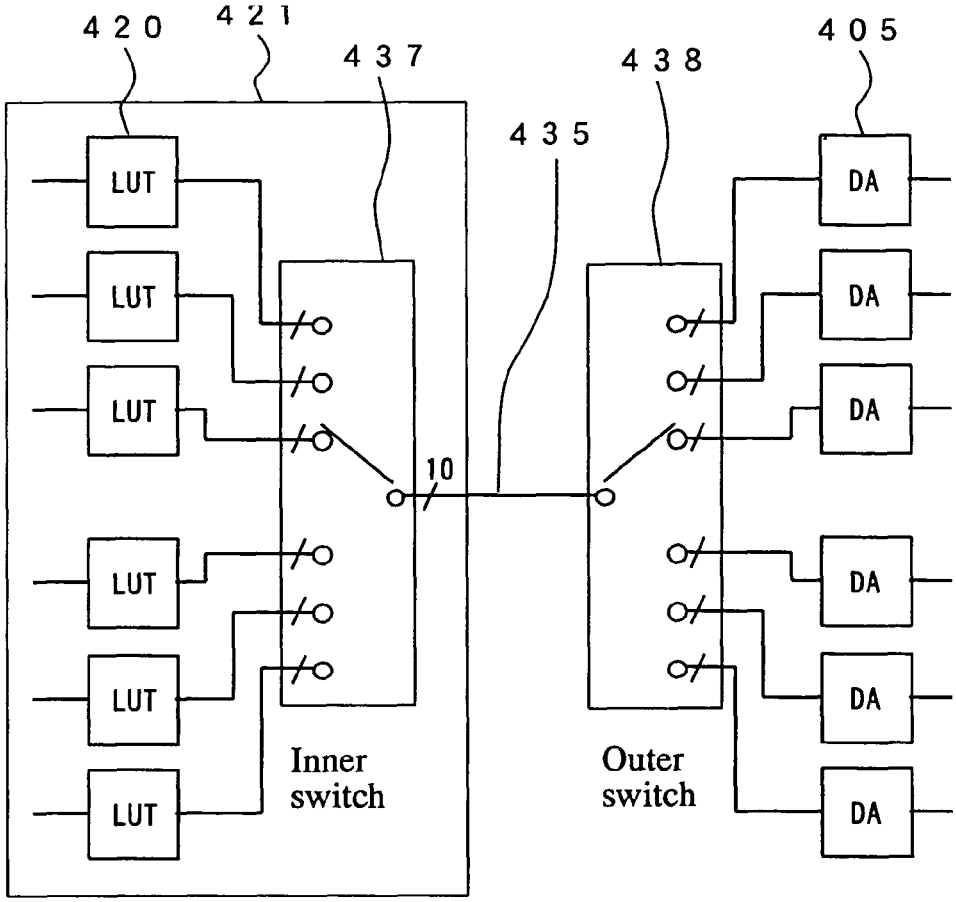
FIG. 24 is a schematic circuit diagram for explaining a method for decreasing the number of pins in the look up table of the liquid crystal display device according to the embodiment of the present invention.

FIG. 24 shows a circuit constitution which provides analogue switches for decreasing the number of pins of a look up table 421 formed in one package. Here, it is possible to decrease the number of wiring and pins of inner and outer interfaces using the similar constitution. When a plurality of look up tables 420 are accommodated in one package, although the circuit constitution can be simplified, there arises a problem that the number of pins of the package is increased. Since the data bus 435 arranged between the look up table 420 and the DA converter 405 adopts 10 bits, when the data bus is provided for each phase, the number of pins of the one-packaged look up table 421 which is connected to the data bus is remarkably increased. For example, when the data bus adopts 12 phases and 10 bits, the total number of pins becomes 120. In view of the above, in the present invention, the output of each look up table is selected by an inner switch 437 and the designation of the output is selected by an external switch 438 at the same timing as the selection of the output of the look up table. Due to such a circuit constitution, in case of 12 phases and 10 bits, the number of pins can be decreased from 120 to 10 so that it is possible to minimize the size of the using package.

Figure 25:
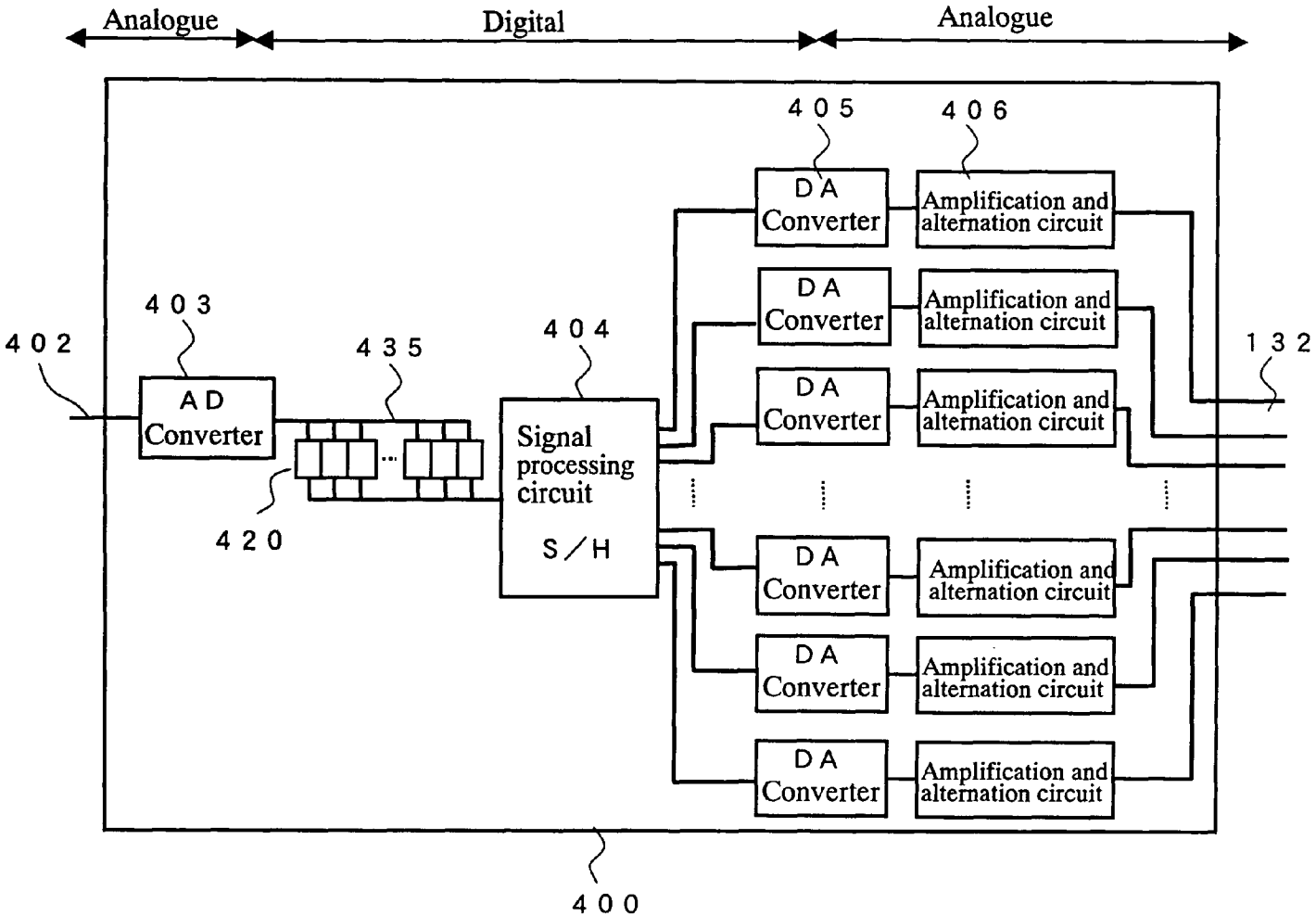
FIG. 25 is a block diagram showing a video signal control circuit of the liquid crystal display device according to the embodiment of the present invention.

Subsequently, the constitution which is capable of omitting the number of wiring is explained in conjunction with FIG. 25. In FIG. 25, the position of the look up tables 420 comes before the sample hold circuit 404 for phase development. With the use of the constitution shown in FIG. 25, the number of wiring between the look up tables 420 and the sample hold circuit 404 can be largely omitted. For example, with respect to the constitution shown in FIG. 11, between the sample hold circuit 404 and the look up tables 420, the number of signal lines for transmitting data must correspond to the number of signal lines which are subjected to the phase development. When the signal lines adopt 12 phases and 10 bits, the number of wirings becomes 120. To the contrary, with respect to the constitution shown in FIG. 25, the number of wirings can be reduced to 10 for 10 bits.

With respect to the look up tables 420 shown in FIG. 25, display signals are transmitted to the video signal control circuit from the external device through the display signal lines 402 in a fixed order. Accordingly, by determining the order of the phase development in accordance with the order of the display signals, there arises no problem even when the position of the part for performing the phase development and the position of the part which performs the correction are changed. That is, so long as the data is determined as the data of nth phase, it is possible to perform the correction necessary for the irregularities of the nth phase prior to the phase development.

The data bus 435 of 10 bits, for example, is outputted from the AD converter 403. The number of look up tables 420 correspond to the number of signal lines which are subjected to the phase development and the data bus 435 is connected to respective look up tables 420. The video signal control circuit 400 is informed of the phase of the transmitted data based on the order of data outputted from the AD converter 403 and selects the look up table 420 which performs the correction.

Figure 26:
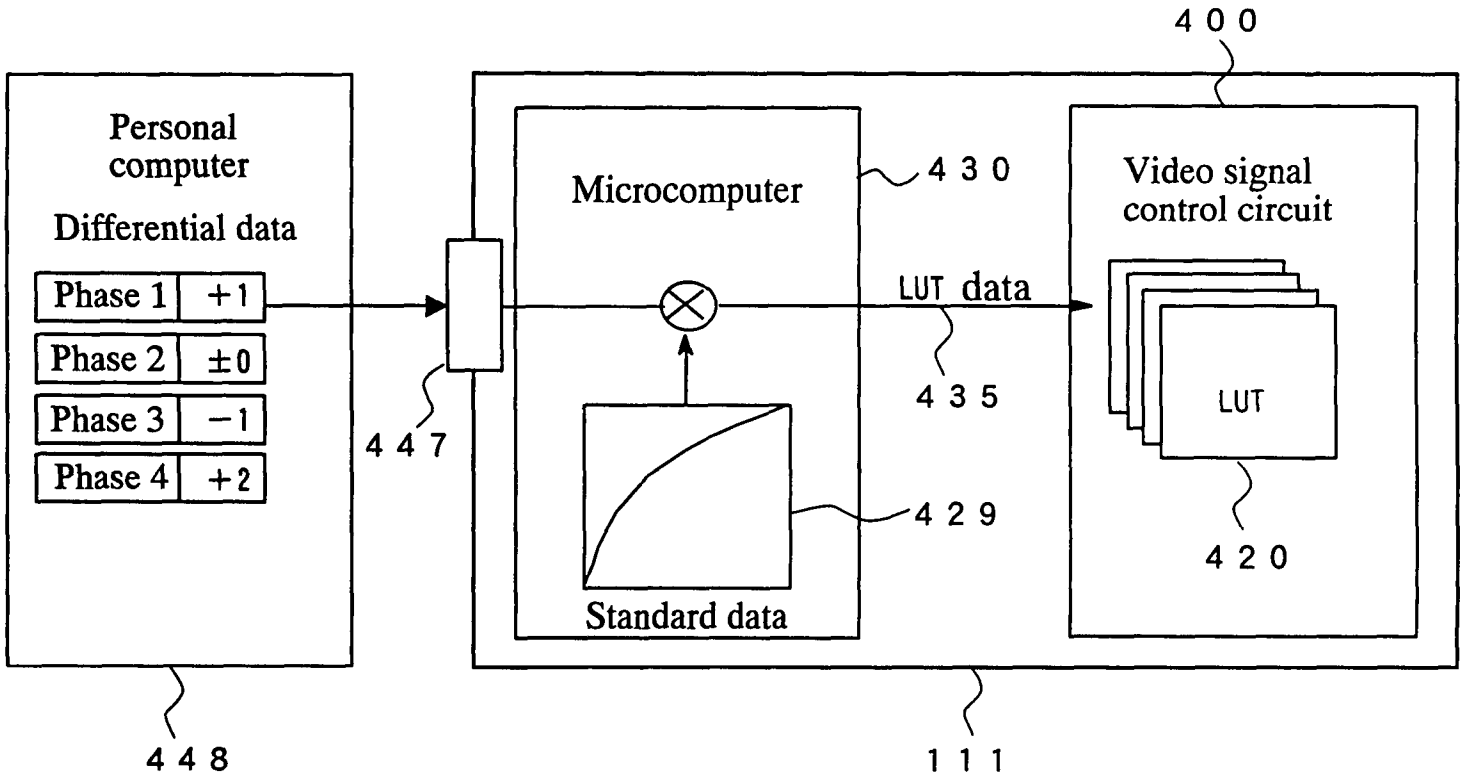
FIG. 26 is a schematic circuit diagram for explaining a data transfer method in the look up table of the liquid crystal display device according to the embodiment of the present invention.

Subsequently, the communication of the look up table data is explained in conjunction with FIG. 26. When a data quantity set in the look up table 420 covers 12 phases per one color, 10 bit (2 byte) data and 256 gray scales, the data quantity becomes 6144 bytes based on the following calculation.

12 phases×2 bytes×256 gray scales=6144 bytes

The data quantity for three colors becomes 18432 bytes based on the following calculation.

6144 bytes×3 colors=18432 bytes.

For example, with the use of a method in which the look up table data is recorded in an external personal computer 448, the data communication is performed between the external personal computer 448 and the microcomputer 430 in the inside of the display control device 111 and the data is fetched in the look up table 420, when the communication between the personal computer 448 and the microcomputer 430 is executed at a speed of 9600 bps using RS-232C, it takes 15 seconds at the fastest. In the drawing, numeral 447 indicates an interface part for data communication. Further, the data communication between the personal computer 448 and the microcomputer 430 is not limited to RS-232C and other method (for example, USB, IEEE1394, SCS1, Bluetooth and the like) are applicable.

Then, to take a case in which the data quantity is stored in a built-in RAM of the microcomputer in the inside of the video signal control circuit 400 into consideration, there arises a problem that the data quantity occupies a large area amounting to 18432 bytes.

To shorten the communication time and to save the built-in RAM of the microcomputer, the data is divided to the standard data 429 for γ correction and the differential data. The difference data is set to an optimal value by observing display images using an external device (a personal computer). In preparing the look up table data, the calculation is performed by multiplying the standard data 429 by the difference data in the inside of the microcomputer. Due to such an operation, it is possible to fetch the data in the look up table without increasing the communication data quantity between the personal computer and the microcomputer and without using the large region of the built-in RAM of the microcomputer.

Figure 27A:
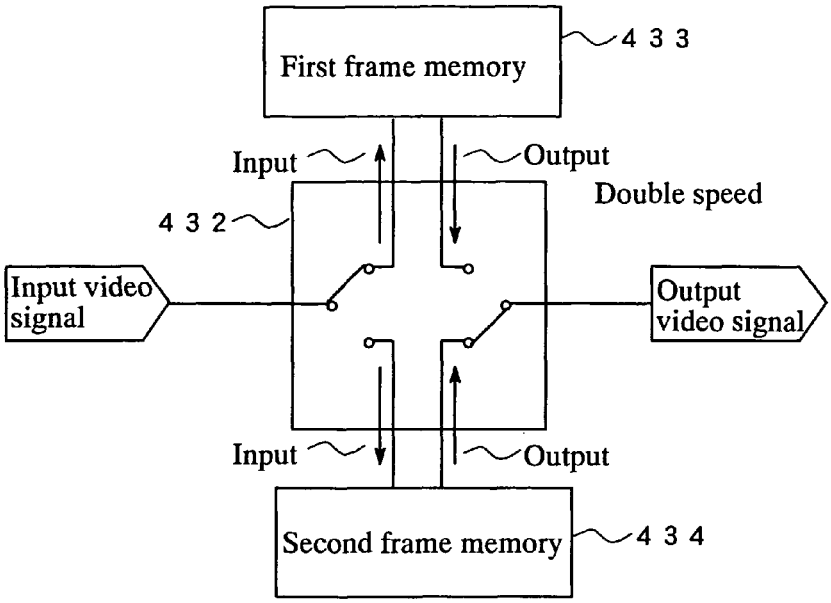
FIG. 27 includes a schematic circuit diagram and a timing chart for explaining a method for multiplying frame frequency of the liquid crystal display device according to the embodiment of the present invention.
Figure 27B:
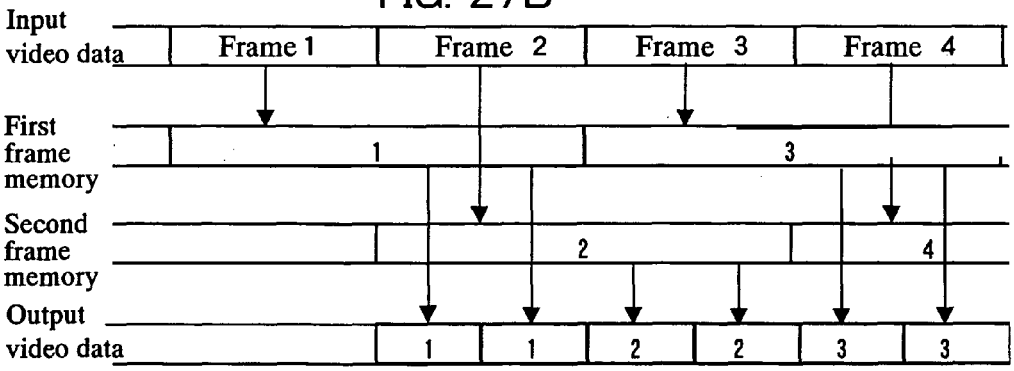

Subsequently, a method for multiplying the frame frequency is explained in conjunction with FIG. 27. FIG. 27(*a*) shows the circuit constitution which converts the frame frequency using a frame memory for two frames and FIG. 27(*b*) is a timing chart for obtaining a twofold speed.

The circuit which converts the frame frequency is constituted of a timing controller 432, a first frame memory 433 having the capacitance for one frame and a second frame memory 434 having the capacitance for one frame. Video signals are inputted to the timing controller 432 and then are inputted to the first frame memory 433 and the second frame memory 434 by a switch operation in the timing controller 432. The video signals are read out from the first frame memory 433 and the second frame memory 434 with a twofold clock when the frequency is increased twice, for example and are outputted from the timing controller 432.

Subsequently, the explanation is made with respect to timing. The image data is directly written in the first frame memory 433 at the timing that the input of the video signal is frame 1. The image data in the frame is written in the second frame memory 434 at the timing that the image input is in frame 2. Simultaneously with such operations, the data in frame 1 is read out twice at the twofold speed from the first frame memory 433. At the timing of frame 3, the image data in frame 3 is written in the first frame memory 433 and, at the same time, the data in the second frame memory 434 is read out at the twofold speed. By repeating these operations, it is possible to output the signals having the frame frequency increased twice.

Figure 28:
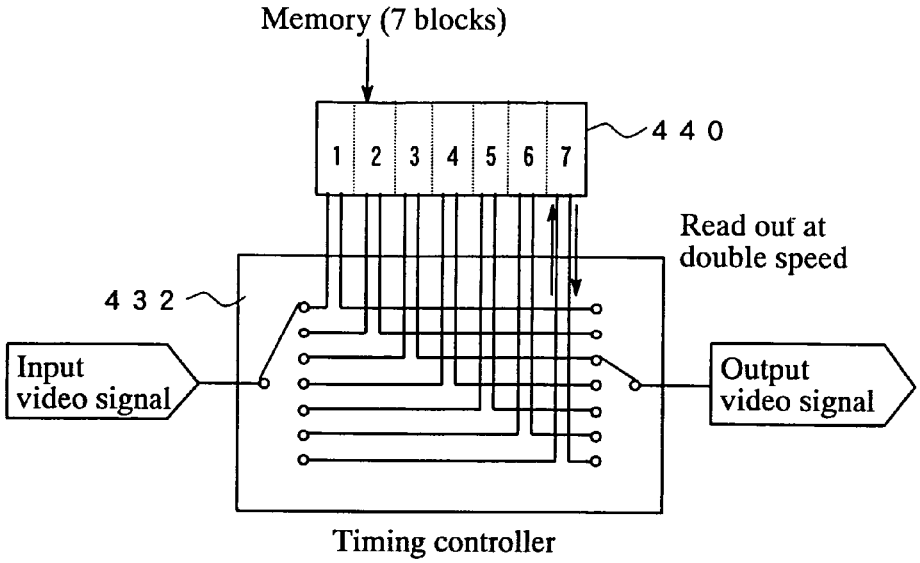
FIG. 28 is a schematic circuit diagram for explaining a method for multiplying frame frequency of the liquid crystal display device according to the embodiment of the present invention.
Figure 29:
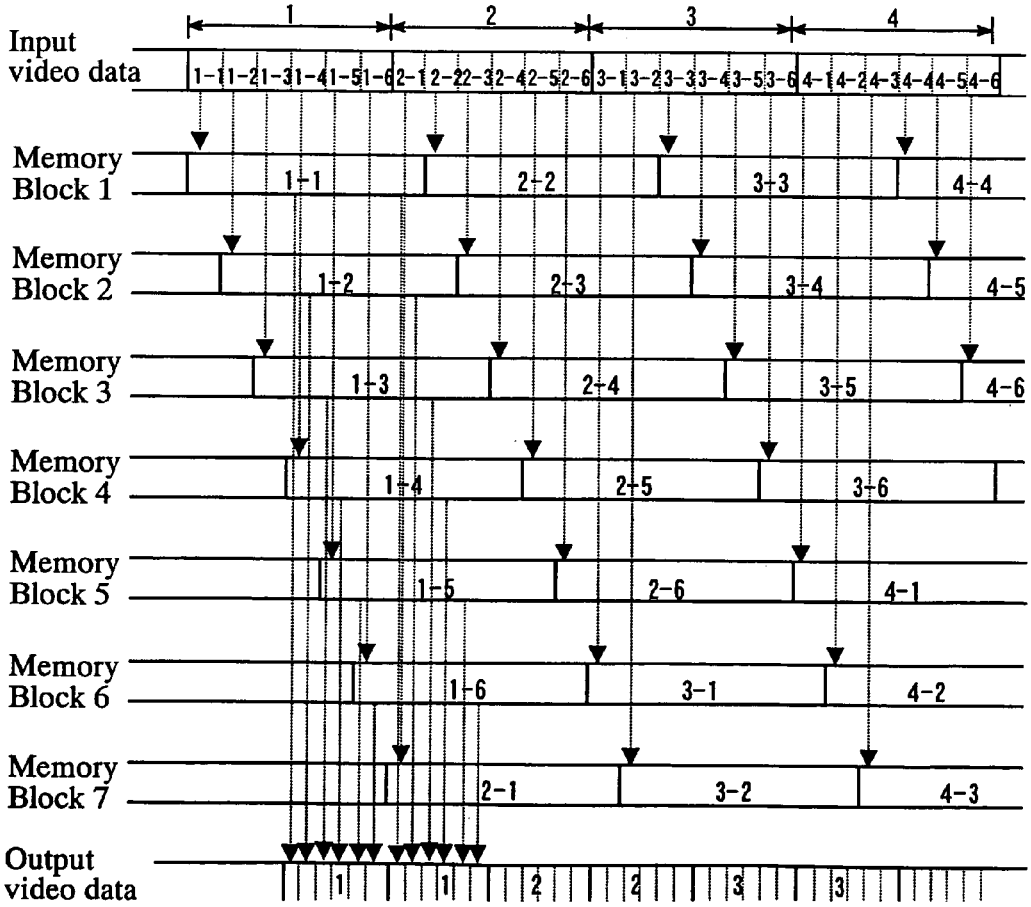
FIG. 29 is a timing chart for explaining a method for multiplying frame frequency of the liquid crystal display device according to the embodiment of the present invention.

FIG. 28 shows the circuit constitution in which the frame frequency is converted using the memory for 1 frame+1 block and FIG. 29 shows a timing chart. In FIG. 28, a case in which 6 blocks of memory capacitance correspond to 1 frame is exemplified. The circuit is constituted of a block memory 440 which is divided into 7 blocks and a timing controller 432. Inputs and outputs of respective seven memory blocks are controlled by the timing controller 432.

Then, the manner of operation is explained based on a timing chart shown in FIG. 29. Video signals for one frame is divided into six timings and these timings are indicated with 1-1 to 1-6. The signal of 1-1 is written in the block 1, the signal of 1-2 is written in the block 2 and, thereafter, the signals are written in respective blocks sequentially. Then, the signals are read out from the memory at a twofold speed in a synchronism with the writing timing and the video signals of the twofold speed are outputted as shown in FIG. 29. Then, the signal of 2-1 is written in the block 7 and the signal of 2-2 is written in the block 1. Thereafter, the reading and writing are performed by repeating this rotation. Although this circuit constitution makes the operation complicated, the circuit constitution has an advantage that the memory capacitance can be reduced. The memory capacitance can be further reduced corresponding to the increase of the number of divided blocks. In this case, however, the operation become more complicated. Accordingly, it is necessary to take the balance between these conditions.

Figure 30:
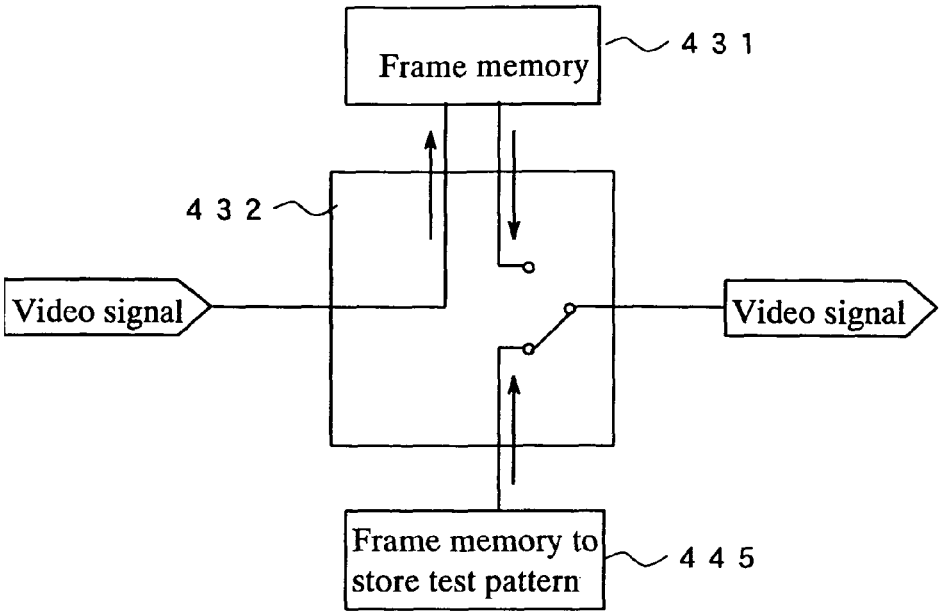
FIG. 30 is a schematic circuit diagram for explaining a method for displaying a test pattern using a frame memory of the liquid crystal display device according to the embodiment of the present invention.

FIG. 30 shows the circuit constitution which outputs test patterns using a memory. Although the adjustment of the circuit is usually performed using video signals each time, in this case, the test patterns such as a dotted "ichimatsu" pattern, a color bar chart pattern, a gray scale pattern and the like are used. In this case, it is necessary to prepare a personal computer or the like which outputs these patterns as a signal source. However, with the use of the circuit shown in FIG. 30, the patterns are generated in the inside of the video signal control circuit 400 so that such a signal source is unnecessary. The circuit is constituted of a frame memory 431 which is served for the usual frequency conversion or the like, a frame memory 445 in which test patterns are preliminarily written and a timing controller 432. During the usual operation, the video signals are outputted from the frame memory 431. When the test pattern is displayed, a switch is changed over so as to make the frame memory 445 for test patterns output the video signals.

Figure 31:
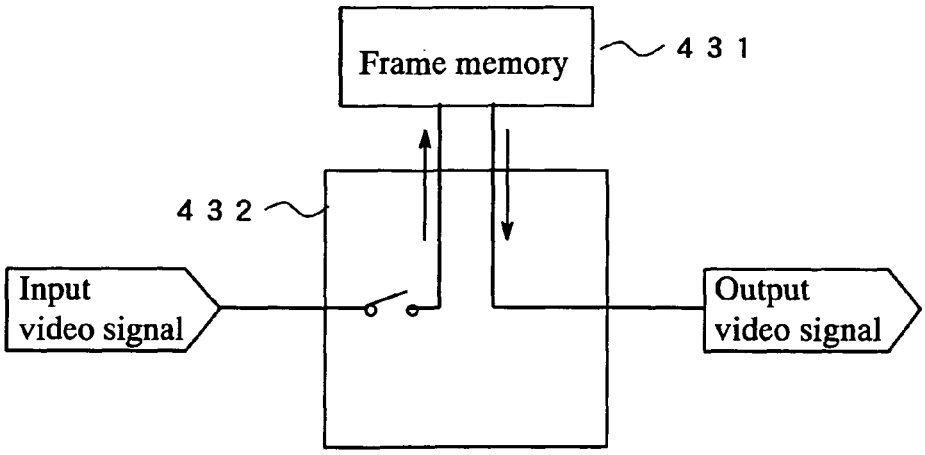
FIG. 31 is a schematic circuit diagram for explaining a method for displaying a still picture using a frame memory of the liquid crystal display device according to the embodiment of the present invention.

FIG. 31 shows the circuit constitution which outputs still pictures using the frame memory 431. Still-picture outputs perform a function which is effective when video signals whose display is not desirable must be inputted. In the usual operation, the images are displayed real time to always update the video signals in the inside of the frame memory 431. When writing of video signal into the memory is interrupted, the image is not updated. Accordingly, the signals immediately before the interruption are read out from the memory repeatedly. In this manner, the outputting of still pictures is performed by controlling a switch for writing signals into the memory.

Figure 32A:
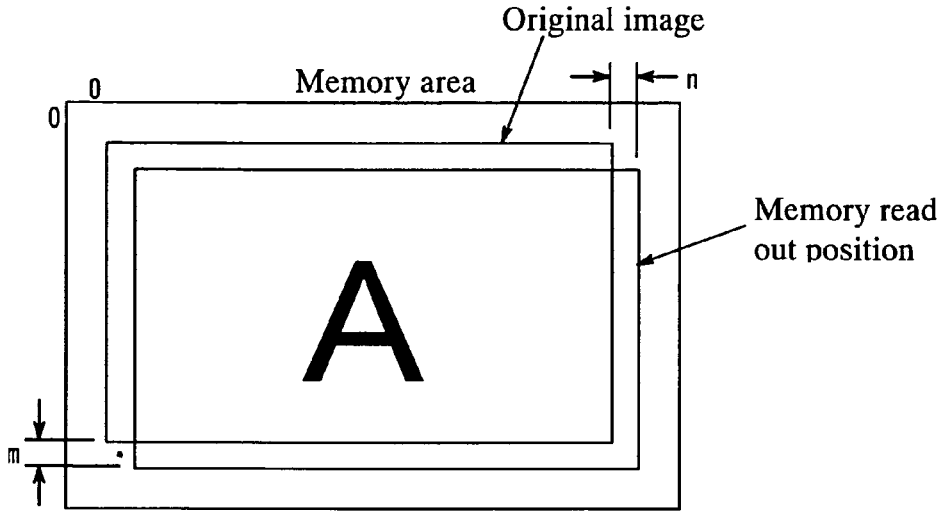
FIG. 32 is a schematic circuit diagram for explaining a method which adjusts convergence using the frame memory of the liquid crystal display device according to the embodiment of the present invention.
Figure 32B:
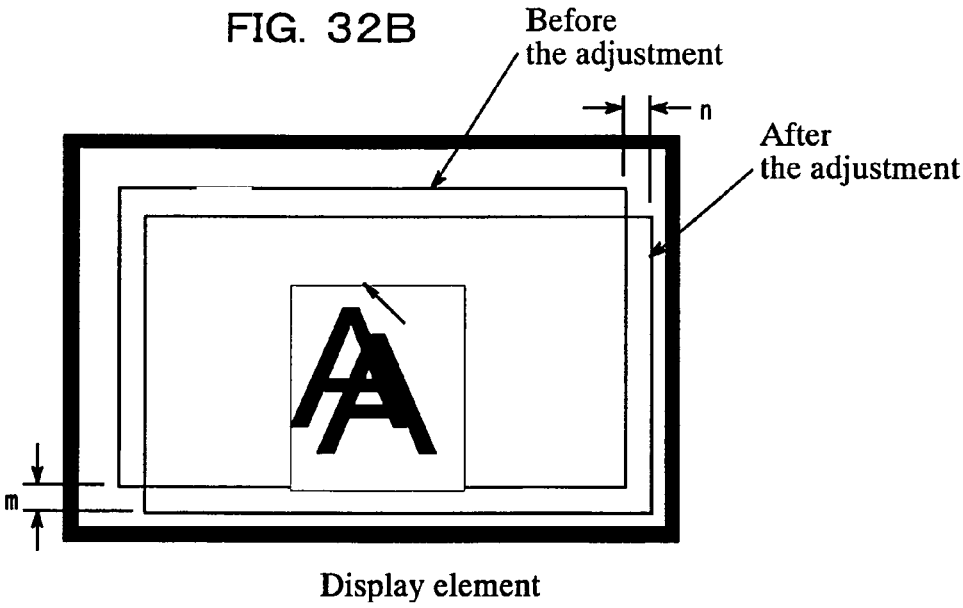

FIG. 32 shows the adjustment of convergence of a circuit which uses the frame memory 431. When a product uses a plurality (for example, two sheets or three sheets) of display elements, it is necessary to align their respective positions at a level of a pixel unit. Although the alignment is usually performed by finely adjusting the positions of the display elements, according to the method of this embodiment, it is possible to perform the adjustment without changing the positions of the display elements. The method is explained hereinafter. At the time of reading out the video signals written in the frame memory 431, the addresses are adjusted so as to adjust the display position. When the address of the frame memory 431 and the pixel of the display element agree with each other, the address of reading position is shifted by n in the right direction and in the downward direction by m with respect to the position of the video signals in the inside of the memory as shown in FIG. 32 (*a*), for example. Correspondingly, the display position in the display element is moved in the left direction by n pixels and in the upward direction by m pixels. In this manner, the display position of the display element is adjusted.

Figure 33:
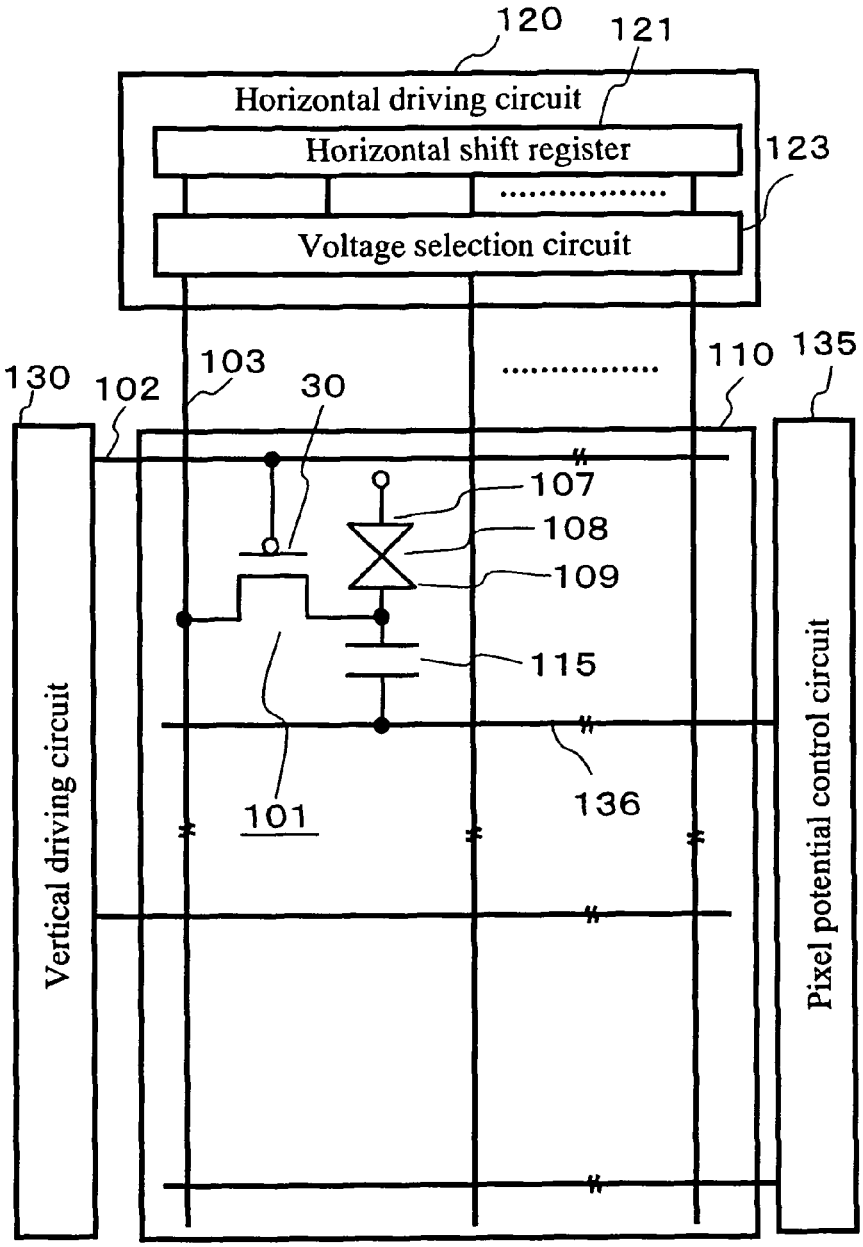
FIG. 33 is a block diagram for explaining a pixel portion of the liquid crystal display device according to the embodiment of the present invention.

Subsequently, the pixel portion 101 is explained in conjunction with FIG. 33. Further, a driving method which changes the potential of a pixel electrode using a pixel potential control circuit is explained in conjunction with FIG. 33. FIG. 33 is a circuit diagram showing an equivalent circuit of the pixel portion 101. The pixel portions 101 are arranged in a matrix array such that each pixel portion 101 is disposed in a crossing region formed by two neighboring scanning signal lines 102 and two neighboring video signal lines 103 (a region surrounded by four signal lines) of the display part 110. However, only one pixel portion is shown in FIG. 33 to simplify the drawing. Each pixel portion 101 includes an active element 30 and a pixel electrode 109. Further, a pixel capacitance 115 is connected to the pixel electrode 109. The pixel capacitance 115 has one electrode thereof connected to the pixel electrode 109 and the other electrode thereof connected to the pixel potential control line 136. Further, the pixel potential control line 136 is connected to the pixel potential control circuit 135. Here, in FIG. 33, the active element 30 is formed of ap-type transistor.

As mentioned previously, the scanning signals are outputted to the scanning signal lines 102 from the vertical driving circuit 130. The ON/OFF control of the active elements 30 is performed in response to the scanning signals. The gray scale voltages are supplied to the video signal lines 103 as the video signals and when the active elements 30 are turned on, the gray scale voltages are supplied to the pixel electrodes 109 from the video signal lines 103. Counter electrodes (common electrodes) 107 are arranged to face the pixel electrodes 109 in an opposed manner and a liquid crystal layer (not shown in the drawing) is inserted between the pixel electrode 109 and the counter electrode 107. Here, on the circuit diagram shown in FIG. 33, it is expressed that a liquid crystal capacitance 108 is equivalently connected between the pixel electrode 109 and the counter electrode 107. The display is performed by making use of a phenomenon that when the voltages are applied between the pixel electrodes 109 and the counter electrodes 107, the orientation direction of the liquid crystal molecules is changed and hence, the property of the liquid crystal layer with respect to light is changed.

As a method for driving the liquid crystal display device, as mentioned previously, the alternation driving is performed to prevent applying of the direct current to the liquid crystal layer. To perform the alternation driving, when the potential of the counter electrodes 107 is used as the reference potential, the voltages of positive polarity and negative polarity with respect to the reference potential are outputted from the video signal selection circuit 123 as the gray scale voltages. However, when the video signal selection circuit 123 is formed of a circuit having high dielectric strength which can withstand the potential difference between positive polarity and negative polarity, there arises a problem that the circuit including the active elements 30 becomes large-sized. Also, there arises a problem that the operational speed is decreased. Further, as shown in FIG. 10, it is necessary to provide the operational amplifiers of positive polarity side and negative polarity side in the video signal control circuit 400.

In view of the above, the inventors have reviewed the alternation driving while using signals of the same polarity with respect to the reference potential as the video signals supplied to the pixel electrodes 109 from the video signal selection circuit 123. For example, the voltages of positive polarity with respect to the reference potential are used as the gray scale voltages outputted from the video signal selection circuit 123. After writing the voltages of positive polarity with respect to the reference potential to the pixel electrodes, by lowering the voltages of the pixel potential control signals applied to the electrodes of the pixel capacitance 115 from the pixel potential control circuit 135, the voltages of the pixel electrodes 109 are also lowered so that it is possible to generate the voltages of negative polarity with respect to the reference potential. With the use of such a driving method, the difference between the maximum value and the minimum value outputted from the video signal selection circuit 123 can be made small so that the video signal selection circuit 123 can be formed of a circuit of low dielectric strength. Here, although the case in which the voltages of negative polarity are generated using the pixel potential control circuit 135 by writing the voltages of positive polarity in the pixel electrodes 109 has been explained as an example, it is possible to generate the voltages of positive polarity by writing the voltages of negative polarity in the pixel electrodes 109 by elevating the voltages of the pixel potential control signals.

Figure 34A:
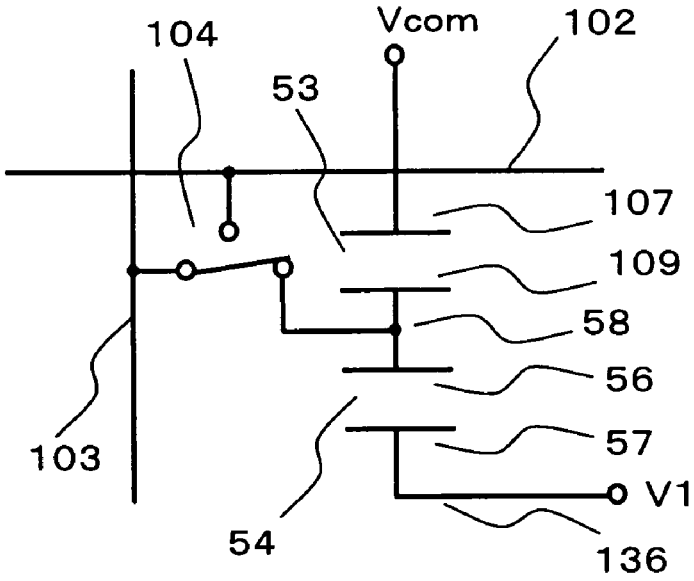
FIG. 34 is a schematic circuit diagram for explaining a method for controlling pixel potential of the liquid crystal display device according to the embodiment of the present invention.
Figure 34B:
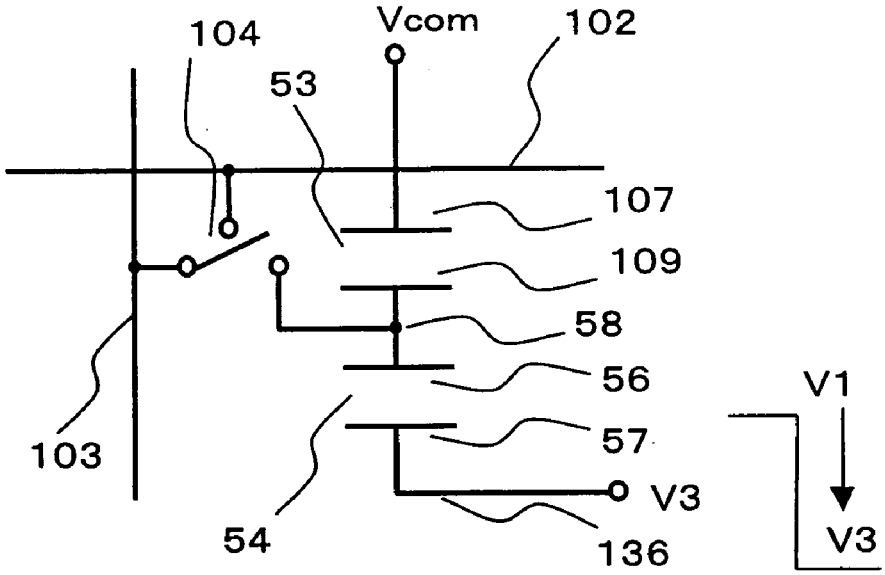

Subsequently, a method for changing the voltages of the pixel electrodes 109 is explained in conjunction with FIG. 34. In FIG. 34, for easing the explanation, the liquid crystal capacitance 108 is expressed as a first capacitor 53, the pixel capacitance 115 is expressed as a second capacitor 54 and an active element 30 is expressed as a switch 104. An electrode which is connected to the pixel electrode 109 of the pixel capacitance 115 is assumed as an electrode 56 and an electrode which is connected to the pixel potential control line 136 of the pixel capacitance 115 is assumed as an electrode 57. Further, a point at which the pixel electrode 109 and the electrode 56 are connected to each other is indicated as a node 58. Here, for easing the explanation, other parasitic capacitances are ignored. Further, the capacitance of the first capacitor 53 is indicated by CL and the capacitance of the second capacitor 54 is indicated by CC.

First of all, as shown in FIG. 34(*a*), a voltage V1 is applied to the electrode 57 of the second capacitor 54 from the outside. Subsequently, when the switch 104 is turned on in response to the scanning signal, a voltage is supplied to the pixel electrode 109 and the electrode 56 from the video signal line 103. Here, the voltage supplied to the node 58 is set to V2.

Then, as shown in FIG. 34(*b*), at a point of time that the switch 104 is turned off, the voltage (pixel potential control signal) which is supplied to the electrode 57 is dropped from V1 to V3. Here, since a total quantity of charge charged in the first capacitor 53 and the second capacitor 54 is not changed, the voltage of the node 58 is changed and becomes $V2-\{CC/(CL+CC)\}\times(V1-V3)$.

Here, when the capacitance CL of the first capacitor 53 is sufficiently small compared to the capacitance CC of the second capacitor 54 ($CL \ll CC$), the relationship $CC/(CL+CC)\cong 1$ and the voltage of the node 58 becomes $V2-V1+V3$. Here, assuming $V2=0$ and $V3=0$, the voltage of the node 58 becomes $-V1$.

According to the above-mentioned method, the voltages supplied to the pixel electrodes 109 from the video signal lines 103 can be generated by making the voltages have the positive polarity with respect to the reference potential of the counter electrode 107 and by controlling the voltage (pixel potential control signal) applied to the electrode 57 with respect to the signals of negative polarity. By generating the signals of negative polarity in this manner, it is unnecessary to supply the signals of negative polarity from the video signal selection circuit 123 so that it is possible to form peripheral circuits using elements of low dielectric strength.

Subsequently, operational timings of the circuit shown in FIG. 33 are explained in conjunction with FIG. 35. Φ1 indicates a gray scale voltage supplied to the video signal lines 103. Φ2 indicates a scanning signal supplied to the scanning signal lines 102. Φ3 indicates a pixel potential control signal (voltage drop signal) supplied to the pixel potential control signal line 136. Φ4 indicates the potential of the pixel electrodes 109. Here, the pixel potential control signal Φ3 is a signal which has an amplitude defined between the voltages V3 and V1 shown in FIG. 32.

Figure 35:
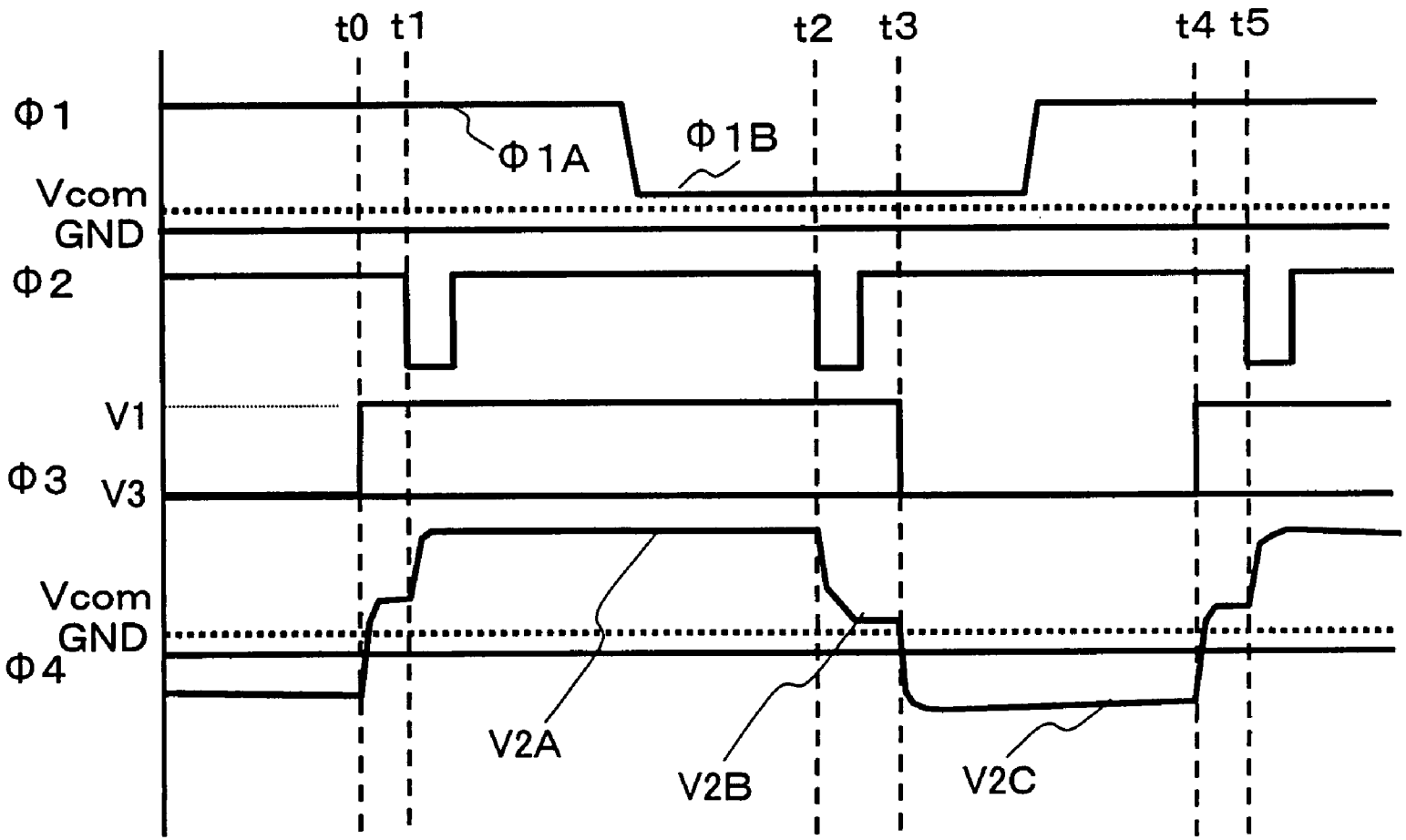
FIG. 35 is a timing chart for explaining a method which controls the pixel potential of the liquid crystal display device according to the embodiment of the present invention.

In explaining the operational timings in FIG. 35, signals Φ1 include an input signal for positive polarity Φ1A and an input signal for negative polarity Φ1B. Here, the input signal for negative polarity Φ1B means a signal used in a case in which the voltage applied to the pixel electrodes is changed in response to the pixel potential control signal and takes the negative polarity with respect to the reference potential Vcom. In this embodiment, a case in which the voltage is supplied such that both of the input signal for positive polarity Φ1A and the input signal for negative polarity Φ1B take the potential of positive polarity with respect to the reference potential Vcom applied to the counter electrode 107 is explained.

In FIG. 35, a case in which the gray scale voltage Φ1 is set to the input signal for positive polarity Φ1A is indicated in a period from t0 to t2. First of all, the voltage V1 is outputted as the pixel control signal Φ3 at t0. Then, when the scanning signal Φ2 is selected and the signal becomes the low level at a point of time t1, the p-type transistor 30 shown in FIG. 31 assumes the ON state so that the input signal for positive polarity 41A supplied to the video signal line 103 is written in the pixel electrode 109. The signal written in the pixel electrode 109 is indicated by Φ4 in FIG. 35. Further, in FIG. 35, the voltage which is written in the pixel electrode 109 at a point of time t2 is indicated by V2A. Then, the scanning signal Φ2 assumes the non-selective state and assumes the high level, the transistor 30 assumes the off state so that the pixel electrode 109 assumes a state in which the pixel electrode 109 is separated from the video signal lines 103 which supply voltages. The liquid crystal device displays the gray scales in accordance with the voltage V2A written in the pixel electrode 109.

Subsequently, a case in which the gray scale voltage Φ1 takes the input signal for negative polarity Φ1B during a period from t2 to t4 is explained. When the gray scale voltage Φ1 takes the input signal for negative polarity Φ1B, the scanning signal Φ2 is selected at a point of time t2 and the voltage V2B having the potential Φ4 is written in the pixel electrode 109. Thereafter, the transistor 30 assumes the OFF state and at a point of time t3 which comes after lapse of 2h (2 horizontal scanning time) from the point of time t2, the voltage supplied to the pixel capacitance 115 is dropped from the V1 to V3 as indicated by the pixel potential control signal Φ3. When the pixel potential control signal Φ3 is changed from V1 to V3, the pixel capacitance 115 plays a role of coupled capacitance so that the potential of the pixel electrodes can be lowered in accordance with the amplitude of the pixel potential control signal Φ3. Accordingly, it is possible to generate the voltage V2C of negative polarity with respect to the reference potential Vcom in the inside of the pixels.

By generating the signals of negative polarity using the above-mentioned method, it is possible to form the peripheral circuits using elements of low dielectric strength. That is, since the signals outputted from the video signal selection circuit 123 are signals of small amplitude at the positive polarity side, it is possible to form the video signal selection circuit 123 using a circuit of low dielectric strength. Further, it is unnecessary to provide an operational amplifier at the negative polarity side. Still further, when the video signal selection circuit 123 can be driven at the low voltage, since the horizontal shift register 120, the display control device 111 and the like which constitute other peripheral circuits can be formed of circuits of low dielectric strength, it is possible to make the whole liquid crystal display device constituted of circuits of low dielectric strength.

Figure 36:
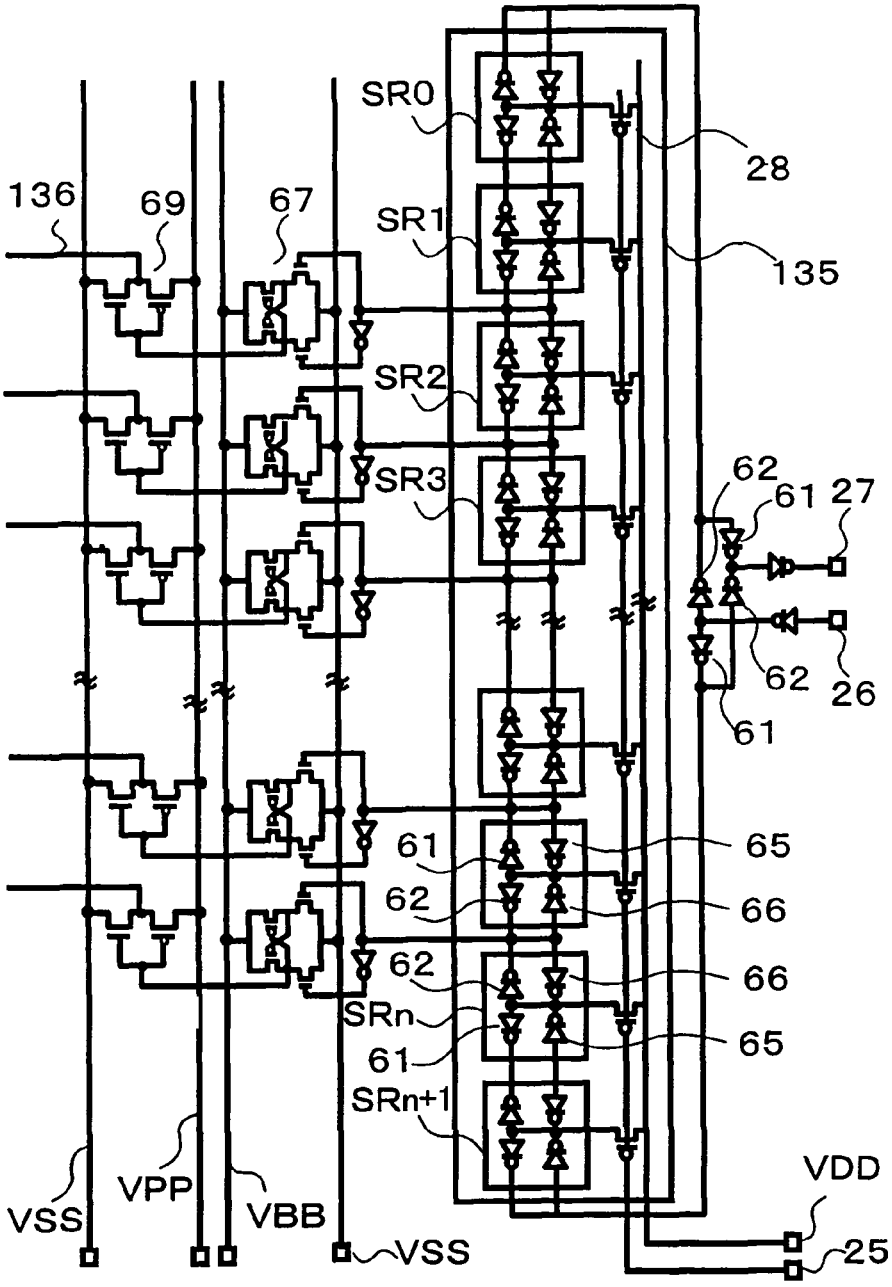
FIG. 36 is a schematic circuit diagram showing the constitution of a pixel potential control circuit of the liquid crystal display device according to the embodiment of the present invention.
Figure 37A:
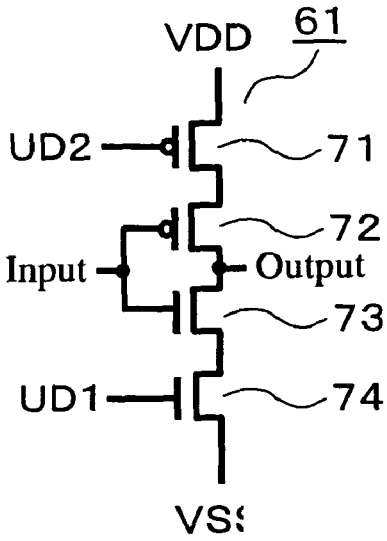
FIG. 37 is a schematic circuit diagram showing the constitution of a clocked inverter of the liquid crystal display device according to the embodiment of the present invention.
Figure 37B:
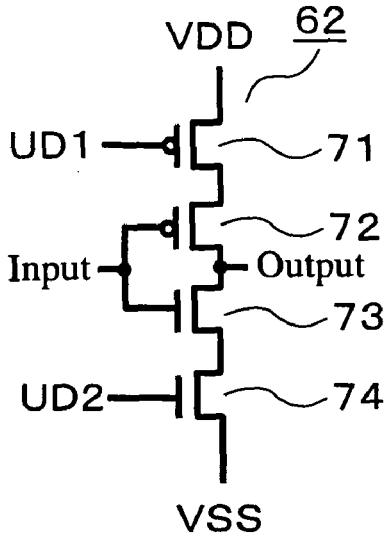
Figure 37C:
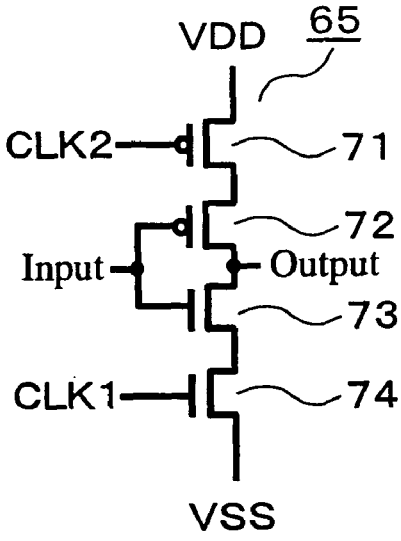
Figure 37D:
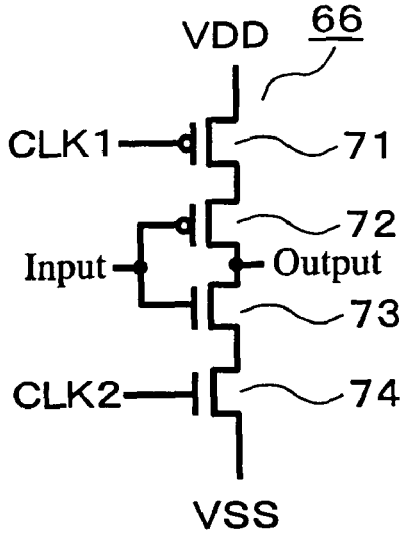

Subsequently, the circuit constitution of the pixel potential control circuit 135 is described in conjunction with FIG. 36. SR indicates a double-way shift register and is capable of shifting signals in both directions, that is, upper and lower directions. The double-way shift register SR is constituted of clocked inverters 61, 62, 65 and 66. Numeral 67 indicates a level shifter and numeral 69 indicates an output circuit. The double-way shift register SR and the like are operated using the power source voltage VDD. The level shifter 67 converts the voltage level of signals outputted from the double-way shift register SR. Signals having an amplitude between the power source voltage VBB and a power source voltage VSS (a GND potential) which has higher potential than the power source voltage VDD are outputted from the level shifter 67. Power source voltages VPP and VSS are supplied to the output circuit 69 and the output circuit 69 outputs the voltages VPP and VSS to the pixel potential control lines 136 in response to signals transmitted from the level shifter 67. The voltage V1 of the pixel potential control signal Φ3 explained in FIG. 35 becomes the power source voltage VPP and the voltage V3 of the same pixel potential control signal Φ3 becomes the power source voltage VSS. Here, in FIG. 36, the output circuit 69 is constituted of an inverter which consists of a p-type transistor and a n-type transistor. By selecting values of the power source voltage VPP supplied to the p-type transistor and the power source voltage VSS supplied to the n-type transistor, it is possible to output the voltages VPP and the voltage VSS as the pixel potential control signals Φ3.

However, since the substrate voltages are supplied to the silicon substrate on which p-type transistors are formed as described later, the value of the power source voltage VPP is set to a suitable value with respect to the substrate voltage.

Numeral 26 indicates a start signal input terminal which supplies a start signal constituting one of control signals to the pixel potential control circuit 135. The double-way shift registers SR1 to SRn shown in FIG. 36 sequentially output timing signals in accordance with timings of clock signals supplied from the outside when the start signal is inputted. The level shifter 67 outputs the voltage VSS and the voltage VBB in accordance with the timing signals. The output circuit 69 outputs the voltage VPP and the voltage VSS to the pixel potential control lines 136 in accordance with the output of level shifter 67. By supplying the start signal and the clock signal to the double-way shifter register SR in conformity with the timing indicated by the pixel potential control signal Φ3 in FIG. 35, it is possible to output the pixel potential control signal Φ3 from the pixel potential control circuit 135 at the desired timing. Here, numeral 25 indicates a reset signal input terminal.

Subsequently, the clocked inverters 61, 62 used in the double-way shift register SR are explained in conjunction with FIG. 37(*a*) (b). UD1 indicates a first direction setting line and UD2 indicates a second direction setting line.

The first direction setting line UD1 assumes a H level when the scanning is performed from below to above in FIG. 36. And the second direction setting line UD2 assumes a H level when the scanning is performed from above to below in FIG. 36. Although the connections are omitted from FIG. 36 to facilitate the understanding of the drawing, the first direction setting line UD1 and the second direction setting line UD2 are connected to the clocked inverters 61, 62 which constitute the double-way shift register SR.

As shown in FIG. 37(*a*), the clocked inverter 61 is constituted of p-type transistors 71, 72 and n-type transistors 73, 74. The p-type transistor 71 is connected to the second direction setting line UD2 and the n-type transistor 74 is connected the first direction setting line UD1. Accordingly, when the first direction setting line UD1 assumes the H level and the second direction setting line UD2 assumes the L level, the clocked inverter 61 functions as an inverter and when the second direction setting line UD2 assumes the H level and the first direction setting line UD1 assumes the L level, an output terminal of the clocked inverter 61 has high impedance.

To the contrary, as shown in FIG. 37(*b*), with respect to the clocked inverter 62, the p-type transistor 71 is connected to the first direction setting line UD1 and the n-type transistor 74 is connected to the second direction setting line UD2. Accordingly, the clocked inverter 62 functions as an inverter when the second direction setting line UD2 assumes the H level and an output terminal of the clocked inverter 62 has high impedance when the first direction setting line UD1 assumes the H level.

Then, the clocked inverter 65 adopts the circuit constitution shown in FIG. 37(*c*). When a clock signal line CLK1 assumes a H level and a clock signal line CLK2 assumes a L level, the clocked inverter 65 outputs the input inversely, while when the clock signal line CLK1 assumes the L level and the clock signal line CLK2 assumes the H level, an output terminal of the clocked inverter 65 has high impedance.

Then, the clocked inverter 66 adopts the circuit constitution shown in FIG. 37(*d*). When a clock signal line CLK2 assumes a H level and a clock signal line CLK1 assumes a L level, the clocked inverter 66 outputs the input inversely, while when the clock signal line CLK2 assumes the L level and the clock signal line CLK1 assumes the H level, the clocked inverter 66 has high impedance. Although the connections of clock signal lines are omitted from FIG. 36, an output terminal of the clock signal lines CLK1 and CLK2 are connected to the clocked inverters 65, 66 shown in FIG. 37.

As has been explained above, by constituting the double-way shift register SR using the clocked inverters 61, 62, 65 and 66, it is possible to output the timing signals sequentially. Further, by constituting the pixel potential control circuit 135 using the double-way shift register SR, it is possible to scan the pixel potential control signals Φ3 in two ways. That is, the vertical driving circuit 130 is also constituted of the similar double-way shift register so that the liquid crystal display device according to the present invention is capable of performing the double-way scanning in up and down directions. Accordingly, when the displaying image is to be reversed upside down or the like, the scanning is performed from below to above in the drawing by inverting the scanning direction. Accordingly, when the vertical driving circuit 130 performs the scanning from below to above, the pixel potential control circuit 135 also copes with the scanning from below to above by changing the setting of the first direction setting line UD1 and the second direction setting line UD2. Here, the horizontal shift register 121 is also constituted of the similar double-way shift register.

Figure 38:
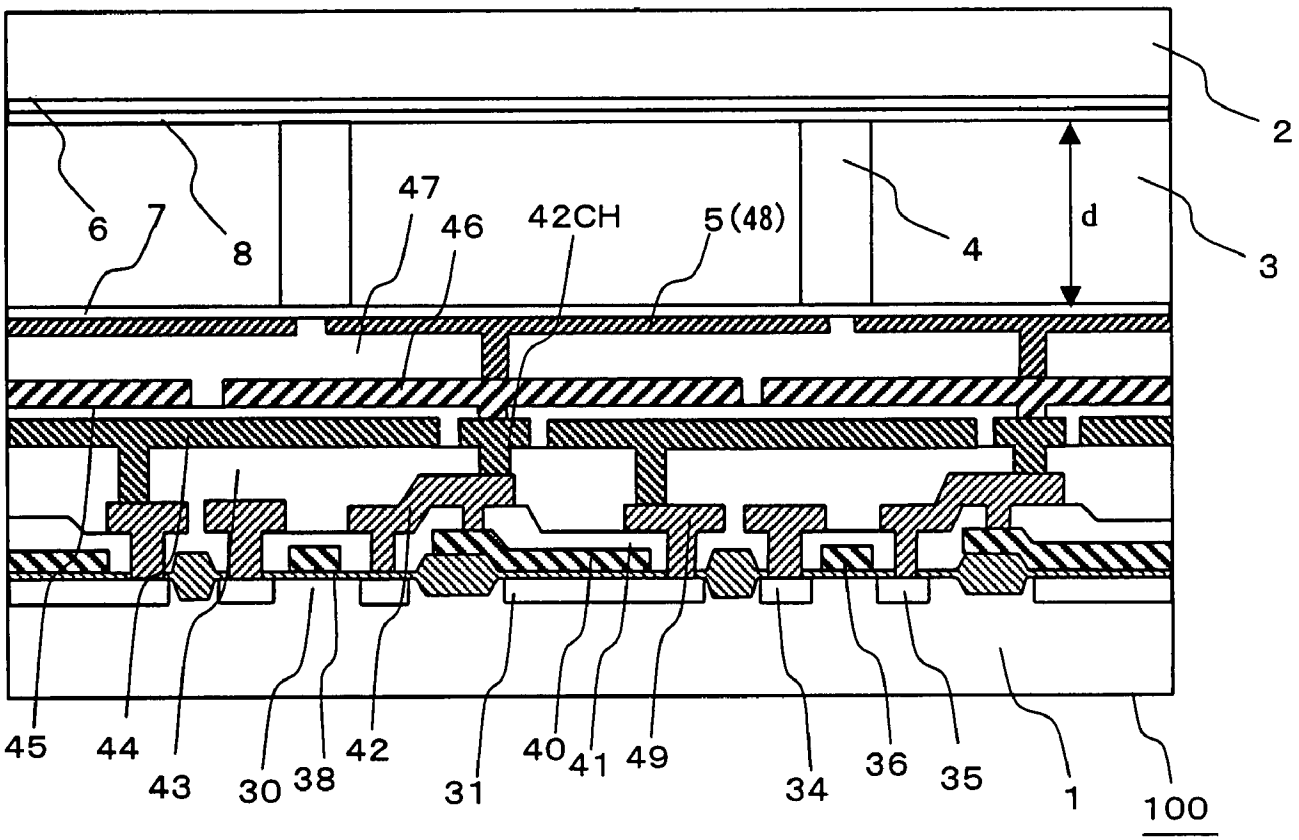
FIG. 38 is a schematic cross-sectional view showing the pixel portion of the liquid crystal display device according to the embodiment of the present invention.

Then, the pixel portion of the reflection type liquid crystal display device LCOS according to the present invention is explained in conjunction with FIG. 38. FIG. 38 is a schematic cross-sectional view of the reflection type liquid crystal display device of one embodiment of the present invention. In FIG. 38, numeral 100 indicates a liquid crystal panel, numeral 1 indicates a driving circuit substrate which constitutes a first substrate, numeral 2 indicates a transparent substrate which constitutes a second substrate, numeral 3 indicates liquid crystal composition and numeral 4 indicates spacers. Spacers 4 are provided for forming a cell gap d which is a fixed distance between the driving circuit substrate 1 and the transparent substrate 2. The liquid crystal composition 3 is inserted in this cell gap d. Numeral 5 indicates reflection electrodes (pixel electrodes) which are formed on the driving circuit substrate 1. Numeral 6 indicates counter electrode and a voltage is applied to the liquid crystal composition 3 between the counter electrodes 6 and the reflection electrodes 5. Numerals 7, 8 indicate orientation films which are provided for orienting liquid crystal molecules in fixed directions. Numeral 30 indicates active elements which supply gray scale voltages to the reflection electrodes 5.

Numeral 34 indicates a source region of the active element 30, numeral 35 indicates a drain region of the active element 30 and numeral 36 indicates a gate electrode of the active element 30. Numeral 38 indicates an insulation film, numeral 31 indicates a first electrode which forms pixel capacitance and numeral 40 indicates a second electrode which forms pixel capacitance. The first electrode 31 and the second electrode 40 form the capacitance by way of the insulation film 38. In FIG. 38, although the first electrode 31 and the second electrode 40 are shown as typical electrodes which form the pixel capacitance, it may be possible to form pixel capacitance when a conductive layer which is electrically connected to the pixel electrode and a conductive layer which is electrically connected to the pixel potential control signal line are arranged to face each other in an opposed manner while sandwiching a dielectric layer therebetween.

Numeral 41 indicates a first interlayer film and numeral 42 indicates a first conductive film. The first conductive film 42 is provided for electrically connecting the drain region 35 with the second electrode 40. Numeral 43 indicates a second interlayer film, numeral 44 indicates a first light shielding film, numeral 45 indicates a third insulation film and numeral 46 indicates a second light shielding film. Through holes 42CH are formed in the second interlayer film 43 and the third interlayer film 45 so that the first conductive film 42 and the second light shielding film 46 are electrically connected. Numeral 47 indicates a fourth interlayer film and numeral 48 indicates a second conductive film forming the reflection electrode 5. The gray scale voltages are supplied to the reflection electrode 5 from the drain region 35 of the active element 30 through the first conductive film 42, the through holes 42CH and the second light shielding film 46.

The liquid crystal display device of this embodiment is the reflection type liquid crystal display device so that a large quantity of light is irradiated to the liquid crystal panel 100. The light shielding films shield light such that the light is prevented from being incident on semiconductor layers of the driving circuit substrate. In the reflection type liquid crystal display device, light irradiated to the liquid crystal panel 100 is incident from the transparent substrate 2 side (upper side in FIG. 38), and passes through the liquid crystal composition 3, is reflected on the reflection electrodes 5, and again passes through the liquid crystal composition 3 and the transparent substrate 2, and is emitted from the liquid crystal panel 100. However, a portion of the light irradiated to the liquid crystal panel 100 leaks into the driving circuit substrate side through a gap of the reflection electrodes 5. The first light shielding film 44 and the second light shielding film 46 are provided for preventing the light from being incident on the active elements 30. In this embodiment, these light shielding films 44, 46 are formed of conductive layers, the second light shielding film 46 is electrically connected to the reflection electrodes 5 and the pixel potential control signals are supplied to the first light shielding film 44 so that the light shielding films 44, 46 also functions as portions of pixel capacitance.

Here, when the pixel potential control signals are supplied to the first light shielding film 44, it is possible to form the first light shielding film 44 as an electric shielding layer between the second light shielding film 46 to which the gray scale voltages are supplied and the first conductive layer 42 which forms video signal lines 103 thereon or a conductive layer (a layer formed on the layer on which gate electrodes 36 are formed) on which scanning signal lines 102 are formed. Accordingly, the parasitic capacitance components generated between the first conductive layer 42 or the gate electrode 36 and the second light shielding film 46 or the reflection electrodes 5 can be reduced. Although it is necessary to sufficiently increase the pixel capacitance CC with respect to the liquid crystal capacitance CL as mentioned previously, by providing the first light shielding film 44 as the electric shielding layer, the parasitic capacitance which is connected in parallel with the liquid crystal capacitance LC is also reduced so that the provision of the first light shielding film 44 as the electric shielding layer is effective. Further, this provision also can reduce jumping of noises from the signal lines.

Further, when the liquid crystal display elements is formed of the reflection type and the reflection electrodes 5 are formed on the liquid-crystal-composition-3-side surface of the driving circuit substrate 1, it is possible to use an opaque silicon substrate or the like as the driving circuit substrate 1. Further, it is possible to dispose the active elements 30 and the wiring below the reflection electrodes 5 and hence, it is possible to obtain an advantageous effect that the area of the reflection electrodes 5 which constitute the pixels can be increased thus realizing a so-called high numerical aperture. Further, it is also possible to obtain an advantageous effect that the heat derived from the irradiation of light to the liquid crystal panel 100 can be radiated from a back surface of the driving circuit substrate 1.

Figure 39:
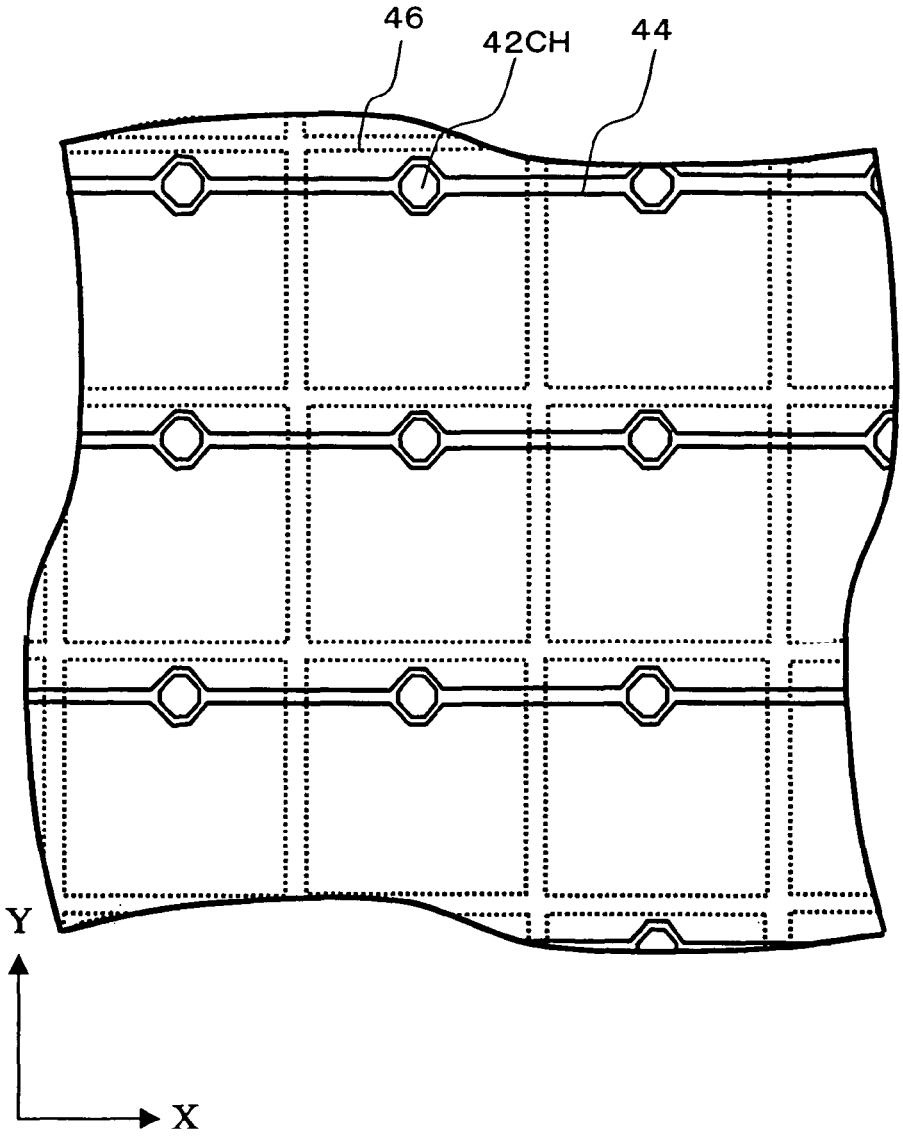
FIG. 39 is a schematic plan view showing the constitution which forms a pixel potential control line using a light shielding film of the liquid crystal display device according to the embodiment of the present invention.

Subsequently, the utilization of the light shielding films as portions of pixel capacitance is explained. The first light shielding film 44 and the second light shielding film 46 face each other in an opposed manner by way of the third interlayer film 45 thus forming portions of the pixel capacitance. Numeral 49 indicates a conductive layer which forms a portion of the pixel potential control lines 136. The first electrode 31 and the first light shielding film 44 are electrically connected through the conductive layer 49. Further, it is possible to form wiring extending from the pixel potential control circuit 135 to the pixel capacitance using the conductive layer 49. Here, the first light shielding film 44 is utilized as the wiring in this embodiment. FIG. 39 shows the constitution in which the first light shielding film 44 is used as the pixel potential control lines 136.

FIG. 39 is a plan view showing the arrangement of the first light shielding film 44. Although numeral 46 indicates a second light shielding film, the film 46 is indicated by a dotted line to show the position thereof. Numeral 42CH indicates through holes which are provided for connecting the first conductive film 42 and the second conductive film 46. Here, to facilitate the understanding of the first light shielding film 44, other constitutions are omitted from FIG. 39. The first light shielding film 44 has the function of the pixel potential control lines 136 and is continuously formed in the X direction in the drawing. Although the first light shielding film 44 is formed such that the first light shielding film 44 covers the whole surface of the display region to perform the function as the light shielding film, to allow the light shielding film 44 to have the function of the pixel potential control lines 136, the first light shielding film 44 is formed as lines which are extended in the X direction (the direction parallel to the scanning signal lines 102) and are arranged in parallel in the Y direction and are connected to the pixel potential control circuit 135. Further, since the first light shielding film 44 also functions as the electrodes of the pixel capacitance, the first light shielding film 44 is formed such that the first light shielding film 44 is superposed on the second light shielding film 46 with a wider area as much as possible. Further, to decrease light leaked from the light shielding film, a distance defined between the first light shielding film 44 and the neighboring first light shielding film 44 is set as narrow as possible.

However, when the distance between the first light shielding film 44 and the neighboring first light shielding film 44 is narrow as shown in FIG. 39, a portion of the light shielding film 44 is superposed on the neighboring second light shielding film 46. As mentioned previously, the liquid crystal display device of the present invention is capable of scanning in two ways. Accordingly, when the pixel potential control signals are scanned in two ways, there arises a case in which the portion of the light shielding film 44 is superposed on the second light shielding film 46 of a succeeding stage and a case in which the potion of the light shielding film 44 is not superposed on the second light shielding film 46 of the succeeding stage. In the case shown in FIG. 39, when the pixel potential control signals are scanned from above to below in the drawing, the first light shielding film 44 and the second light shielding film 46 of the succeeding stage are superposed.

Figure 40A:
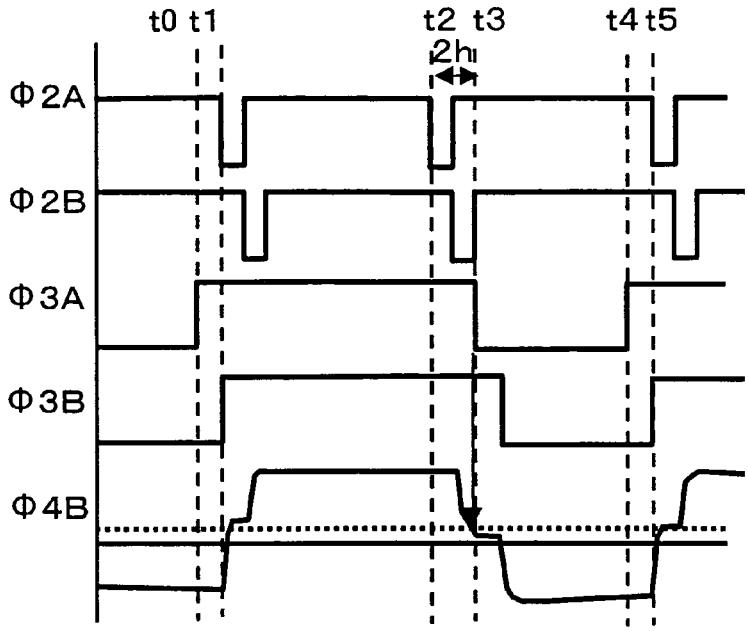
FIG. 40 is a timing chart showing a driving method of the liquid crystal display device according to the embodiment of the present invention.
Figure 40B:
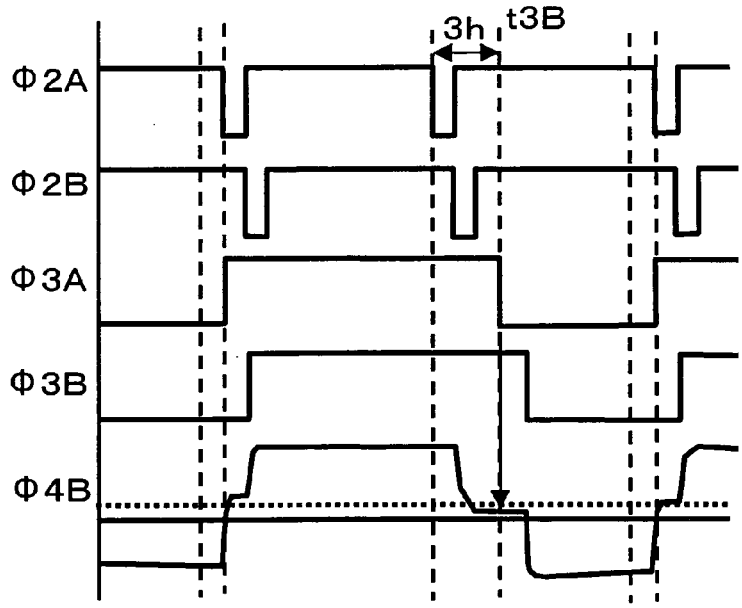

Problems which are generated by the phenomenon that the portions of the light shielding film 44 are superposed on the second light shielding film 46 of the succeeding stage and a method which can solve such problems are explained in conjunction with FIG. 40. FIG. 40(*a*) is a timing chart for explaining the problems. Φ2A indicates a scanning signal of an arbitrary line and is set as the scanning line of line A. Φ2B indicates a scanning signal of a line of succeeding stage and is set as the scanning signal of line B. Here, the period ranging from t2 to t3 in which problems arise is explained and the explanation of other periods is omitted.

In FIG. 40(*a*), in a line A, the pixel potential control signal Φ3A is changed at a point of time t3 which comes after lapse of 2h (2 horizontal scanning time) from a point of time t2. After lapse of 1h from the point of time t2, the outputting of the scanning signal Φ2A is finished so that the active element 30 of the line A which is driven in response to the scanning signal Φ2A assumes the OFF state and the pixel electrode 109 of the line A is separated from the video signal lines 103. At the point of time t3 after lapse of 2h from the point of time t2, even when the delay which is generated by the changeover of signals is taken into consideration, the active element 30 of the line A is sufficiently held in the OFF state. However, the point of time t3 is time that the scanning signal Φ2B of the line B is changed over.

Since the first light shielding film 44 of the line A and the second light shielding film 46 of the line B are superposed each other, the capacitance is generated between the pixel electrodes of the line B and the pixel potential control signal line of the line A. Since the point of time t3 is time at which the active element 30 of the line B is changed over to the OFF state, the pixel electrodes 109 of the B line are not sufficiently separated from the video signal lines 103. When the pixel potential control signal Φ3A of the line A which has the capacitance component between this pixel potential control signal Φ3A and the pixel electrode 109 of the line B is changed over, since the pixel electrode 109 and the video signal line 103 are not sufficiently separated from each other, the charge is moved between the video signal lines 103 and the pixel electrodes 109. That is, the changeover of the pixel potential control signal Φ3A of the line A influences the voltage Φ4B which is written in the pixel electrode 109 of the line B.

The influence derived from the pixel potential control signal Φ3A constitutes the uniform influence and hence is not so outstanding when the scanning direction of the liquid crystal display device is fixed. However, when the liquid crystal display devices are provided for respective colors consisting of red, green, blue and the like and the color display is performed by superposing outputs of respective liquid crystal display devices, due to a reason derived from an optical arrangement of the liquid crystal display devices, there may be a case that the signals are scanned from below to above with respect to only one liquid crystal display device, for example, and the signals of other liquid crystal display device may be scanned from above to below. In this manner, with respect to a liquid crystal display device which differs in scanning direction from other liquid crystal display devices among a plurality of liquid crystal display devices, the display quality becomes uneven so that the appearance is damaged.

Subsequently, the method for solving the problem is explained in conjunction with FIG. 40(*b*). The pixel potential control signal Φ3A of the line A is outputted with delay of 3h from starting of scanning signals Φ2A of the line A. In this case, the pixel potential control signal Φ3A is outputted also after the scanning signal Φ2B of the line B is also changed over and hence, the active element 30 of the line B is sufficiently held in the OFF state so that the influence which the pixel potential control signal Φ3A of the line A gives to the voltage Φ4B written in the pixel electrode 109 of the line B can be decreased.

In this case, although the period in which the input signal for negative polarity is written becomes shorter than the period in which the input signal for positive polarity is written by 3h, when the number of the scanning signal lines 102 exceeds 100, the difference between both periods becomes a value of equal to or less than 3%. Accordingly, the difference of effective value of the input signal for negative polarity and the input signal for positive polarity can be adjusted based on the value of the reference potential Vcom and the like.

Figure 41A:
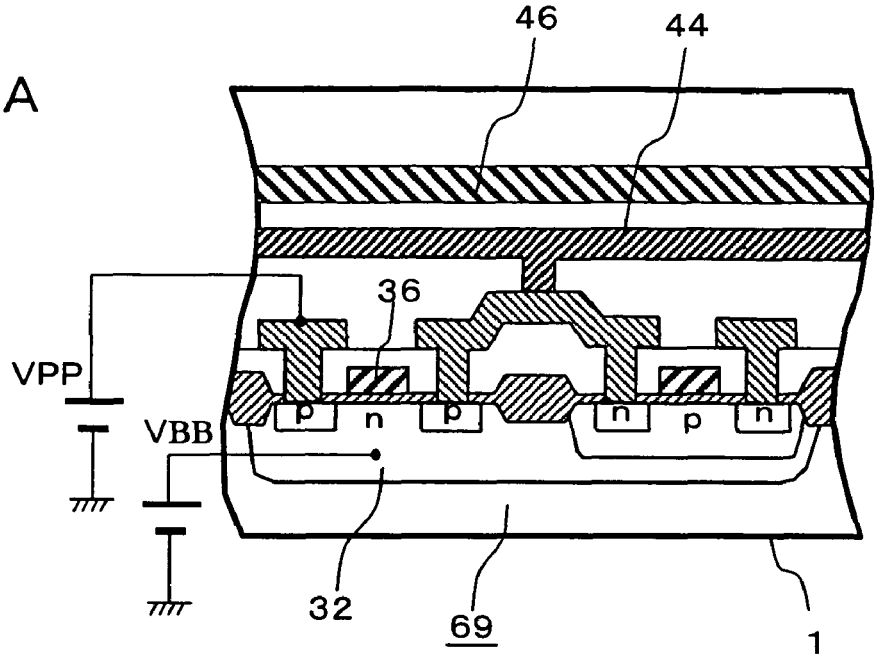
FIG. 41 is a schematic view for showing an operation of the liquid crystal display device according to the embodiment of the present invention.
Figure 41B:
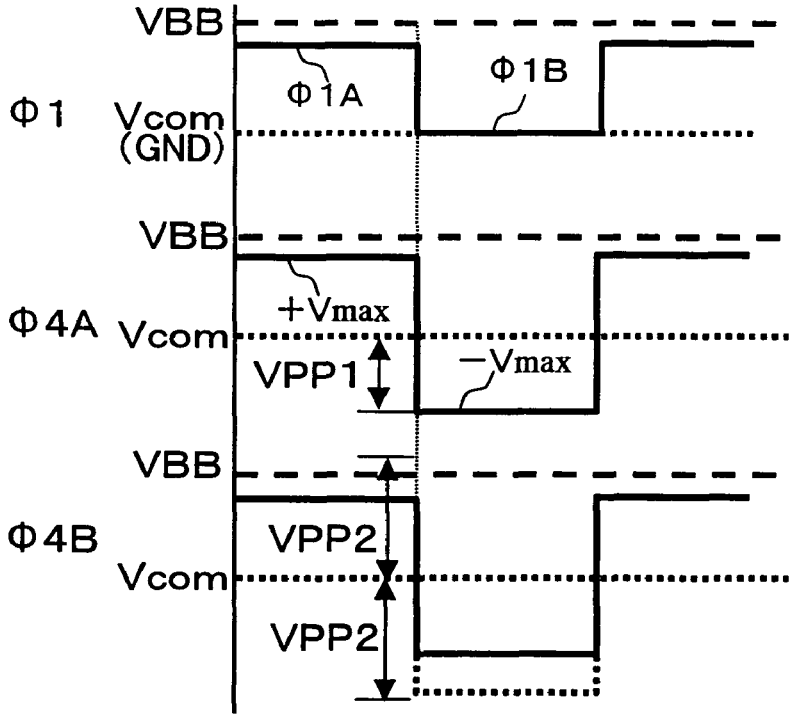

Subsequently, the relationship between the voltage VPP which is supplied to the pixel capacitance and the substrate potential VBB is explained in conjunction with FIG. 41. FIG. 41(*a*) shows an inverter circuit which constitutes the output circuit 69 of the pixel potential control circuit 135.

In FIG. 41(*a*), numeral 32 indicates a channel region of the p-type transistor, wherein an n-type well is formed in the silicon substrate 1 by a method such as ion implantation. The substrate voltage VBB is supplied to the silicon substrate 1 so that the potential of the n-type well 32 is set to VBB. The source region 34 and the drain region 35 are formed of p-type semiconductor layers and are formed on the silicon substrate 1 by a method such as ion implantation. When a voltage having the potential lower than that of the substrate voltage VBB is applied to the gate electrode 36 of the p-type transistor 30, the source region 34 and the drain region 35 are brought into the conductive state.

With respect to the transistors formed on the same silicon substrate, in view of the fact that it is unnecessary to form insulation portions and therefore the structure can be simplified in general, the common substrate potential VBB is applied to the transistors. In the liquid crystal display device of the present invention, the transistors of the driving circuit part and the transistors of the pixel part are formed on the same silicon substrate 1. Due to the same reason, the substrate potential VBB of the same potential is applied to the transistors of the pixel part.

In the inverter circuit shown in FIG. 41(*a*), the voltage VPP which is supplied to the pixel capacitance is applied to the source region 34. The source regions 34 is formed of the p-type semiconductor layer and the pn bonding is provided between the source region 34 and the n-type well 32. When the potential of the source region 34 becomes higher than the potential of the n-type well 32, there arises a problem that current flows from the source regions 34 to the n-type well 32. Accordingly, the voltage VPP is set to a value which is lower than the substrate voltage VBB.

With respect to the voltage of the pixel electrode, as mentioned previously, the voltage of the pixel electrode after the pressure drop is expressed by $V2-\{CC/(CL+CC)\}\times(VPP-VSS)$, wherein V2 indicates the voltage written in the pixel electrode, CL indicates the liquid crystal capacitance, CC indicates the pixel capacitance and VPP and VSS indicate the amplitudes of the pixel potential control signals. Here, when the GND potential is selected as the amplitude VSS, the magnitude of the fluctuation of the voltage of the pixel electrode is determined based on the voltage VPP, the liquid crystal capacitance CL and the pixel capacitance CC.

The relationship between CC/(CL+CC) and the voltage VPP is explained in conjunction with FIG. 41(*b*). Here, for easing the explanation, the reference voltage Vcom is used as GND potential. Further, a case in which a method which adopts the white display (normally white) when the voltage is not applied and the gray scale voltages are applied to the pixel electrode such that the black display (minimum gray scale) is obtained is explained. Φ1 shown in FIG. 41(*b*) indicates the gray scale voltage written in the pixel electrodes from the video signal selection circuit 123. Here, Φ1A indicates the gray scale voltage of positive polarity and Φ2A indicates the gray scale voltage of negative polarity. Since the black display is adopted, the gray scale voltages Φ1A, Φ1B are set such that the potential difference between the reference voltage Vcom and the gray scale voltages written in the pixel electrodes becomes maximum. Since the gray scale voltage Φ1A is a signal of positive polarity in FIG. 41(*b*), the gray scale voltage Φ1A is set to +Vmax such that the potential difference between the reference voltage Vcom and the gray scale voltage Φ1A becomes maximum in the same manner as the related art, and the gray scale voltage Φ1B is set to Vcom (GND), and these gray scale voltages are reduced using the pixel capacitance after writing them in the pixel electrodes.

Both of Φ4A and Φ4B indicate voltages of the pixel electrodes, wherein the voltage Φ4A indicates a voltage of an ideal case in which CC/(CL+CC) is 1 and the voltage Φ4B is a voltage of a case in which CC/(CL+CC) below 1. When the voltage Φ4A is a voltage of negative polarity, Vcom (GND) is written as the gray scale voltage Φ1B and hence, −Vmax which is reduced in accordance with the amplitude VPP of the pixel potential control signals becomes −Vmax=−VPP since CC/(CL+CC)=1.

To the contrary, since CC/(CL+CC) is below 1 with respect to the voltage Φ4B, it is necessary to supply the pixel potential control signals such that +Vmax<VPP 2 is established. As mentioned previously, it is necessary to establish the relationship VPP<VBB, the relationship +Vmax<VPP<VBB is established. Here, although a method which lowers the pixel voltage is adopted to form the circuit of low dielectric strength, when the voltage VPP of the pixel potential control signals become the high voltage, the substrate voltage VBB becomes the high voltage and hence, there arises a problem that the circuit eventually becomes a circuit of high dielectric strength. Accordingly, it is necessary to determine the values of CL and CC such that CC/(CL+CC) becomes 1 as much as possible, that is, CL<<CC.

In a conventional liquid crystal display device which forms thin film transistors on a glass substrate, it is necessary to broaden the area of the pixel electrodes as much as possible (so-called enhancement of numerical aperture) and hence, the relationship between CL and CC can be realized substantially at a level of CL=CC at maximum. Further, since the driving circuit part and the pixel part are formed on the same silicon substrate in the liquid crystal display device of the present invention, the liquid crystal display device has a problem that it is impossible to make the circuit have low dielectric strength when the substrate potential VBB is set to a high voltage.

Subsequently, the gray scale voltages for negative polarity are explained in conjunction with FIG. 42 and a method for generating the gray scale voltages for negative polarity using the look up table is explained in conjunction with FIG. 43. Here, in FIG. 42, for also easing the explanation, the reference voltage Vcom is set to the GND potential. Further, a case in which the liquid crystal display device becomes the white display (normally white) when the voltages are not applied is explained.

Figures 42A, 42B:
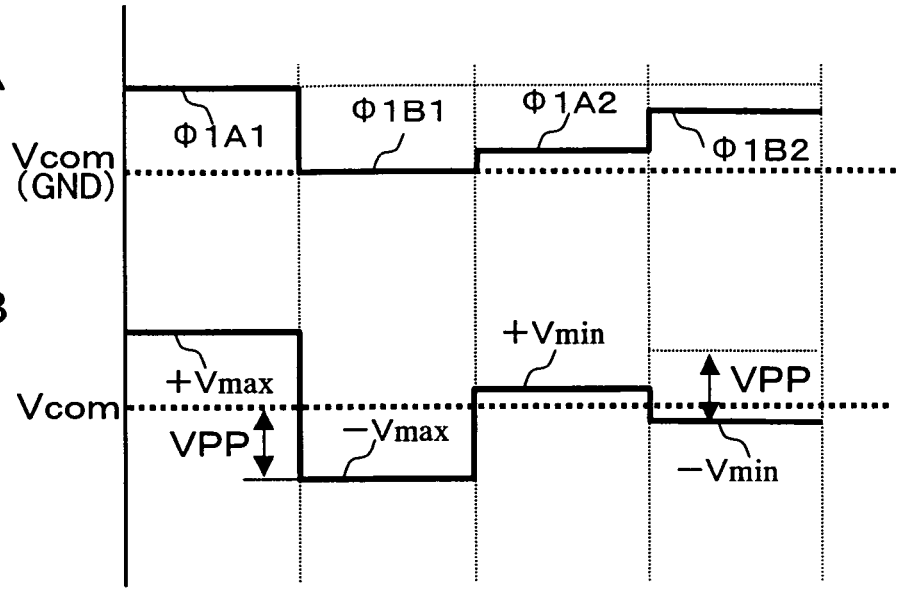
FIG. 42 is a waveform chart for explaining waveforms of positive polarity and negative polarity of the liquid crystal display device according to the embodiment of the present invention.
Figure 43:
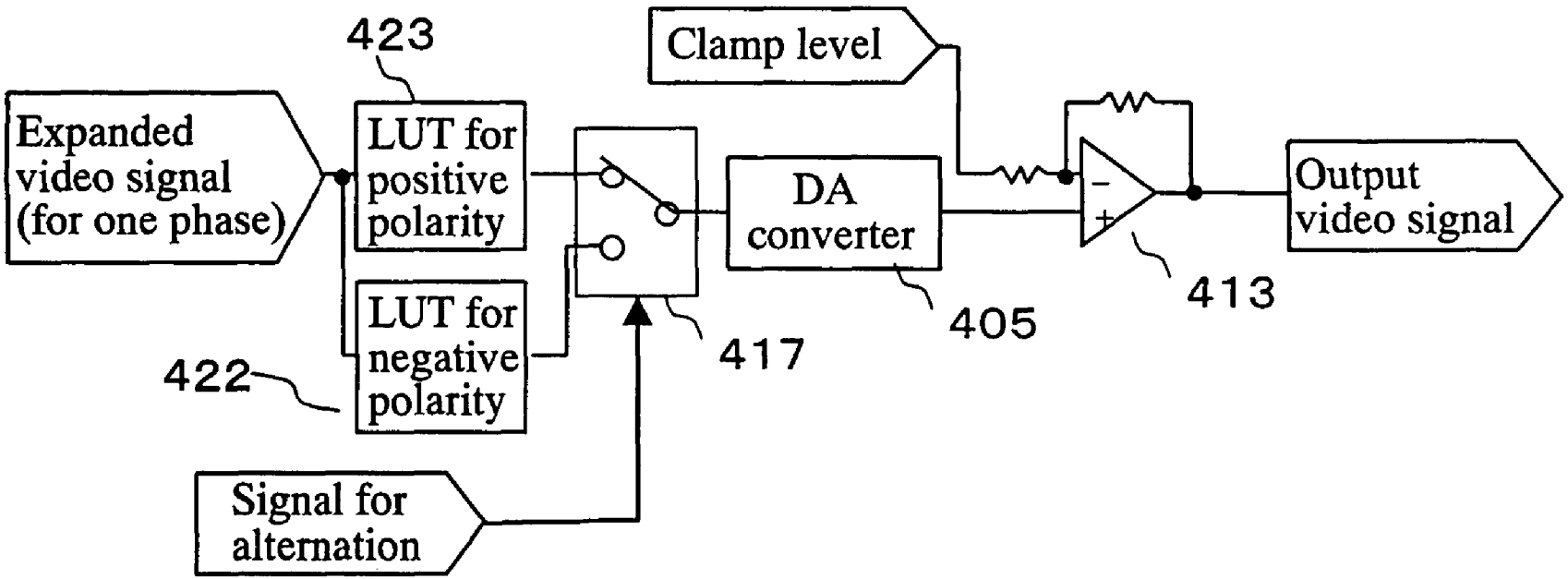
FIG. 43 is a schematic circuit diagram which generates signals of positive polarity and negative polarity using the look up table of the liquid crystal display device according to the embodiment of the present invention.

Φ1 in FIG. 42(*a*) indicates the gray scale voltage written in the pixel electrodes from the video signal selection circuit 123 and Φ4 in FIG. 42(*b*) indicates the voltage of the pixel electrodes. First of all, a case in which the gray scale voltage is applied to the pixel electrode such that the black display (minimum gray scale) is obtained is explained. Φ1A1 indicates the gray scale voltage for positive polarity and Φ1B1 indicates the gray scale voltage for negative polarity. Since the black display is performed, both of the gray scale voltages Φ1A1, ΦB1 are set such that the potential difference between the reference voltage Vcom and the voltage written in the pixel electrodes becomes maximum.

In FIG. 42(*b*), since the gray scale voltage Φ1A1 is a signal of positive polarity, in the same manner as the related art, the voltage of the pixel electrodes becomes +Vmax such that the potential difference between the voltage of the pixel electrodes and the reference voltage Vcom becomes maximum. To the contrary, the gray scale voltage Φ1B1 which is a signal of negative polarity is lowered to −Vmax using the pixel capacitance after being written into the pixel electrodes.

Subsequently, a case in which the gray scale voltage is applied to the pixel electrode such that the white display (maximum gray scale) is obtained is explained. Φ1A2 indicates the gray scale voltage for positive polarity and Φ1B2 indicates the gray scale voltage for negative polarity. Since the white display is performed, both of the gray scale voltages Φ1A2, Φ1B2 are set such that the potential difference between the reference voltage Vcom and the voltage written in the pixel electrodes becomes minimum.

In FIG. 42(*b*), since the gray scale voltage Φ1A2 is a signal of positive polarity, in the same manner as the related art, the voltage of the pixel electrodes becomes +Vmin such that the potential difference between the voltage of the pixel electrodes and the reference voltage Vcom becomes minimum. The gray scale voltage Φ1B2 which is a signal of negative polarity is lowered using the pixel capacitance after being written into the pixel electrodes. Since the voltage to be lowered is VPP, the voltage which becomes −Vmin after the gray scale voltage VPP is lowered is selected as the signal for negative polarity Φ1B2.

As shown in FIG. 42, the signals for negative polarity Φ1B1, Φ1B2 are not voltages which are obtained by simply inverting the signals for positive polarity Φ1A1, Φ1A2 of a method used conventionally. Accordingly, the signals for negative polarity are prepared using the look up tables. FIG. 43 shows a block diagram of the video signal control circuit 400 which prepares the signals for negative polarity using the look up tables. In the drawing, numeral 422 indicates the look up table for negative polarity and numeral 423 indicates the look up table for positive polarity. Since the signals for negative polarity are prepared using the pixel capacitance, operational amplifiers for negative polarity and positive polarity are not used.

The correction data for performing the correction of irregularities is used in the look up table 422 for positive polarity. On the other hand, besides the correction data for performing the correction of irregularities, the correction which lowers the signal to form the signal for negative polarity using the pixel capacitance is also added to the look up table 423 for negative polarity. By changing over the analogue switch 417 in response to the alternation signal, the signal for positive polarity and the signal for negative polarity are transmitted to the DA converter 405.

Subsequently, the manner of operation of the reflection type liquid crystal display device is explained. As one of reflection type liquid crystal display elements, a liquid crystal display element of an electrically controlled birefringence mode has been known. In the electrically controlled birefringence mode, a voltage is applied between reflection electrodes and counter electrodes so as to change the molecular arrangement of liquid crystal composition and eventually the birefringence factor in a liquid crystal panel is changed. The electrically controlled birefringence mode forms images by making use of the change of the birefringence factor as the change of light transmittance.

Figure 44B:
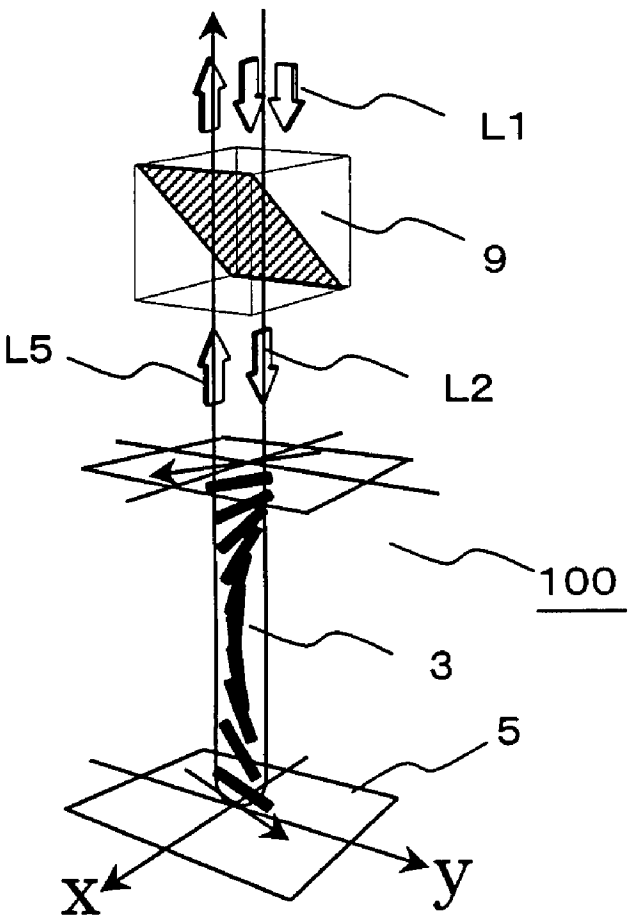
FIG. 44 is a schematic view for explaining another operation of the liquid crystal display device according to the embodiment of the present invention.
Figure 44A:
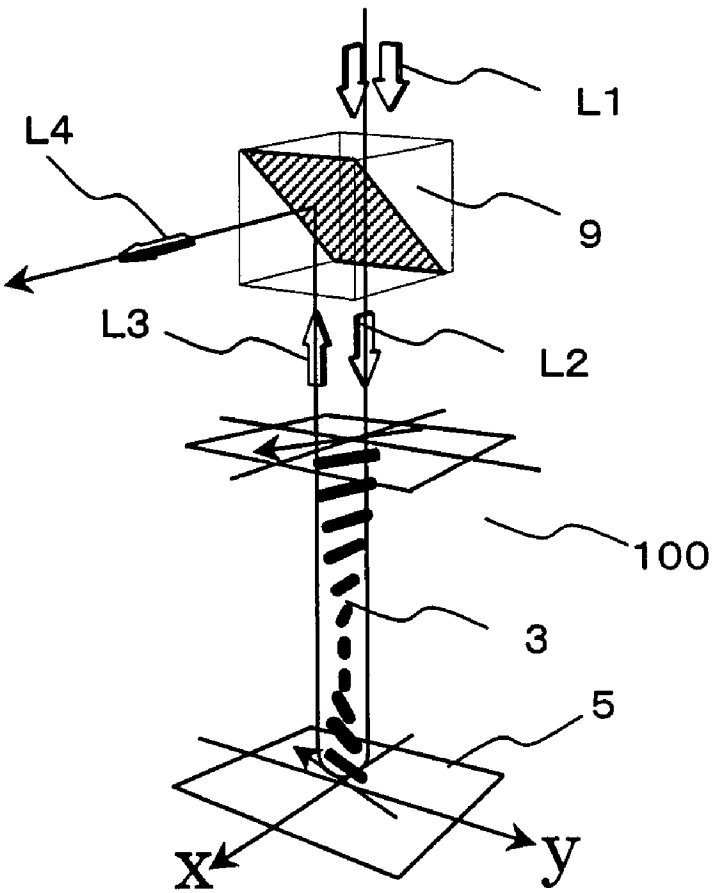

Further, a single polarizer twisted nematic mode (SPTN) which constitutes one type of electrically controlled birefringence mode is explained in conjunction with FIG. 44. Numeral 9 indicates a polarization beam splitter which splits incident light L1 from a light source (not shown in the drawing) into two polarized lights and emits the linear polarized lights L2. In FIG. 44, although a case in which light (P wave) which passes through the polarization beam splitter 9 is used as light incident on the liquid crystal panel 100 is shown, it is possible to use light (S wave) which is reflected on the polarization beam splitter 9. As the liquid crystal composition 3, nematic liquid crystal which has a long axis of liquid crystal molecules arranged parallel to the driving circuit substrate 1 and the transparent substrate 2 and has the positive dielectric anisotropy is used. Further, the liquid crystal molecules 7, 8 are oriented in a twisted form by approximately 90 degrees using the orientation films 7, 8.

A case in which the voltage is not applied to the liquid crystal composition 3 is shown in FIG. 44(*a*). Light incident on the liquid crystal panel 100 is formed into elliptically polarized light by the birefringence of the liquid crystal composition 3 and again is formed into circular polarized light on surfaces of the reflection electrodes 5. The light reflected on the reflection electrodes 5 again passes through the inside of the liquid crystal composition 3 and is again formed into elliptically polarized light and returns to the linear polarized light at the time of emission and is emitted as light L3 (S wave) which has a phase thereof rotated by 90 degrees with respect to the incident light L2. Although the emitted light L3 is again incident on the polarization beam splitter 9, the light is reflected on the polarization surface and is formed into the emitting light L4. This emitting light L4 is irradiated to a screen or the like so as to perform the display. This case is a display method which is a so-called normally white (normally open) in which light is irradiated when the voltage is not applied thereto.

On the other hand, FIG. 44(*b*) shows a case in which the voltage is applied to the liquid crystal composition 3. When the voltage is applied to the liquid crystal composition 3, the liquid crystal molecules are oriented in the electric field direction and hence, the rate that the birefringence is generated in the inside of the liquid crystal is decreased. Accordingly, the light L2 which is incident on the liquid crystal panel 100 with linear polarization is directly reflected on the reflection electrodes 5 as it is and is emitted as the light L5 having the polarization direction equal to that of the incident light L2. The emitting light L5 passes through the polarization beam splitter 9 and returns to the light source. Accordingly, the light is not irradiated to the screen or the like so that the black display is obtained.

In the single polarizer twisted nematic mode, since the orientation direction of the liquid crystal molecules is parallel to the substrates, a general orientation method can be used so that the favorable process stability is obtained. Further, the liquid crystal display can be used in the normally white mode, the liquid crystal display can have the margin with respect to the display failure which is generated at the low voltage side. That is, in the normally white method, the dark level (black display) is obtained in the state that the high-voltage is applied. In this high voltage state, most of liquid crystal molecules are arranged in the electric field direction perpendicular to the surface of the substrates. Accordingly, the display of the dark level does not substantially depend on the initial orientation state at the time of applying the low voltage. Further, human eyes recognize the irregularities of brightness as the relative rate of brightness and exhibit a reaction to the brightness substantially in a logarithmic scale. Accordingly, the human eyes are sensitive to the fluctuation of the dark level. In view of these reasons, the normally white method is a display method advantageous for the irregularities of brightness derived from the initial orientation state.

However, in the above-mentioned electrically controlled birefringence mode, the high accuracy is demanded with respect to the cell gap. That is, the electrically controlled birefringence mode makes use of the phase difference between the irregular light which is generated when the light passes through the liquid crystal layer and the normal light and hence, the intensity of the transmitted light depends on the retardation $\Delta n \cdot d$ between the irregular light and the normal light. Here, $\Delta n$ is refractive index anisotropy and d is the cell gap between the transparent substrate 2 and the driving circuit substrate 1 which is formed by the spacers 4 (see FIG. 38).

Accordingly, in this embodiment, the accuracy of the cell gap is set to equal to or less than ±0.05 μm in view of the display irregularities. Further, in the reflection type liquid crystal display element, the light incident on the liquid crystal is reflected on the reflection electrodes and again passes through the liquid crystal layer. Accordingly, when the liquid crystal of the same refractive index anisotropy $\Delta n$ is used, the cell gap d becomes one half of the cell gap of the transmission type liquid crystal display element. Compared to the cell gap d of approximately 5 to 6 μm of the general transmission type liquid crystal display element, the cell gap is approximately 2 μm in this embodiment.

In this embodiment, to cope with the demand for the high accuracy of the cell gap and the further narrower cell gap, this embodiment adopts a method which forms columnar spacers on the driving circuit substrate 1 in place of the conventional bead scattering method.

Figure 45:
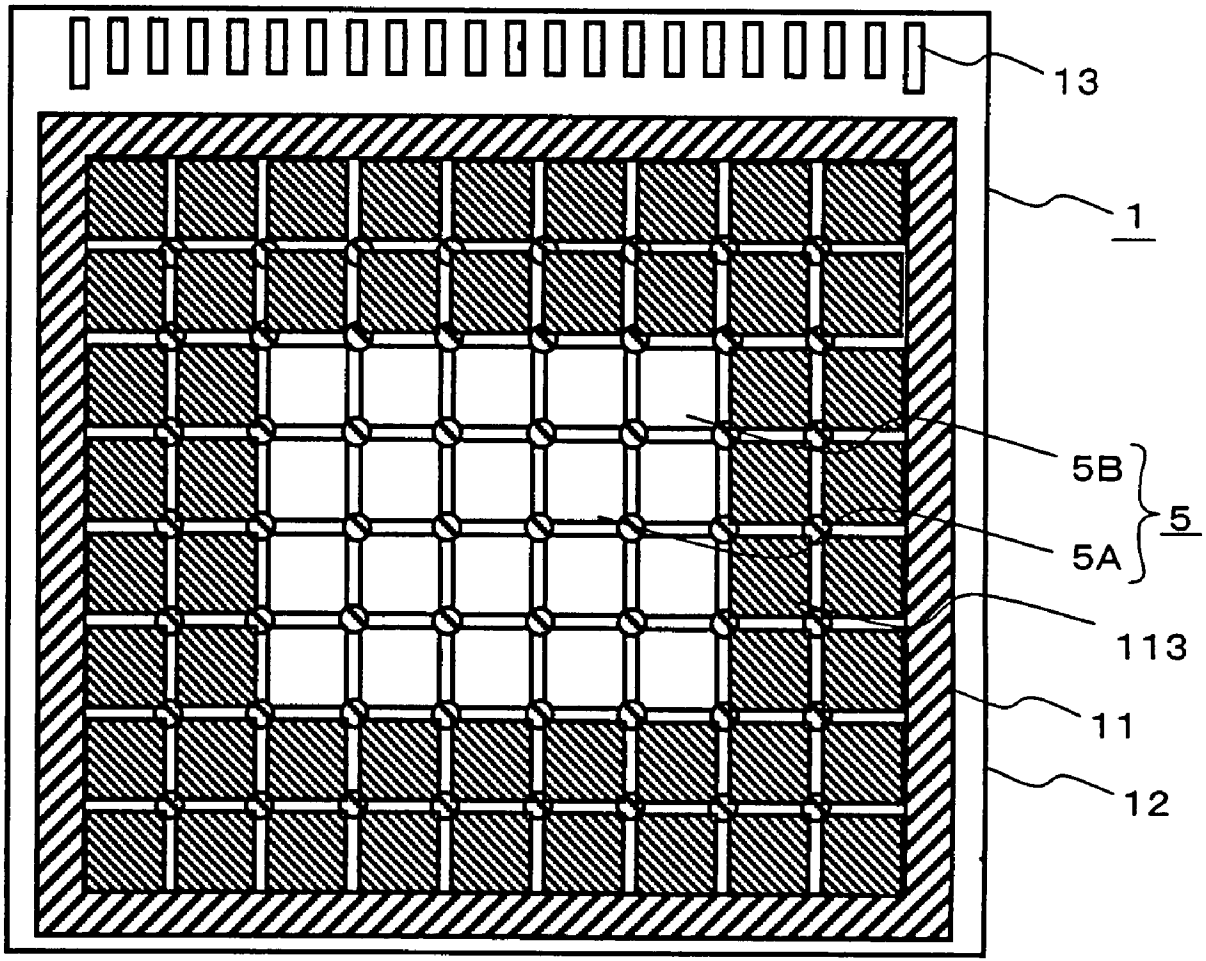
FIG. 45 is a schematic plan view showing a liquid crystal panel of the liquid crystal display device according to the embodiment of the present invention.

FIG. 45 shows a schematic plan view for explaining the arrangement of the reflection electrodes 5 and the spacers 4 mounted on the driving circuit substrate 1. A large number of spacers 4 are arranged on the whole surface of the driving circuit substrate 1 in a matrix array to hold the fixed gap. Each reflection electrode 5 constitutes the minimum pixel of an image which the liquid crystal display element forms. For the sake of brevity, in FIG. 45, the reflection electrodes 5 are constituted such that four pixels are arranged in the longitudinal direction and five pixels are arranged in the lateral direction and these pixels are indicated with symbols 5A, 5B. Here, an outermost-side group of pixels are indicated by 5B and a group of pixels arranged in the inside of the pixels 5B are indicated by 5A.

In FIG. 45, the pixels in a matrix array with four pixels arranged in the longitudinal direction and five pixels arranged in the lateral direction are formed on the display region. The image displayed by the liquid crystal display element is formed on this display region. Dummy pixels 113 are arranged outside the display region. A peripheral frame 11 made of material equal to that of the spacers 4 is arranged around a periphery of the dummy pixels 113. Further, a sealing material 12 is coated outside the peripheral frame 11. Numeral 13 indicates external connection terminals which are served for supplying signals to the liquid crystal panel 100 from the outside.

As the material for the spacers 4 and the peripheral frame 11, resin material is used. As the resin material, for example, a chemical amplification type negative type resist (BPR-113) (product name) produced by JSR Limited can be used. Resist material is coated on the driving circuit substrate 1 on which the reflection electrodes 5 are formed by a spindle coating method or the like and the resist is exposed in a pattern of the spacers 4 and peripheral frame 11 using a mask. Thereafter, the resist is developed using a removing agent so as to form the spacers 4 and the peripheral frame 11.

By forming the spacers 4 and the peripheral frame 11 using the resist material or the like as raw material, it is possible to control the height of the spacers 4 and the peripheral frame 11 based on a film thickness of the coating material so that the spacers 4 and the peripheral frame 11 can be formed with high accuracy. Further, the positions of the spacers 4 can be determined by the mask pattern and hence, the spacers 4 can be set at desired positions accurately. When the spacers 4 are present on the pixels in a liquid crystal projector, there arises a problem that shades of the spacers 4 are recognized in the projected and magnified image. By forming the spacers 4 through exposure and development using the mask pattern, it is possible to form spacers 4 at positions which give rise to no problem when the image is displayed.

Further, since the peripheral frame 11 is formed simultaneously with the spacers 4, as a method for filling the liquid crystal composition 3 between the driving circuit substrate 1 and the transparent substrate 2, a method which drops the liquid crystal composition 3 on the driving circuit substrate 1 and thereafter laminates the transparent substrate 2 to the driving circuit substrate 1 can be used.

After arranging the liquid crystal composition 3 between the driving circuit substrate 1 and the transparent substrate 2 and assembling the liquid crystal panel 100, the liquid crystal composition 3 is held in the region surrounded by the peripheral frame 11. Further, the sealing material 12 is coated on the outside of the peripheral frame 11 so as to seal the liquid crystal composition 3 in the inside of the liquid crystal panel 100. As mentioned previously, since the peripheral frame 11 is formed using the mask pattern, it is possible to form the peripheral frame 1 on the driving circuit substrate 1 with high positional accuracy. Accordingly, the boundary of the liquid crystal composition 3 can be determined with high accuracy. Further, the boundary formed between the peripheral frame 11 and the sealing material 12 can be determined with high accuracy.

The sealing material 12 has a role of fixing the driving circuit substrate 1 and the transparent substrate 2 together and a role of preventing the intrusion of substance which is harmful to the liquid crystal composition 3. When the sealing material 12 having fluidity is coated, the peripheral frame 11 plays a role of a stopper for the sealing material 12. By providing the peripheral frame 11 as the stopper for the sealing material 12, the margin in designing with respect to the boundary of the liquid crystal composition 3 and the boundary of the sealing material 12 can be broadened so that the distance from the end side of the liquid crystal panel 100 to the display region can be narrowed (narrowing of picture frame).

Since the peripheral frame 11 is formed such that the peripheral frame 11 surrounds the display region, there arises a problem that the driving circuit substrate 1 cannot be effectively rubbed in the vicinity of the peripheral frame 11 due to the peripheral frame 11 when the driving circuit substrate 1 is subjected to the rubbing processing. The orientation films are formed so as to orient the liquid crystal composition 3 in the fixed direction and these orientation films are subjected to the rubbing processing. In this embodiment, after forming the spacers 4 and the peripheral frame 11 on the driving circuit substrate 1, the orientation films 7 are coated. Thereafter, the orientation films 7 are subjected to the rubbing processing in which the orientation films 7 are rubbed with a cloth or the like such that the liquid composition 3 is oriented in a fixed direction.

In the rubbing processing, since the peripheral frame 11 is not projected from the driving circuit substrate 1, the orientation films 7 in the vicinity of the peripheral frame 11 cannot receive the sufficient rubbing due to a stepped portion formed by the peripheral frame 11. Accordingly, portions where the orientation of the liquid crystal composition 3 is uneven are liable to be formed in the vicinity of the peripheral frame 11. To make the display irregularities derived from the orientation failure of the liquid crystal composition 3 not apparent, several pixels 113 disposed inside the peripheral frame 11 are formed of the dummy pixels 113 and these dummy pixels 113 are used as pixels which do not contribute to the display.

However, when the dummy pixels 113 are provided and signals are supplied to these dummy pixels 113 in the same manner as the pixels 5A, 5B, since the liquid crystal composition 3 is present between the dummy pixels 113 and the transparent substrate 2, there arises a problem that the display by the dummy pixels 113 is also observed. To use the liquid crystal display element in the normally white mode, when the voltage is not applied to the liquid crystal composition 3, the dummy pixels 113 are displayed white. Accordingly, the boundary of the display region becomes obscure and hence, the display quality is damaged. Although it may be possible to shield light from impinging on the dummy pixels 113, since the distance between the pixels is several μm, it is difficult to form a light shielding frame accurately on the boundary of the display region. Accordingly, voltage which enables the dummy pixels 113 to perform the black display is supplied to the dummy pixels 113 such that the dummy pixels 113 are observed as a black frame which surrounds the display region.

Figure 46:
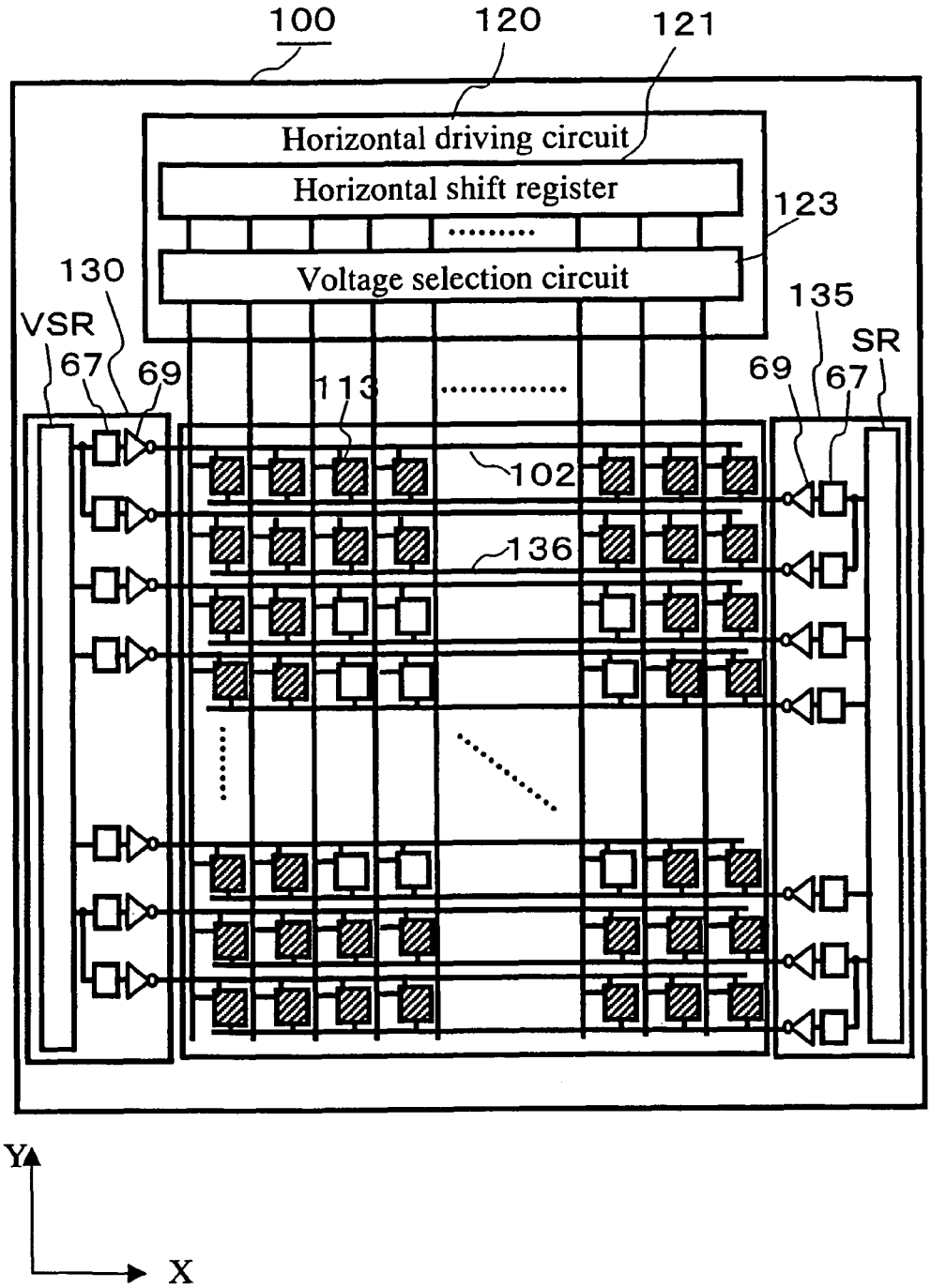
FIG. 46 is a schematic circuit diagram showing a driving method of dummy pixels of the liquid crystal display device according to the embodiment of the present invention.

A method for driving the dummy pixels 113 is explained in conjunction with FIG. 46. Since the voltage which makes the dummy pixels 113 to perform the black display is supplied to the dummy pixels 113, the whole surface of the region where the dummy pixels 113 are formed performs the black display. Since the whole surface of the region performs the black display, it is unnecessary to form the dummy pixels 113 individually as in the same manner as the pixels formed in the display region and a plurality of dummy pixels may be formed such that they are electrically connected. Further, to take time necessary for driving the liquid crystal display element into consideration, it is useless to ensure the writing time for the dummy pixels. Accordingly, it is possible to form one dummy pixel electrode by continuously connecting a plurality of dummy pixels. However, when a plurality of dummy pixels are formed into one dummy pixel by connecting these dummy pixels, the area of the pixel electrode is increased so that the liquid crystal capacitance is enlarged. As mentioned previously, when the liquid crystal capacitance is increased, the efficiency to lower the pixel voltage using the pixel capacitance is lowered.

Accordingly, the dummy pixels are formed individually in the same manner as the pixels in the display region. However, when the writing is performed every one line in the same manner as the effective pixels, the driving time is prolonged by an amount of time necessary for driving a plurality of lines for dummy pixels which are newly provided. Accordingly, there arises a problem that the time for writing data in the effective pixels is shortened by an amount necessary for driving the dummy pixels. Further, to perform the display of high definition, high-speed video signals (signals having high dot clock) are inputted. Accordingly, the restriction on the writing time of pixels is further increased. In view of the above, to save the writing time for several lines during the writing period for one screen, as shown in FIG. 43, the timing signals for a plurality of lines are outputted from the vertical double-way shift register VSR of the vertical driving circuit 130 with respect to the dummy pixels and the timing signals are inputted to a plurality of level shifters 67 and the output circuit 69 so as to make the output circuit 69 output the scanning signals to the dummy pixels 113. Further, also with respect to the pixel potential control circuit 135, the timing signals for a plurality of lines are outputted from the double-way shift register SR and the timing signals are inputted to a plurality of level shifters 67 and the output circuit 69 so as to make the output circuit 69 output the pixel potential control signals to the dummy pixels 113.

Figure 47:
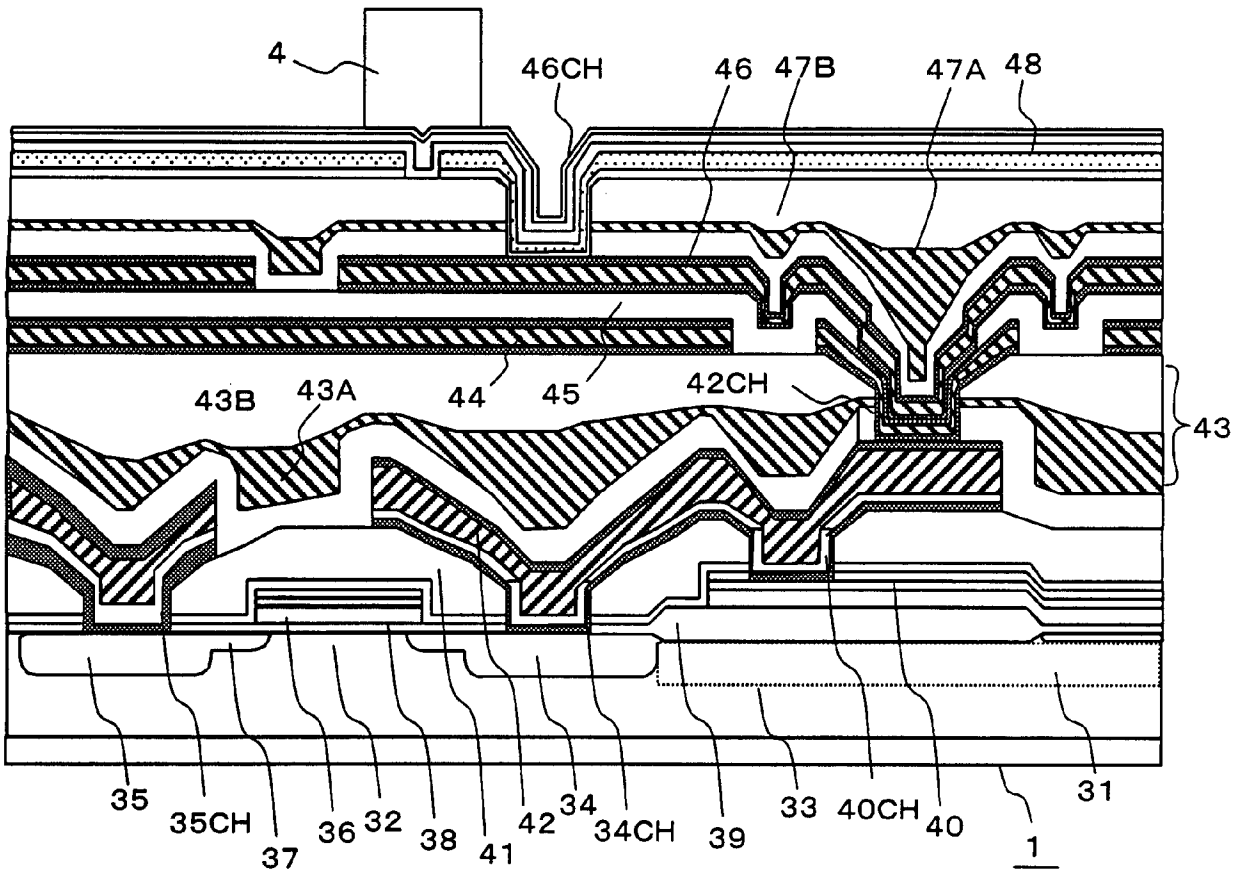
FIG. 47 is a schematic cross-sectional view of a portion in the periphery of an active element of the liquid crystal display device according to the embodiment of the present invention.
Figure 48:
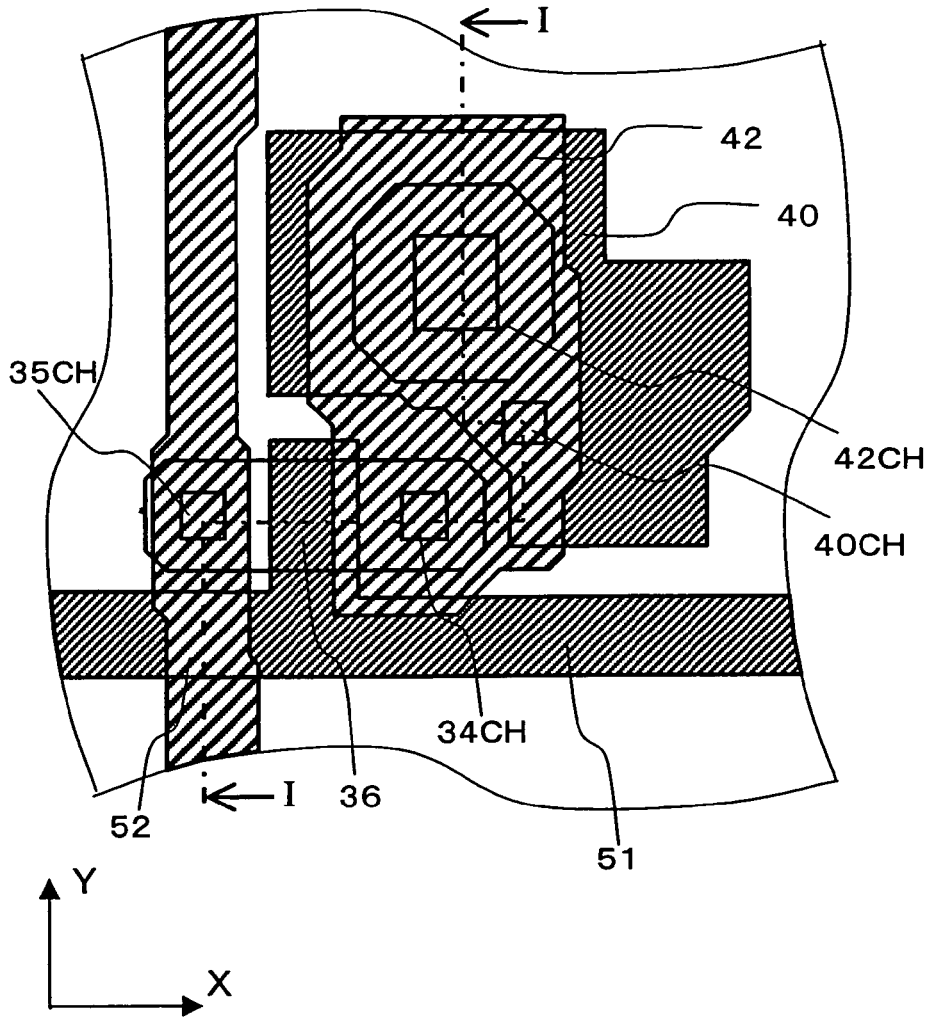
FIG. 48 is a schematic plan view of a portion in the periphery of an active element of the liquid crystal display device according to the embodiment of the present invention.

Subsequently, the constitution of the active element 30 and the peripheral constitution of the active element 30 mounted on the driving circuit substrate 1 are explained in detail in conjunction with FIG. 47 and FIG. 48. In FIG. 47 and FIG. 48, symbols which are equal to those of symbols used in FIG. 38 indicate the identical constitutions or parts. FIG. 48 is a schematic plan view showing the periphery of the active element 30 and FIG. 47 is a cross-sectional view taken along a line I-I in FIG. 48. The distances between respective parts do not agree to each other with respect to FIG. 47 and FIG. 48. Further, FIG. 48 is provided for showing the positional relationship among the scanning signal line 102, the gate electrode 36, the video signal line 103, the source region 35, the drain region 34, the second electrode 40 which forms the pixel capacitance, the first conductive layer 42 and the contact holes 35CH, 34CH, 40CH and 42CH. Other constitutions are omitted.

In FIG. 47, numeral 1 indicates the silicon substrate which constitutes the driving circuit substrate, numeral 32 indicates the semiconductor region (p-type well) which is formed in the silicon substrate 1 by ion implantation, numeral 33 indicates a channel stopper, numeral 34 indicates the drain region which is made conductive and formed in the p-type well 32 by ion implantation, numeral 35 indicates the source region which is formed in the p-type well 32 by ion implantation, and numeral 31 indicates the first electrode of the pixel capacitance which is made conductive and formed in the p-type well 32 by ion implantation. Here, although the active element 30 is formed of the p-type transistor in this embodiment, the active element 30 may be formed of the n-type transistor.

Numeral 36 indicates the gate electrode, numeral 37 indicates an offset region which alleviates the intensity of electric field at an end portion of the gate electrode 36, numeral 38 indicates an insulation film, numeral 39 indicates a field oxide film which electrically separates the transistors and numeral 40 indicates a second electrode which forms the pixel capacitance. That is, the second electrode 40 forms the capacitance between the second electrode 40 and the first electrode 21 which is formed on the silicon substrate 1 by way of the insulation film 38. The gate electrode 36 and the second electrode 40 are formed of a two-layered film formed by laminating a conductive Layer for lowering a threshold value of the active element 30 and a conductive layer of low resistance on the insulation film 38. As the two-layered film, for example, a film formed of polysilicon and tungsten silicide can be used. Numeral 41 indicates the first interlayer film and numeral 42 indicates the first conductive film. The first conductive film 42 is formed of a multi-layered film formed of a barrier metal which prevents the contact failure and a conductive film of low resistance. As the first conductive film, for example, a multi-layered metal film which is made of titanium tungsten and aluminum and is formed by sputtering can be used.

In FIG. 48, numeral 102 indicates the scanning signal line. In FIG. 48, the scanning signal lines 102 are extended in the X direction and are arranged in the Y direction. The scanning signals which turn on or off the active element 30 are supplied to the scanning signal lines 102. Each scanning signal line 102 is formed of a two-layered film in the same manner as the gate electrodes. For example, the two-layered film formed by laminating polysilicon and tungsten silicide can be used as the scanning signal line 102. The video signal lines 103 are extended in the Y direction and are arranged in parallel in the X direction. The video signals which are written in the reflection electrodes 5 are supplied to the video signal lines 103. The video signal line 103 is formed of a multi-layered metal film in the same manner as the first conductive film 42. For example, the multi-layered metal film formed of titanium tungsten and aluminum can be used as the video signal line 103.

The video signals pass through the contact hole 35CH formed in the first interlayer film 41 and are transmitted to the drain region 35 through the first conductive film 42. When the scanning signals are supplied to the scanning signal line 102, the active element 30 is turned on, while the video signals are transmitted to the source region 34 through the semiconductor region (p-type well) 32 and are transmitted to the first conductive film 42 through the contact hole 34CH. The video signals which are transmitted to the first conductive film 42 are transmitted to the second electrode 40 of pixel capacitance through the contact hole 40CH.

Further, as shown in FIG. 47, the video signals are transmitted to the reflection electrode 5 through the contact hole 42CH. The contact hole 42CH is formed in the field oxide film 39. Since a film thickness of the field oxide film 39 is large, the contact hole 42CH is disposed at the high position compared to other constitutions. By forming the contact hole 42CH in the field oxide film 39, it is possible to dispose the contact hole 42CH at a position close to the conductive film forming the upper layer so that the length of a connection portion of the contact hole 42CH can be shortened.

Further, as shown in FIG. 47, the second interlayer film 43 provides an insulation between the first conductive film 42 and the second conductive film 44. The second insulation film 43 is formed of two layers consisting of a flattening film 43A which absorbs irregularities formed due to respective parts and an insulation film 43B which covers the flattening film 43A. The flattening film 43A is formed by coating SOG (Spin On Glass). The insulation film 43B is formed of a TEOS film and is formed of SiO2 film by a CVD method using TEOS (tetraethylorthosilikate) as a reaction gas.

After forming the second interlayer film 43, the second interlayer film 43 is polished by CMP (Chemical Mechanical Polishing). The second interlayer film 43 can be flattened by polishing using CMP. The first light shielding film 44 is formed on the flattened second interlayer film. The first light shielding film 44 is formed of a multi-layered metal film made of tungsten and aluminum in the same manner as the first conductive film 42.

The first light shielding film 44 covers substantially the whole surface of the driving circuit substrate 1 and an opening is constituted of only a portion of the contact hole 42CH shown in FIG. 45. The third interlayer film 45 is formed on the first light shielding film 44 using a TEOS film. Further, the second light shielding film 46 is formed on the third interlayer film 45. The second light shielding film 46 is formed of a multi-layered metal film made of tungsten and aluminum in the same manner as the first conductive film 42. The second light shielding film 46 is connected with the first conductive film 42 through the contact hole 42CH. In the contact hole 42CH, a metal film which forms the first light shielding film 44 and a metal film which forms the second light shielding film 46 are laminated to establish the connection.

By providing the constitution in which the first light shielding film 44 and the second light shielding film 46 are formed of conductive films, the third interlayer film 45 disposed between the first light shielding film 44 and the second light shielding film 46 is formed of an insulation film (a dielectric film), the pixel potential control signals are supplied to the first light shielding film 44, and the gray scale voltage is supplied to the second light shielding film 46, it is possible to form the pixel capacitance by the first light shielding film 44 and the second light shielding film 46. Further, to take the dielectric strength of the third interlayer film 45 with respect to the grayscale voltage and the fact that the capacitance can be increased by decreasing the film thickness into considerations it is preferable to set the film thickness of the third interlayer film 45 to a value which falls in a range from 150 nm to 450 nm and it is further preferable to set the film thickness to approximately 300 nm.

Figure 49:
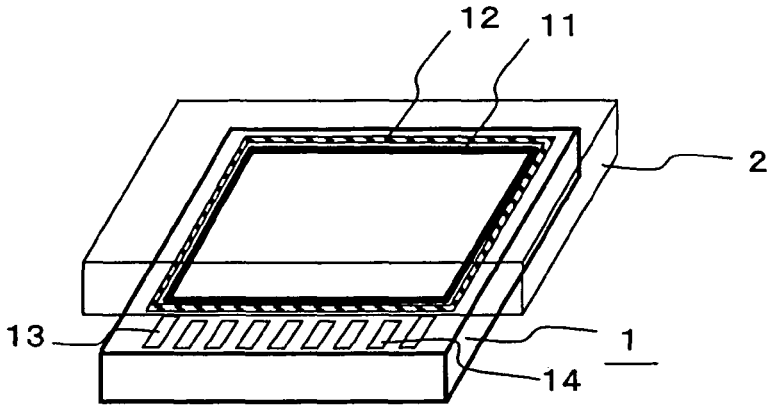
FIG. 49 is a schematic perspective view showing the liquid crystal panel of the liquid crystal display device according to the embodiment of the present invention.

Subsequently, FIG. 49 shows the constitution in which the transparent substrate 2 is superposed on the driving circuit substrate 1. The peripheral frame 11 is formed on a peripheral portion of the driving circuit substrate 1 and the liquid crystal composition 3 is held in a space surrounded by the peripheral frame 1, the driving circuit substrate 1 and the transparent substrate 2. Between the driving circuit substrate 1 and the transparent substrate 2 which are superposed each other and on the outside of the peripheral frame 11, the sealing material 12 is coated. The driving circuit substrate 1 and the transparent substrate 2 are fixed to each other by adhesion using the sealing material 12 so as to form the liquid crystal panel 100. Numeral 13 indicates the external connection terminals.

Figure 50:
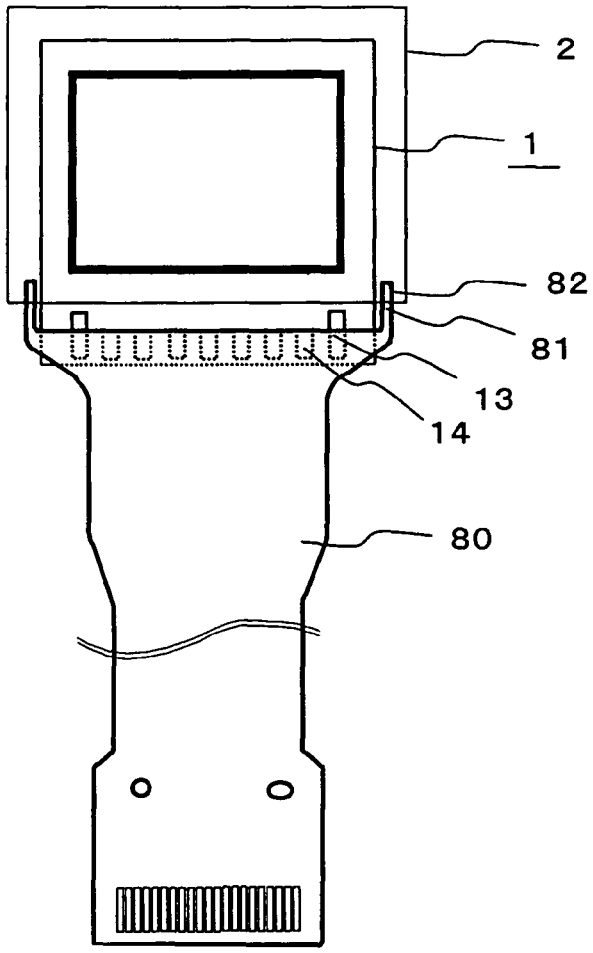
FIG. 50 is a schematic view showing a state in which a flexible printed circuit board is connected to the liquid crystal panel of the liquid crystal display device according to the embodiment of the present invention.

Then, as shown in FIG. 50, the flexible printed circuit board 80 which supplies the signals from the outside is connected to the external connection terminals 13. The flexible printed circuit board 80 has both outside terminals elongated compared to the other terminals and these outside terminals are connected to the counter electrodes 5 formed on the transparent substrate 2 thus forming counter electrode terminals 81. That is, the flexible printed wiring board 80 is connected to both of the driving circuit substrate 1 and the transparent substrate 2.

With respect to the wiring to the conventional counter electrodes 5, the flexible printed circuit board is connected to external connection terminals formed on the driving circuit substrate 1 and the flexible printed circuit board is connected to the counter electrodes 5 through the driving circuit substrate 1. Connection portions 82 connected with the flexible printed circuit board 80 are formed on the transparent substrate 2 of this embodiment such that the flexible printed circuit board 80 and the counter electrodes 5 are connected to each other directly. That is, although the liquid crystal panel 100 is formed by superposing the transparent substrate 2 and the driving circuit substrate 1, a portion of the transparent substrate 2 is projected toward the outside from the driving circuit substrate 1 so as to form the connection portion 82 and the transparent substrate 2 is connected to the flexible printed wiring board 80 at the portion projected toward the outside.

Figure 51:
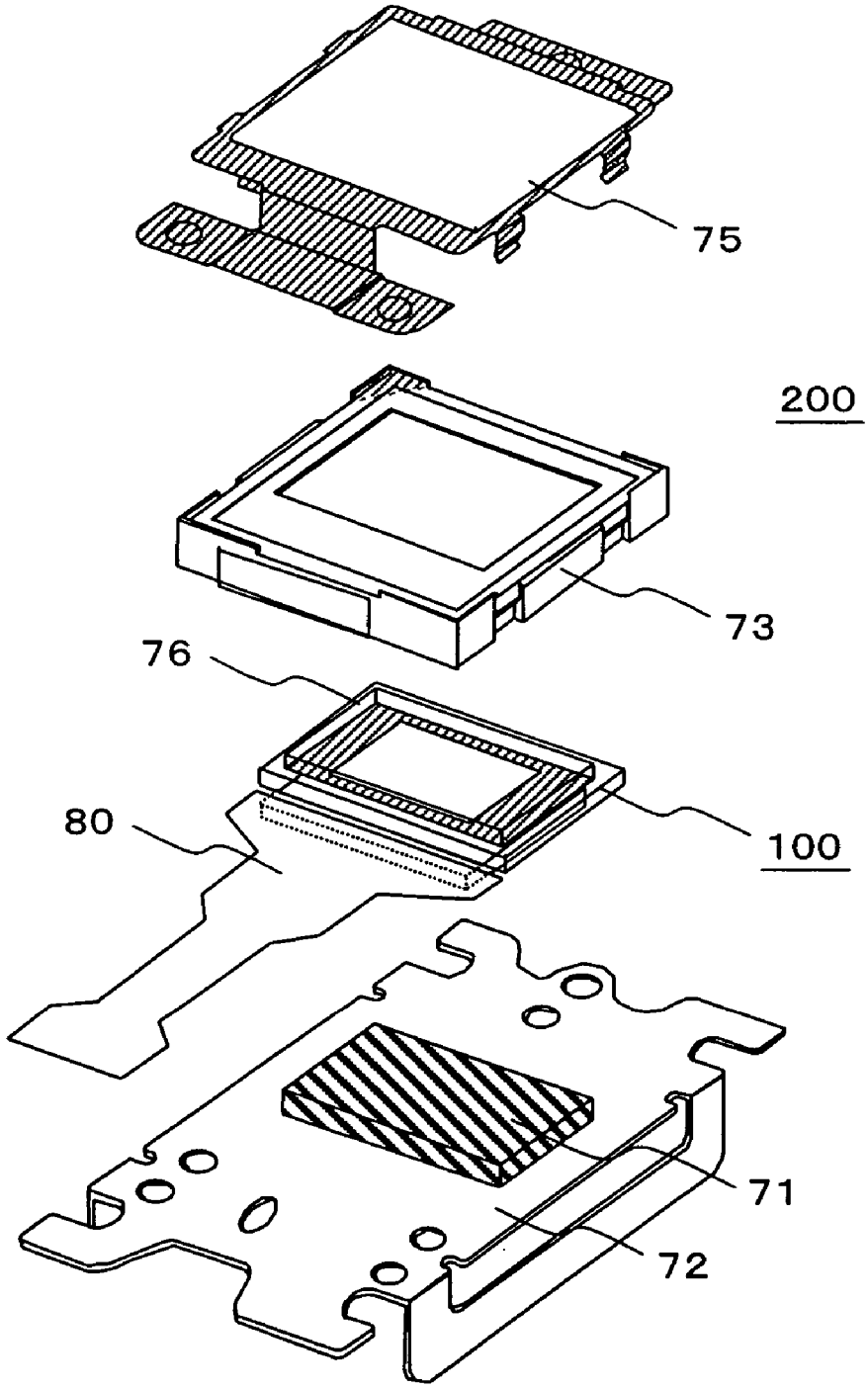
FIG. 51 is a schematic assembly view showing the liquid crystal display device according to the embodiment of the present invention.
Figure 52:
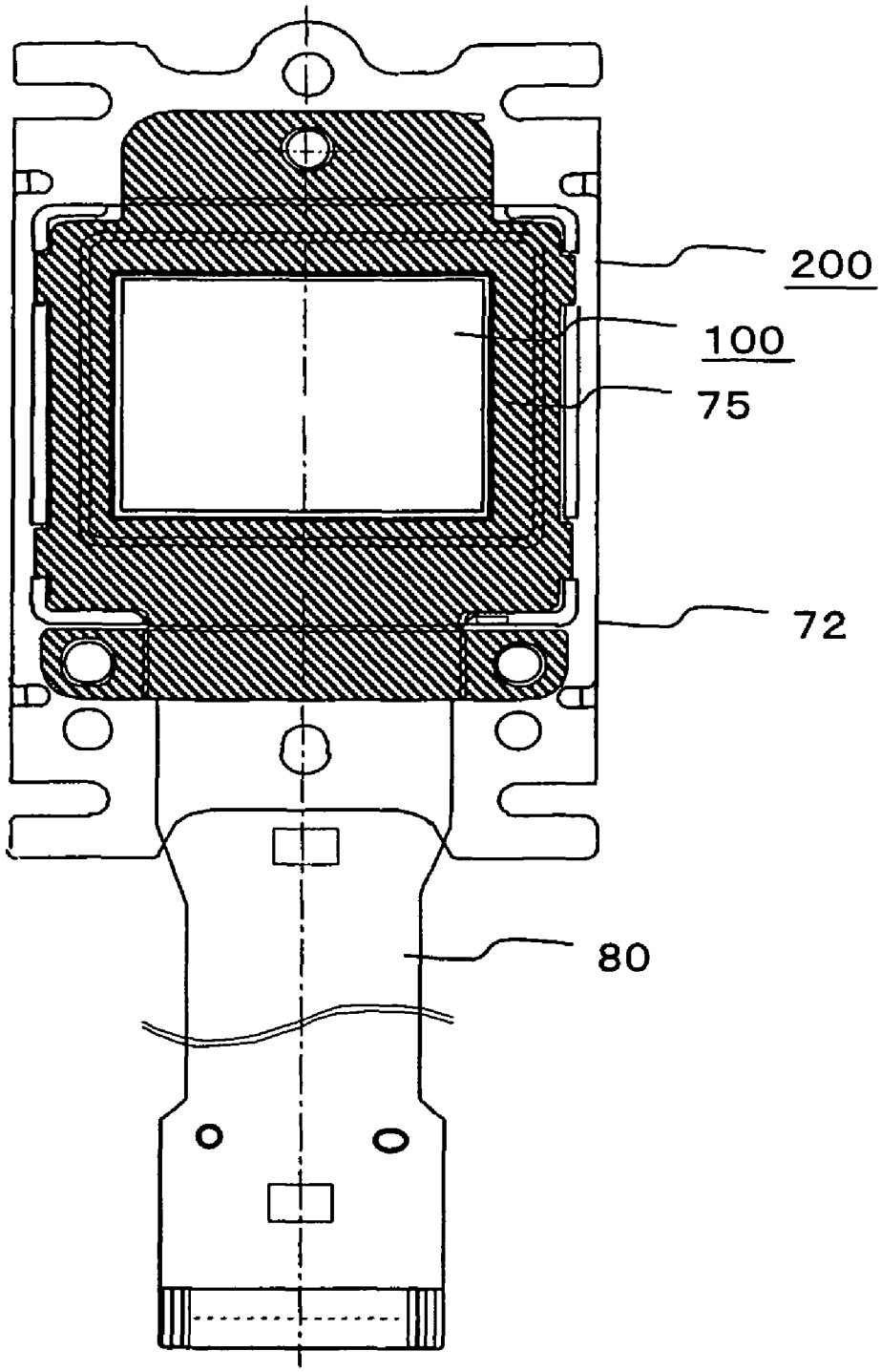
FIG. 52 is a schematic view showing the liquid crystal display device according to the embodiment of the present invention.

The constitution of the liquid crystal display device 200 is shown in FIG. 51 and FIG. 52. FIG. 51 is an exploded assembly view of respective parts constituting the liquid crystal display device 200. Further, FIG. 52 is a plan view of the liquid crystal display device 200.

As shown in FIG. 51, the liquid crystal panel 100 to which the flexible printed wiring board 80 is connected is arranged on a radiator plate 72 with a cushion member 71 sandwiched between the liquid crystal panel 100 and the radiator plate 72. The cushion member 71 has the high heat conductivity and is filled in a gap formed between the radiator plate 72 and the liquid crystal panel 100. That is, the cushion member 71 has a role to facilitate the transfer of heat of the liquid crystal panel 100 to the radiator plate 72. Numeral 73 indicates a mold and is fixed to the radiator 72 by adhesion.

Further, as shown in FIG. 51, the flexible printed wiring board 80 passes through a gap formed between the mold 73 and the radiator plate 72 and is taken out to the outside of the mold 73. Numeral 75 indicates the light shielding plate which prevents light from the light source from impinging on other parts which constitute the liquid crystal display device 200. Numeral 76 indicates a light shielding frame and forms an outer frame of the display region of the liquid crystal display device 200.

Although the inventions which have been made by the inventors have been specifically explained heretofore based on the above-mentioned embodiments of the present invention, the present inventions are not limited to the above-mentioned embodiments and various modifications can be conceived without departing from the sprit of the present invention.

EFFECT OF THE INVENTION

To recapitulate the main advantageous effects obtained by the typical inventions out of the inventions disclosed in the present application, they are as follows.

According to the present inventions, the irregularities of the signals can be corrected and hence, the quality of images can be enhanced when the images are displayed using the liquid crystal.

According to the present inventions, since the correction of the irregularities can be changed using software, the reduction of cost can be achieved without performing the change of constants on hardware.

EXPLANATION OF SYMBOLS

11 . . . peripheral frame, 12 . . . sealing material, 14 . . . external connection terminal, 25 . . . scanning reset signal input terminal, 26 . . . scanning start signal input terminal, 27 . . . scanning completion signal output terminal, 28 . . . transistor for resetting, 30 . . . active element, 34 . . . source region, 35 . . . drain region, 36 . . . gate region, 38 . . . insulation film, 39 . . . field oxide film, 41 . . . first interlayer film, 42 . . . first conductive film, 43 . . . second interlayer film, 44 . . . first light shielding film, 45 . . . third interlayer film, 46 . . . second light shielding film, 47 . . . fourth interlayer film, 48 . . . second conductive film, 61 to 62 . . . clocked inverter, 65 to 66 . . . clocked inverter, 71 . . . cushion member, 72 . . . radiator plate, 73 . . . mold, 74 . . . protective adhesive material, 75 . . . light shielding plate, 76 . . . light shielding frame, 80 . . . flexible wiring board, 100 . . . liquid crystal panel, 101 . . . pixel portion, 102 . . . scanning signal line, 103 . . . video signal line, 104 . . . switching element, 107 . . . counter electrode, 108 . . . liquid crystal capacitance, 109 . . . pixel electrode, 110 . . . display part, 111 . . . display control device, 120 . . . horizontal driving circuit, 121 . . . horizontal shift register, 122 . . . display data holding circuit, 123 . . . voltage selection circuit, 130 . . . vertical driving circuit, 131 . . . control signal line, 132 . . . display data line, 400 . . . video signal control circuit, 401 . . . external control signal line, 402 . . . display signal line, 403 . . . AD converter, 404 . . . signal processing circuit, 405 . . . DA converter, 406 . . . amplification and alternation circuit, 407 . . . sample hold circuit, 409 . . . sample hold circuit (for digital), 410 . . . analogue driver, 413 . . . operational amplifier (for amplification), 414 . . . operational amplifier (for negative polarity), 415 . . . operational amplifier (for positive polarity), 416 . . . analogue switch (for changeover of operational amplifier), 417 . . . analogue switch (for changeover of look up table), 418 . . . analogue switch (for changeover of video source), 420 . . . lookup table (LUT),

421 . . . lookup table (one package), 422 . . . look up table for positive polarity, 423 . . . look up table for negative polarity, 424 . . . look up table for first video source, 425 . . . look up table for second video source, 426 . . . look up table for third video source, 427 . . . look up table for first gray scale, 428 . . . look up table for second gray scale, 429 . . . standard look up table, 430 . . . microcomputer, 431 . . . frame memory, 432 . . . timing controller, 433 . . . first frame memory, 434 . . . second frame memory, 435 . . . data bus, 436 address bus, 37 . . . inner switch, 438 . . . external switch, 440 . . . block memory, 445 . . . test pattern memory

What is claimed is:

1. A liquid crystal display device comprising:

a liquid crystal panel and a video signal control circuit which supplies video signals to the liquid crystal panel, wherein the video signal control circuit includes a first frame memory, a second frame memory, a first switching element, and a second switching element, the video signal control circuit is configured to convert a frame driving frequency to be faster than an average response time of human eyes by adjusting a reading-out speed of parallel digital data from the first frame memory and the second frame memory, the liquid crystal panel includes a first substrate and a second substrate, a columnar spacer is disposed between the first substrate and the second substrate, in a first frame, the first switching element outputs parallel digital data from the first frame memory and the second switching element inputs parallel digital data to the second frame memory, and in a second frame, the first switching element outputs parallel digital data from the second frame memory and the second switching element inputs parallel digital data to the first frame memory.

2. A liquid crystal display device according to claim 1, wherein convergence is adjusted using the first frame memory and the second frame memory.

3. A liquid crystal display device according to claim 1, the columnar spacer is made of a resist material.

4. A liquid crystal display device comprising a liquid crystal panel and a video signal control circuit supplying video signals to the liquid crystal panel, wherein the video signal control circuit includes a first frame memory, a second frame memory, a first switching element, and a second switching element, the video signal control circuit is configured to output the video signals faster than an average response time of human eyes by adjusting a reading-out speed of parallel digital data from the first frame memory and the second frame memory, the liquid crystal panel includes a first substrate and a second substrate, a columnar spacer is disposed between the first substrate and the second substrate, in a first frame, the first switching element outputs parallel digital data from the first frame memory and the second switching element inputs parallel digital data to the second frame memory, and in a second frame, the first switching element outputs parallel digital data from the second frame memory and the second switching element inputs parallel digital data to the first frame memory.

5. A liquid crystal display device according to claim 4, wherein convergence is adjusted using the first frame memory and the second frame memory.

6. A liquid crystal display device according to claim 4, wherein the columnar spacer is made of a resist material.

7. A liquid crystal display device comprising a liquid crystal panel and a video signal control circuit supplying video signals to the liquid crystal panel, wherein the video signal control circuit includes a first frame memory, a second frame memory, a first switching element, and a second switching element, the video signal control circuit is configured to output the video signals faster than an average response time of human eyes by adjusting a reading-out speed of parallel digital data from the first frame memory and the second frame memory, the liquid crystal panel includes a columnar spacer made of a resist material, the liquid crystal panel is filled with a liquid crystal composition by a dropping method, in a first frame, the first switching element outputs parallel digital data from the first frame memory and the second switching element inputs parallel digital data to the second frame memory, and in a second frame, the first switching element outputs parallel digital data from the second frame memory and the second switching element inputs parallel digital data to the first frame memory.

8. A liquid crystal display device according to claim 7, wherein convergence is adjusted using the first frame memory and the second frame memory.

* * * * *